US008070246B2

(12) United States Patent
Otsuki

(10) Patent No.: US 8,070,246 B2
(45) **Date of Patent: *Dec. 6, 2011**

(54) PRINTING UP TO EDGES OF PRINTING PAPER WITHOUT PLATEN SOILING

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/912,592

(22) Filed: Oct. 26, 2010

(65) Prior Publication Data

US 2011/0084994 A1 Apr. 14, 2011

Related U.S. Application Data

(63) Continuation of application No. 12/042,223, filed on Mar. 4, 2008, now abandoned, which is a continuation of application No. 10/888,403, filed on Jul. 9, 2004, now Pat. No. 7,360,888, which is a continuation of application No. 09/960,618, filed on Sep. 21, 2001, now Pat. No. 6,930,696.

(30) Foreign Application Priority Data

Sep. 27, 2000 (JP) ..... 2000-294074
Sep. 27, 2000 (JP) ..... 2000-294142
Sep. 27, 2000 (JP) ..... 2000-294172

(51) Int. Cl.
*B41J 29/38* (2006.01)

(52) U.S. Cl. ..... 347/5; 347/16; 347/104

(58) Field of Classification Search ..... 347/5, 9, 347/16, 104

See application file for complete search history.

(56) References Cited

U.S. PATENT DOCUMENTS 4,198,642 A 4/1980 Gamblin
5,646,667 A 7/1997 Broder et al.
5,844,585 A 12/1998 Kurashima et al.
6,168,320 B1 1/2001 Ono et al.

(Continued)

FOREIGN PATENT DOCUMENTS

EP 0995603 4/2000

(Continued)

OTHER PUBLICATIONS

European Search Report from EP Application 10185186.3, dated Nov. 23, 2010.

*Primary Examiner* — Lam S Nguyen

(57) ABSTRACT

This invention allows images to be printed up to the edges of printing paper while preventing ink droplets from depositing on the platen. Ink droplets Ip are ejected from a print head 28 and printing is started when printing paper P is fed in the sub-scanning direction by upstream paper feed rollers 25*a* and 25*b*, and the front edge Pf reaches a position above a downstream slot 26*r*. Since printing is started when the front edge Pf of printing paper P has reached a position behind nozzle No. 1, images can be printed without forming blank spaces up to the front edge Pf of the printing paper P by causing the nozzles to eject ink droplets Ip irrespective of whether the nozzles are above the printing paper. When images are formed in the vicinity of the front edge Pf of printing paper P, the paper is repeatedly fed in small increments in the sub-scanning direction, and printing is carried out. Adopting this arrangement makes it possible to print images on the front-edge portion of the printing paper when the paper is above the downstream slot 26*r*.

6 Claims, 42 Drawing Sheets

U.S. PATENT DOCUMENTS

| | | | |
|---|---|---|---|
| 6,239,817 | B1 | 5/2001 | Meyer |
| 6,457,803 | B1 | 10/2002 | Ohkoda |
| 6,964,466 | B1 | 11/2005 | Kodama et al. |

FOREIGN PATENT DOCUMENTS

| | | | |
|---|---|---|---|
| EP | 1043166 | | 10/2000 |
| EP | 1 186 993 | | 3/2002 |
| JP | 08-169155 | | 9/1995 |
| JP | 08 207381 | A | 8/1996 |
| JP | 11-245397 | | 1/1999 |
| JP | 2000 25210 | A | 1/2000 |
| JP | 2000 118058 | A | 4/2000 |
| JP | 2000 351205 | A | 12/2000 |
| JP | 2001 54955 | A | 2/2001 |
| JP | 2001 106802 | A | 4/2001 |

PRINTING UP TO EDGES OF PRINTING PAPER WITHOUT PLATEN SOILING

CROSS-REFERENCE TO RELATED APPLICATIONS

This application is a continuation of co-pending U.S. patent application Ser. No. 12/042,223, filed Mar. 4, 2008, and entitled "PRINTING UP TO EDGES OF PRINTING PAPER WITHOUT PLATEN SOILING," which is continuation of U.S. patent application Ser. No. 10/888,403, filed Jul. 9, 2004, and entitled "PRINTING UP TO THE EDGES OF PRINTING PAPER WITHOUT PLATEN SOILING," now U.S. Pat. No. 7,360,888, which is a continuation of U.S. patent application Ser. No. 09/960,618, filed Sep. 21, 2001, entitled "PRINTING UP TO THE EDGES OF PRINTING PAPER WITHOUT PLATEN SOILING," now U.S. Pat. No. 6,930,696. All of the foregoing patents and patent applications are hereby incorporated herein by reference in their entirety for all purposes.

BACKGROUND OF THE INVENTION

1. Field of the Invention

The present invention relates to a technique for recording dots on the surface of a recording medium with the aid of a dot-recording head, and more particularly to a technique for printing images up to the edges of printing paper without soiling the platen.

2. Description of the Related Art

Printers in which ink is ejected from the nozzles of a print head have recently become popular as computer output devices. FIG. 44 is a side view depicting the periphery of a print head for a conventional printer. Printing paper P is supported on a platen 26*o* while facing the head 280. The printing paper P is fed in the direction of arrow A by the upstream paper feed rollers 25*p* and 25*q* disposed upstream of the platen 26*o* and by the downstream paper peed rollers 25*r* and 25*s* disposed downstream of the platen 26*o*. Dots are recorded and images printed on the printing paper P when ink is ejected from the head.

SUMMARY OF THE INVENTION

When an attempt is made to print images up to the edges of printing paper with the aid of such a printer, it is necessary to arrange the printing paper such that the edges of the printing paper are disposed underneath the print head (that is, on the platen) and to cause ink droplets to be ejected from the print head. With such printing, however, the ink droplets sometimes miss the edges of the printing paper (for which the droplets have been originally intended) and end up depositing on the platen due to errors developing during the feeding of the printing paper, a shift in the impact location of the ink droplets, or the like. In such cases, the ink deposited on the platen soils the printing paper transported over the platen in the next step.

It is an object of the present invention, which was perfected in order to overcome the above-described shortcomings of the prior art, to provide a technique that allows images to be printed up to the edges of printing paper while preventing ink droplets from depositing on the platen.

Perfected in order to at least partially overcome the above-described shortcomings, the present invention envisages performing specific procedures for a dot-recording device designed to record ink dots on a surface of a print medium with the aid of a dot-recording head provided with a plurality of dot-forming elements for ejecting ink droplets. The dot-recording device comprises a platen configured to extend in the main scanning direction and to be disposed opposite the dot-forming elements at least along part of a main scan path, the platen being configured to support the print medium, a width of the slot in the sub-scanning direction corresponding to a specific sub-scanning range on a surface of the dot recording head including at least part of the plurality of dot-forming elements.

The specific sub-scanning range preferably includes at least one of two end ranges in the sub-scanning at opposite ends of the dot-recording head, each end range including at least one dot-forming element.

The printing (dot-forming) procedure performed by such a printing device entails driving the dot-recording head and/or the print medium to perform main scanning, driving at least some of the dot-forming elements to form dots, and causing the print medium to undergo sub-scanning by being driven across the main scanning direction in between the main scans. In the process, printing near an edge of the printing medium is effected in a first recording mode, in the first recording mode the controller performing edge printing by ejecting ink droplets from at least some of the dot-forming elements disposed opposite the slot when the print medium is supported on the platen, and the edge of the print medium is disposed above the slot. Printing in an intermediate portion of the print medium is effected in a second recording mode, a maximum sub-scan feed amount in the second recording mode being greater than a maximum sun-scan feed amount in the first recording mode.

According to this embodiment, ink droplets can be prevented from depositing on the plate, and areas extending all the way to the edges of printing paper can be printed without blank spaces with the aid of dot-forming elements disposed opposite the slot.

The edge portions should preferably be printed such that the ink droplets are prevented from being ejected by any dot-forming elements other than those disposed opposite the slot. Adopting this embodiment makes it possible to prevent ink droplets from soiling the platen when the preceding portion of the print medium is insufficiently fed in the sub-scanning direction and the front edge of the print medium being printed fails to reach the position above the slot; that is, when the front edge of the print medium rests on the platen, and part of the platen is disposed directly opposite the dot-recording head. The same applies to cases in which the print medium is fed in the sub-scanning direction in an excessive manner and the rear edge of the print medium passes beyond the slot when images are printed on the rear edge of the print medium.

Images should preferably be printed in the edge portions when the front edge of the print medium is above the slot in cases in which the slot is provided at a position opposite at least a dot-forming element that is disposed along a downstream edge in the sub-scanning direction. Such an embodiment allows images to be printed without blank space along the front edge of the print medium.

In addition, images should preferably be printed in the edge portions when the rear edge of the print medium is above the slot opening in cases in which the slot is provided at a position opposite at least a dot-forming element that is disposed along an upstream edge in the sub-scanning direction. Such an embodiment allows images to be printed without blank spaces along the rear edge of the print medium.

The following benefits are obtained when dots are recorded in this manner in accordance with an embodiment in which the sub-scanning unit for performing sub-scanning in a printing device comprises an upstream sub-scanning unit configured to hold and move the print medium, the upstream sub-scanning unit being disposed on an upstream side in the sub-scanning direction with respect to the dot-recording head; and a downstream sub-scanning unit configured to hold and move the print medium, the downstream sub-scanning unit being disposed on a downstream side in the sub-scanning direction with respect to the dot-recording head.

In the above-described printing device, sub-scanning is accomplished solely with the upstream or downstream sub-scanning unit when images are printed in the edge portions of a print medium. According to the printing procedure adopted for this printing device, the printing distance can be reduced by accomplishing sub-scanning solely with the upstream or downstream sub-scanning unit.

The sub-scanning of the first recording mode should preferably be performed in a feed amount corresponding to a single dot pitch in the sub-scanning direction. Adopting this arrangement makes it possible to print images in the edge portions of the recording medium with nozzles that are close to the edge portions in the sub-scanning direction in the dot-recording head.

Such printing should preferably involve generating image data representing an image extending outside the print medium beyond the edge on which the edge printing is performed, and forming dots on the basis of these image data. Adopting this arrangement makes it possible to print images on the portions of the print medium extending beyond the intended position on the basis of images provided for an area outside the print medium even when the print medium is positioned incorrectly.

A length of an area of the image outside the print medium is preferably set less than the slot width. According to this arrangement, the print medium can be positioned relative to the dot-recording head such that the ink droplets for recording images in an area beyond the edge portion on which images are printed in accordance with the edge-portion printing routine adopted for the print medium are caused to descend into the slot when these ink droplets fail to deposit on the print medium.

Perfected in order to at least partially overcome the above-described shortcomings, the present invention envisages performing specific procedures for a dot-recording device designed to record dots on the surface of a print medium with the aid of a dot-recording head provided with a plurality of dot-forming elements for ejecting ink droplets.

This dot-recording device comprises a platen configured to extend in the main scanning direction while disposed opposite the dot-forming elements at least along part of a main scan path. The platen has an upstream slot that extends in the main scanning direction at a position opposite a dot-forming element disposed at an upstream edge of the dot-recording head in the sub-scanning direction. The platen has also a downstream slot that extends in the main scanning direction at a position opposite a dot-forming element disposed at a downstream edge of the dot recording head in the sub-scanning direction.

In the printing, the dot-recording head and/or the print medium are/is driven to perform main scanning, driving at least some of the dot-forming elements to form dots, and causing the print medium to undergo sub-scanning by being driven across the main scanning direction in between the main scans. Print data is prepared that is containing the image data for recording images in an expanded area that extends lengthwise beyond at least the front and rear edges of the print medium. Ink droplets are ejected onto the expanded area on the basis of the print data. Performing printing with the aid of such a dot-recording device makes it possible to print images up to the edges of printing paper while preventing ink droplets from depositing on the platen.

In the printing on the expanded area, the position of the print medium in the sub-scanning direction is preferably selected such that the print medium is supported on the platen, the front edge of the print medium is brought to a point above the downstream slot, and the front edge reaches a point located in the sub-scanning direction upstream of the dot-forming element on the downstream edge in the sub-scanning direction when ink droplets are ejected onto the front edge of the print medium. The position of the print medium in the sub-scanning direction is preferably selected such that the print medium is supported on the platen, the rear edge of the print medium is brought to a point above the upstream slot, and the rear edge of the print medium reaches a point located in the sub-scanning direction downstream of the dot-forming elements on the upstream edge in the sub-scanning direction when ink droplets are ejected onto the rear edge of the print medium. Adopting this embodiment makes it possible to extend printing up to edge portions without soiling the platen by printing images at the front edge of the print medium above the upstream slot, and at the rear edge of the print medium above the downstream slot.

Following embodiment is preferable in the case that the dot-recording method is such that the platen further has a pair of lateral slots separated apart at a distance substantially equal to a width of the print medium, the lateral slots extending in a sub-scanning range in which ink droplets are ejected from the plurality of dot-forming elements. The image represented by the image data extends widthwise into opposite expanded areas beyond left and right edges of the print medium but remains between outside edges of the pair of lateral slots. Adopting this embodiment makes it possible to print images without blank spaces at the left and right edges of the print medium.

In the printing on the expanded area, the position of the print medium in the main scanning direction is preferably selected such that the print medium is supported on the platen, and the two edges of the print medium are kept at positions above the corresponding lateral slots. Adopting this embodiment makes it possible to print images without blank spaces at the left and right edges of the print medium without soiling the platen.

The print data preferably includes information about a recording condition of dots in pixels in the expanded areas. Adopting this embodiment can make it easier to specify the portions of an expanded area that lie beyond the edges of a print medium.

Perfected in order to at least partially overcome the above-described shortcomings, the present invention envisages performing specific procedures for a dot-recording device designed to record dots on the surface of a print medium with the aid of a dot-recording head provided with a plurality of dot-forming elements for ejecting ink droplets. The platen of this printer comprises a first support, a first slot and a second support. The first support supports the print medium and extends in the main scanning direction at a position opposite a first sub-group of dot-forming elements selected from the plurality of dot-forming elements. The first slot extends in the main scanning direction at a position opposite a second sub-group of dot-forming elements which are disposed in the sub-scanning direction downstream from the first sub-group of dot-forming elements. The second support supports the print medium and extends in the main scanning direction at a position opposite a third sub-group of dot-forming elements which are disposed in the sub-scanning direction downstream from the second sub-group of dot-forming elements. The platen of this printer may further comprise a second slot. The second slot extends in the main scanning direction at a position opposite a fourth sub-group of dot-forming elements which are disposed in the sub-scanning direction downstream from the third sub-group of dot-forming elements.

Adopting such an embodiment allows the upper-edge portion of the print medium, which is fed over the platen from the upstream side (in the course of sub-scanning), to be supported on the first support. It is therefore unlikely that the upper-edge portion (front-edge portion) will fall into the first slot during sub-scanning. It is also possible to print images without blank spaces all the way to the edges of the print medium with the aid of the second sub-group of dot-forming elements (disposed opposite the first slot) and/or the third sub-group of dot-forming elements (disposed opposite the second slot).

The printing (dot-forming) procedure performed by such a printing device entails forming dots on a print medium with the aid of the second to fourth sub-groups of dot-forming elements without the use of the first sub-group of dot-forming elements in accordance with a first image-printing mode for printing images without blank spaces up to the front and/or rear edges of the print medium. The printing procedure also entails forming dots on the print medium with the aid of the first to fourth sub-groups of dot-forming elements in accordance with a second image-printing mode for printing images with blank spaces along the front and rear edges of the print medium. Adopting such an embodiment makes it possible to prevent ink droplets from depositing on the platen and to print images without blank spaces along the edges of the print medium with the aid of dot-forming elements disposed opposite the slots in accordance with the first image-printing mode. Images can be printed faster with the second image-printing mode than with the first image-printing mode because the first sub-group of dot-forming elements is used in addition to the dot-forming elements involved in performing the first image-printing mode.

Assuming that the surface area of the print medium is divided into an upper-edge portion containing the front edge of the print medium, a lower-edge portion containing the rear edge of the print medium, and an intermediate portion disposed between the upper-edge portion and lower-edge portion, the following embodiment is preferable. In the upper-edge portion of the print medium, dots are formed with the aid of the fourth sub-group of dot-forming elements without the use of any of the first to third sub-groups of dot-forming elements. In the intermediate portion of the print medium, dots are formed with the aid of the second to fourth sub-groups of dot-forming elements without the use of the first sub-group of dot-forming elements. In the lower-edge portion of the print medium, dots are formed with the aid of the second sub-group of dot-forming elements without the use of the first, third, or fourth sub-group of dot-forming elements. As used herein, the term "using sub-groups of dot-forming elements" refers to the partial use of at least some of the dot-forming elements when an image is printed. The term "a sub-group of dot-forming elements is left unused" refers to the fact that none of the dot-forming elements belonging to this sub-group of dot-forming elements is used even once when an image is printed.

Because this embodiment entails using the fourth sub-group of dot-forming elements to print images in the upper-edge portion of the print medium, ink droplets are directed to the second slot, and the platen supports are prevented from being soiled when the ink droplets thus ejected miss the upper-edge portion. Similarly, using the second sub-group of dot-forming elements to print images in the lower-edge portion allows ink droplets to be directed to the first slot and prevents platen supports from being soiled when the ink droplets miss the lower-edge portion. It is therefore possible to prevent platen supports from being soiled and to form dots all the way to the front and rear edges of the print medium. Fast printing can be achieved for the intermediate portion because of the use of the second to fourth sub-groups of dot-forming elements.

In the case that the dot-recording device is such that the dot-recording head is aligned in the main scanning direction and provided with a plurality of dot-forming element groups for ejecting different types of ink, the following embodiment is preferable. The first slot is a single slot provided opposite the second sub-groups of dot-forming elements selected from the plurality of dot-forming element groups. The second slot is a single slot provided opposite the fourth sub-groups of dot-forming elements selected from the plurality of dot-forming element groups. Adopting such an embodiment allows dots to be formed using different types of ink in accordance with the first image-printing mode.

The present invention can be implemented as the following embodiments.

(1) A dot-recording method, print control method, or printing method.

(2) A dot-recording device, print control device, or printing device.

(3) A computer program for operating the device or implementing the method.

(4) A storage medium containing computer programs for operating the device or implementing the method.

(5) A data signal carried by a carrier wave and designed to contain a computer program for operating the device or implementing the method.

These and other objects, features, aspects, and advantages of the present invention will become more apparent from the following detailed description of the preferred embodiments with the accompanying drawings.

DESCRIPTION OF THE PREFERRED EMBODIMENT

Embodiments of the present invention will now be described through embodiments in the following sequence.

A. Overview of Embodiments
B. First Embodiment
C. Second Embodiment
D. Third Embodiment
E. Fourth Embodiment
F. Fifth Embodiment
G. Sixth Embodiment
H. Modifications

A. Overview of Embodiments

Figure 1:
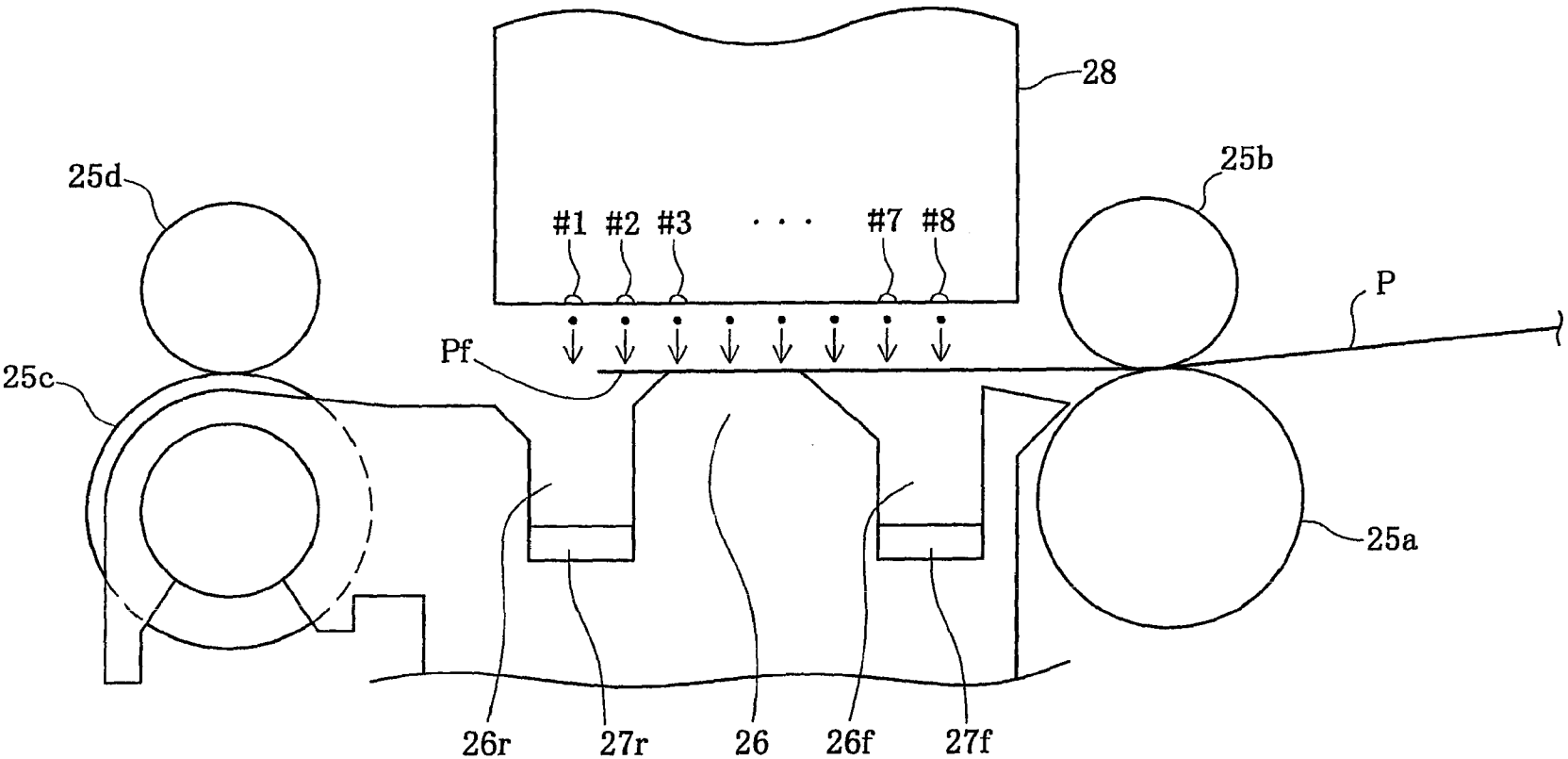
FIG. 1 is a side view depicting the structure of the periphery of a print head for an ink-jet printer configured according to an embodiment of the present invention.

FIG. 1 is a side view depicting the structure of the periphery of a print head for an ink-jet printer configured according to an embodiment of the present invention. In FIG. 1, printing paper P is supported and fed (in the sub-scanning direction) by upstream paper feed rollers 25*a* and 25*b*, and the front edge Pf thereof passes over an upstream slot 26*f* and a platen 26, reaching an opening above a downstream slot 26*r*. At this point, ink droplets Ip are ejected from the print head 28, and printing is started. Even when the paper is fed incorrectly, images can be printed up to the edges without leaving blank spaces on the front-edge portion Pf of the printing paper P because printing is started when the front edge Pf of the printing paper P has moved beyond nozzle No. 1. The ink droplets not deposited on the printing paper P are absorbed by an absorbent member 27*r*.

Printing should preferably be carried out by repeatedly scanning the medium in the sub-scanning direction in small feed-per-dot increments when images are printed near the front edge Pf of the printing paper P. This approach makes it easier to print images in the area containing the front edge of the printing paper above the downstream slot 26*r*.

Figure 2:
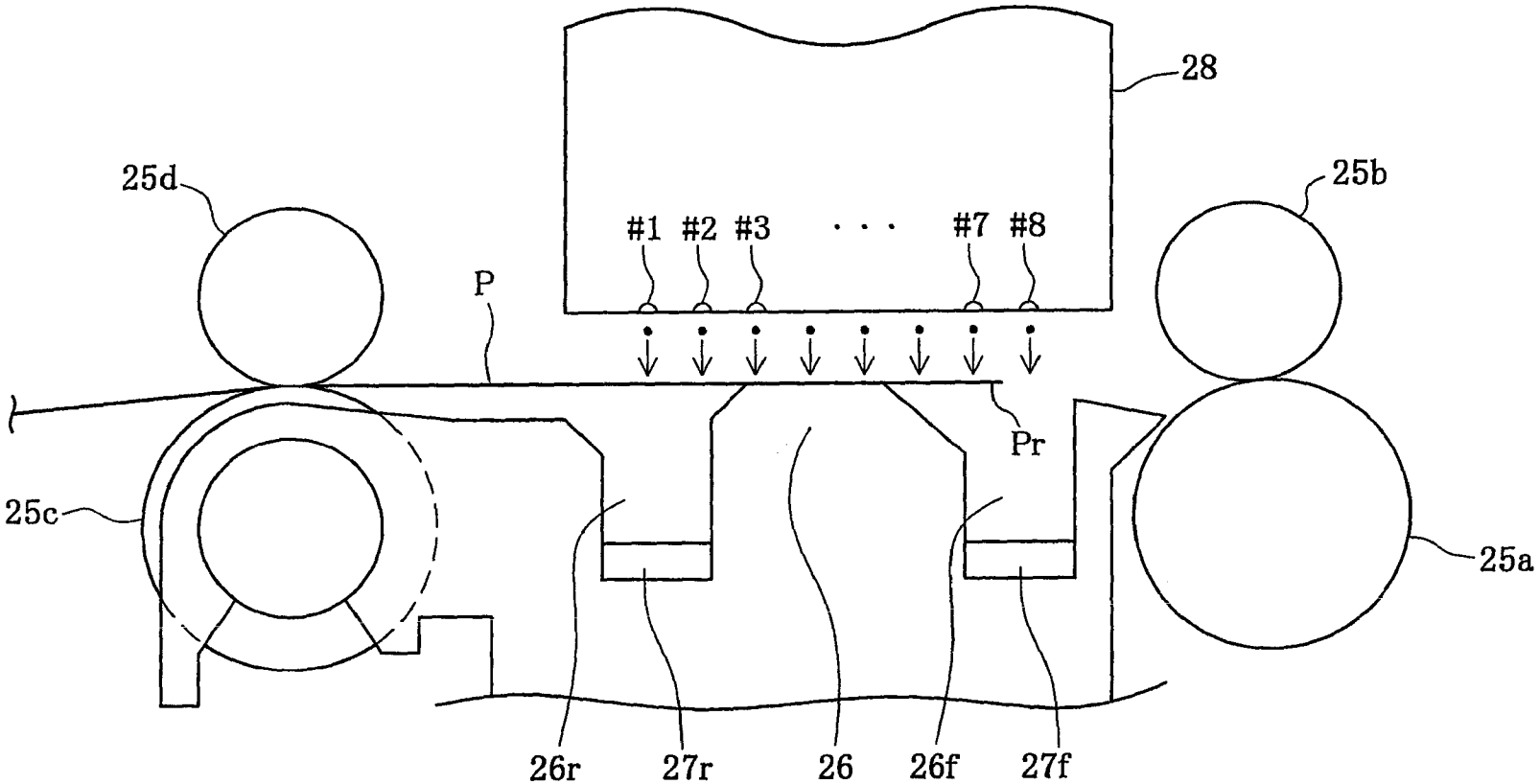
FIG. 2 is a diagram depicting the manner in which images are printed on the rear edge Pr of printing paper P.

FIG. 2 depicts the manner in which images are printed on the rear edge Pr of the printing paper P. In FIG. 2, printing paper P is supported and fed solely by downstream paper feed rollers 25*c* and 25*d*, and the rear edge Pr thereof reaches the opening above the downstream slot 26*r* in the final stages of printing. At this point, ink droplets are ejected from the print head 28, and images are printed in the area containing the rear edge of the printing paper. Even when the paper is fed incorrectly, images can be printed up to the edges without leaving blank spaces on the rear-edge portion Pr of the printing paper because printing is performed when the rear edge Pr of the printing paper P has not yet reached nozzle No. 8. The ink droplets not deposited on the printing paper P are absorbed by an absorbent member 27*f*.

Printing should preferably be carried out by repeatedly scanning the medium in the sub-scanning direction in small increments when images are printed near the rear edge Pr of the printing paper. This approach makes it easier to print images in the area containing the rear edge of the printing paper above the upstream slot 26*f*.

Figure 3:
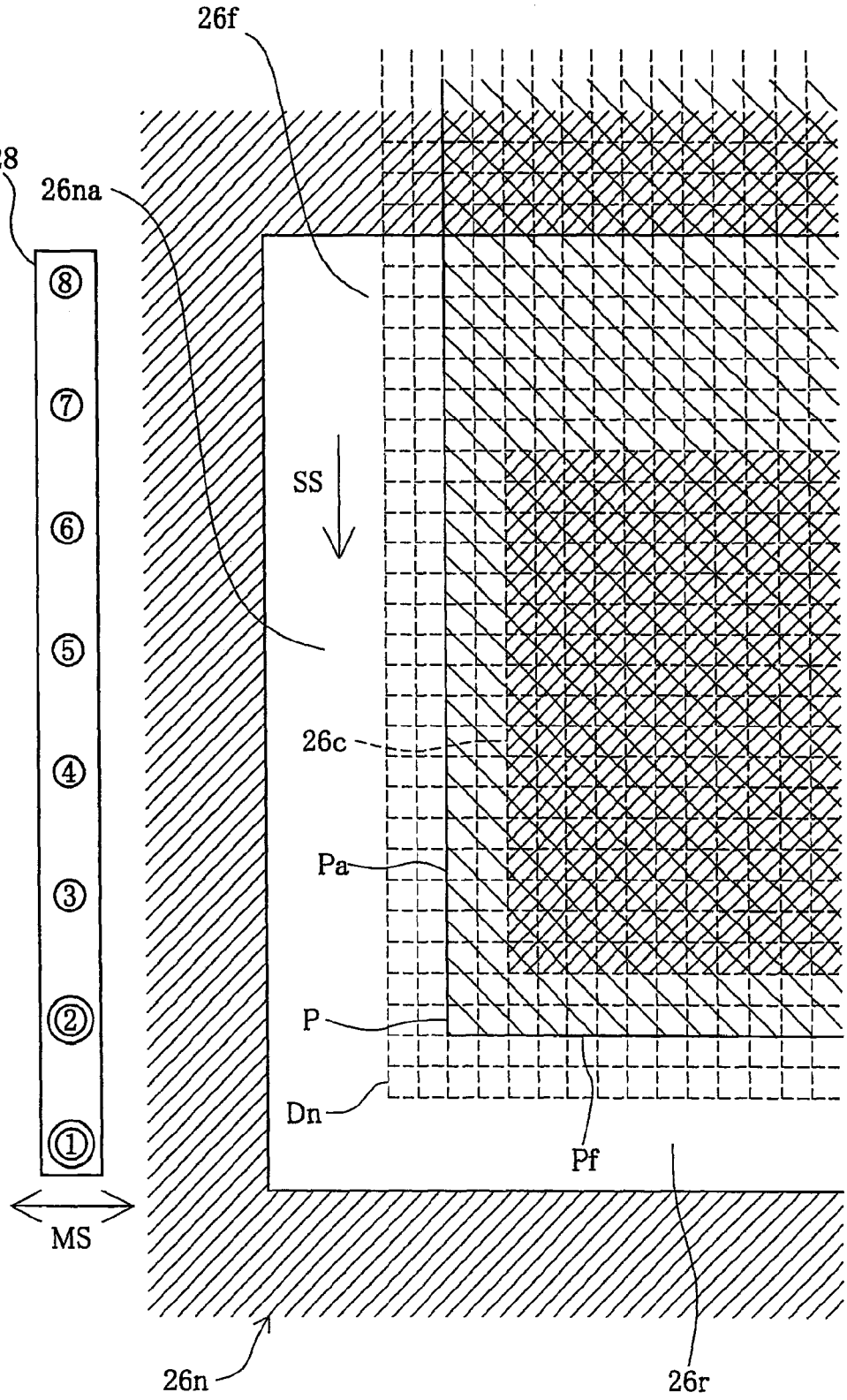
FIG. 3 is a diagram depicting the structure of the mechanical portion of the present printing device.

FIG. 3 is a magnified plan view depicting the structure of part of the left side of a platen provided to an ink-jet printer in accordance with an embodiment of the present invention. The platen 26*n* is provided with a downstream slot 26*r*, upstream slot 26*f*, left slot 26*na*, and right slot 26*nb* (not shown) in a quadrilateral arrangement. The area enclosed in these slots is the central portion 26*c* of the platen 26*n*. The slot-free upper surface of the platen is shown in FIG. 3 as the part hatched with thin oblique lines from top right to bottom left. Nozzle Nos. 1 and 2 (shown by double circle signs) of the print head 28 pass above the downstream slot 26*r* when the print head 28 is fed in the course of main scanning in the direction of arrow MS. In FIG. 3, the printing paper P is fed in the course of sub-scanning in the direction of arrow SS from top to bottom. In the process, the printing paper P is guided by guides (not shown) and is fed in the course of sub-scanning such that the two edges thereof are positioned above the left slot 26*na* and right slot 26*nb* of the platen 26*n*.

The image data Dn used to record images on the printing paper P are compiled as information about the images to be recorded as dots in each pixel of a rectangular grid that covers the image area. In FIG. 3, the pixels are shown by broken lines. These pixels are also specified for areas that lie beyond the external edges of the printing paper P, as can be seen in FIG. 3. In FIG. 3, the printing paper P is the portion hatched with thick oblique lines from top left to bottom right.

When set in the guides, the printing paper P is fed in the course of sub-scanning in the direction of arrow SS. The feeding of the printing paper P in the course of sub-scanning stops when the front edge thereof reaches a position upstream of nozzle No. 1 above the downstream slot 26*r*. Nozzle Nos. 1 and 2 subsequently start printing images in the upper-edge portion Pf of the printing paper P (located downstream in FIG. 3 because the printing paper P is shown in reverse from top to bottom). Images can be printed without blank spaces on the upper edge of the printing paper P because the dot-recording pixels are specified for areas lying beyond the upper edge Pf of the printing paper P. In addition, the fact that nozzle Nos. 1 and 2, which are used for printing, are disposed above the downstream slot 26*r* allows ink droplets to fall into the downstream slot 26*r* and to deposit in the central portion 26*c* of the platen 26*n* when these droplets miss the printing paper P. It is thus possible to prevent the lower surface of the printing paper P from being soiled by the ink droplets depositing on the central portion 26*c* of the platen 26*n*. The pixels specified for the areas beyond the left and right edge portions of the printing paper P are printed by the nozzles disposed above the left slot 26*na* and right slot 26*nb* (not shown) during main scanning. It is therefore possible to print images on the left and right edges without soiling the central portion 26*c* of the platen 26*n*.

B. First Embodiment

(1) Device Structure

Figure 4:
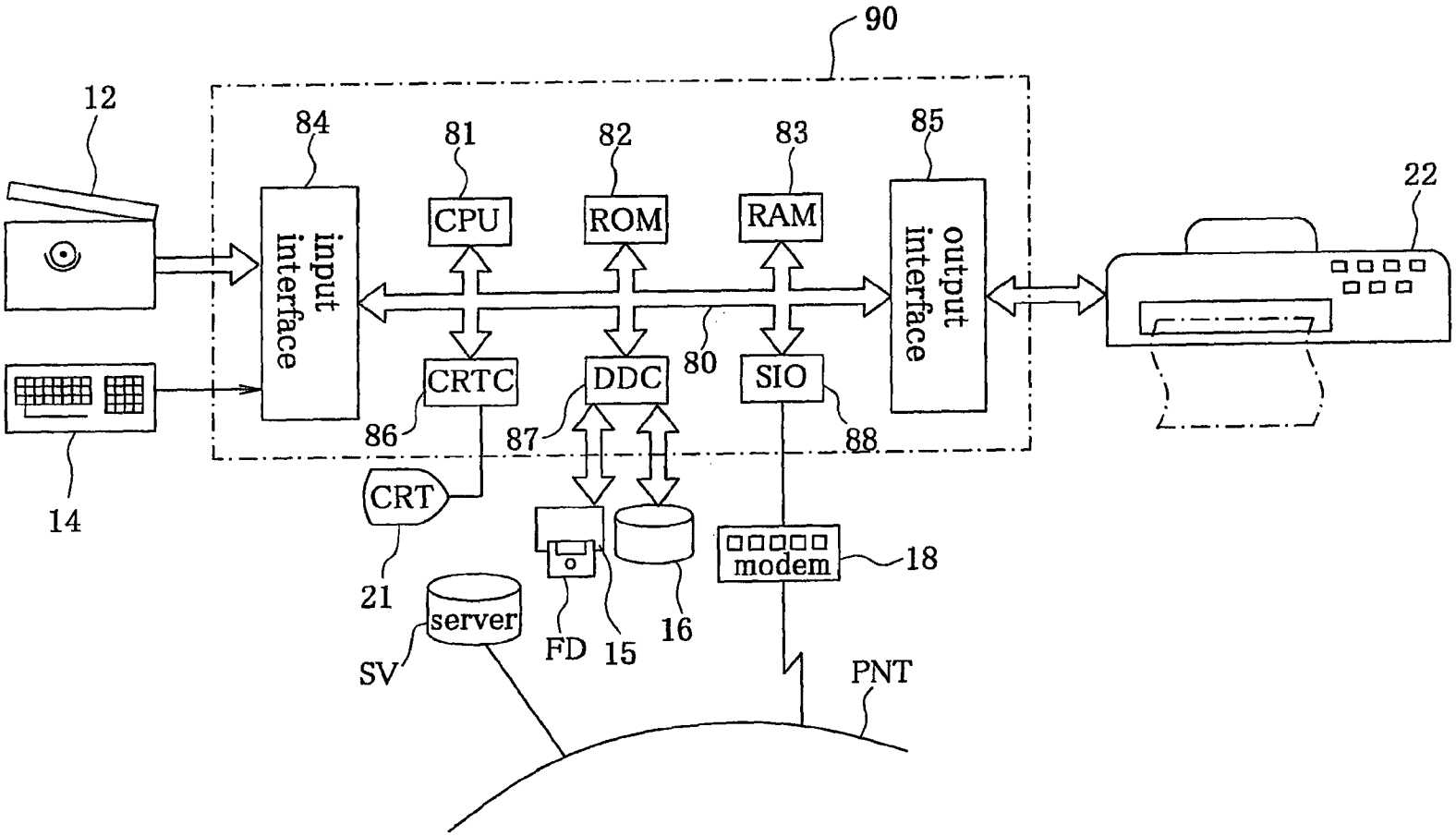
FIG. 4 is a block diagram depicting the structure of an image processing device and a printing device as embodiments of the present invention.

FIG. 4 is a block diagram depicting the structure of an image processing device and a printing device as embodiments of the present invention. A scanner 12 and a printer 22 are connected to a computer 90 in the manner shown in the drawing. In addition to being able to function as an image processing device, the system can function as a printing device in conjunction with the printer 22 as a result of the fact that specific programs are loaded and executed by the computer 90. The following units are connected to each other by a bus 80 in the computer 90, which is based on a CPU 81 for performing arithmetic processing in order to control various routines related to image processing in accordance with the programs: ROM 82 is used to store data processing software or the data to be processed by the CPU 81, and RAM 83 is a memory designed to temporarily store data processing software or the data to be processed. The input interface 84 is used to enter signals from the scanner 12 or keyboard 14, and the output interface 85 is used to output data to the printer 22. The CRTC 86 is used to control signal output for a CRT 21 capable of displaying information in color, and the disk controller (DDC) 87 is designed to control data exchange involving a hard disk 16, floppy drive 15, or CD-ROM drive (not shown). The hard disk 16 contains the programs to be loaded and executed by the RAM 83, various types of software provided in the form of device drivers, and the like.

A serial input/output interface (SIO) 88 is also connected to the bus 80. The SIO 88 is connected to a modem 18, and to a public telephone network PNT via this modem 18. The computer 90 is connected to an external network through the agency of the SIO 88 and modem 18, and a connection to a specific server SV allows image processing software to be downloaded to the hard disk 16. The required software can also be copied from a floppy disk FD or CD-ROM and executed by the computer 90.

Figure 5:
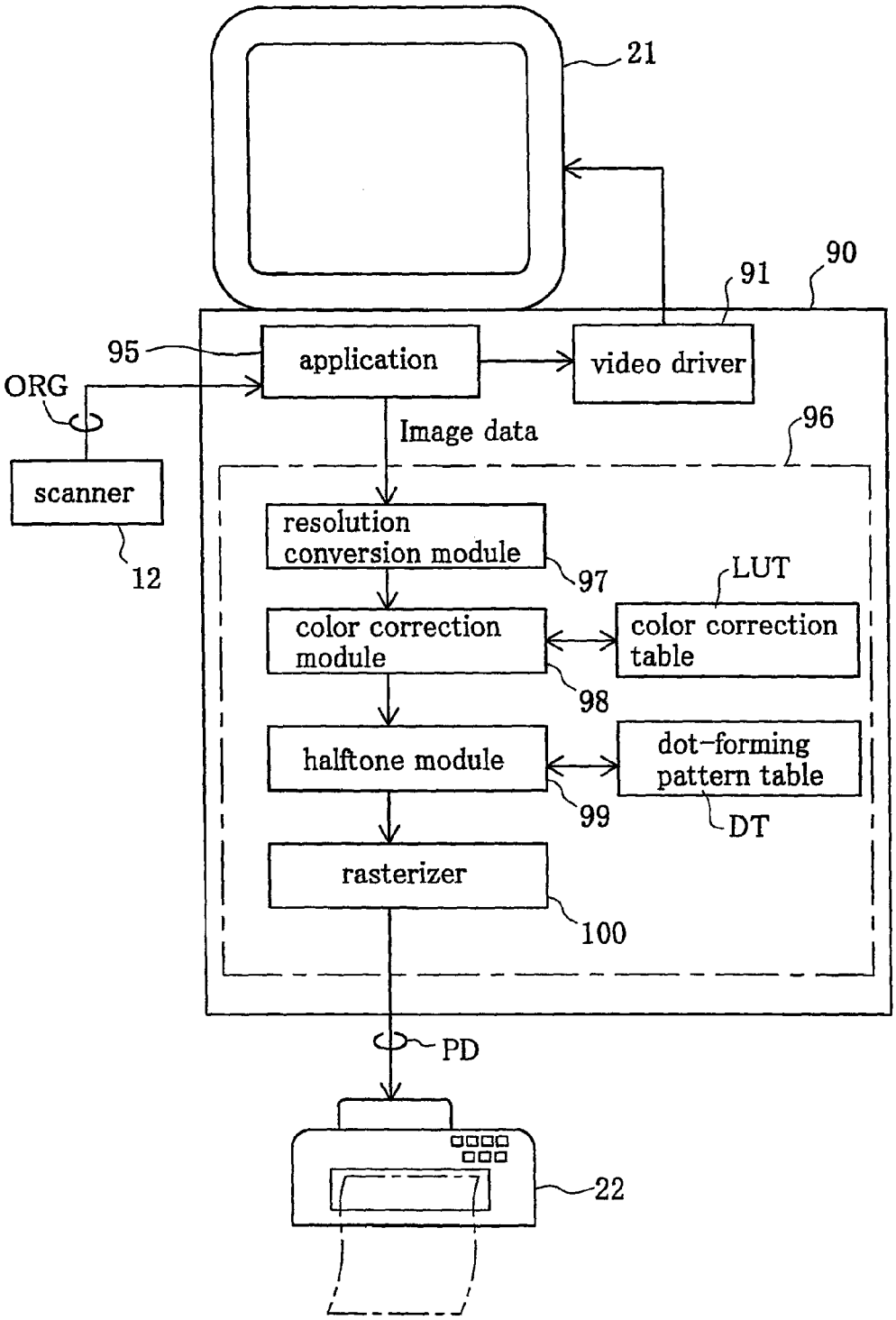
FIG. 5 is a block diagram depicting the structure of the software for the present printing device.

FIG. 5 is a block diagram depicting the structure of the software for the present printing device. In the computer 90, an application program 95 is executed within the framework of a specific operating system. The operating system contains a video driver 91 or a printer driver 96, and the application program 95 outputs the image data D to be transferred to the printer 22 by means of these drivers. The application program 95 for performing video retouching or the like allows images to be read from the scanner 12 and displayed by the CRT 21 by means of the video driver 91 while processed in a prescribed manner. The data ORG presented by the scanner 12 are in the form of primary-color image data ORG obtained by reading a color original and composed of the following three color components: red (R), green (G), and blue (B).

When the application program 95 generates a printing command, the printer driver 96 of the computer 90 receives image data from the application program 95, and the resulting data are converted to a signal that can be processed by the printer 22 (in this case, into a signal containing multiple values related to the colors cyan, magenta, light cyan, light magenta, yellow, and black). In the example shown in FIG. 5, the printer driver 96 comprises a resolution conversion module 97, a color correction module 98, a halftone module 99, and a rasterizer 100. A color correction table LUT and a dot-forming pattern table DT are also stored. The application program 95 corresponds to the image data generator.

The role of the resolution conversion module 97 is to convert the resolution of the color image data handled by the application program 95 (that is, the number of pixels per unit length) into a resolution that can be handled by the printer driver 96. Because the image data converted in terms of resolution in this manner are still in the form of video information composed of three colors (RGB), the color correction module 98 converts these data into the data for each of the colors (cyan (C), magenta (M), light cyan (LC), light magenta (LM), yellow (Y), and black (K)) used by the printer 22 for individual pixels while the color correction table LUT is consulted.

The color-corrected data have a gray scale with 256 steps, for example. The halftone module 99 executes a halftone routine for expressing this gray scale in the printer 22 by forming dispersed dots. The halftone module 99 executes the halftone routine upon specifying the dot formation patterns of the corresponding ink dots in accordance with the gray scale of the image data by consulting the dot-forming pattern table DT. The image data thus processed are sorted according to the data sequence to be transferred to the printer 22 by the rasterizer 100, and are outputted as final print data PD. The print data PD contain information about the amount of feed in the sub-scanning direction and information about the condition of dot recording during each main scan.

The data about the condition of dot recording and the data about the amount of feed in the sub-scanning direction both in the print data PD correspond to image data D, which substantially specify the images to be printed. Specifically, these data contain, as image data, information about the manner in which dots are recorded in each pixel inside the expanded area.

In the present embodiment, the sole role of the printer 22 is to form ink dots in accordance with the print data PD without processing the images, although it is apparent that such processing can also be carried out by the printer 22.

The overall structure of the printer 22 will now be described with reference to FIG. 6. As can be seen in the drawing, the printer 22 comprises a mechanism for transporting paper P with the aid of a paper feed motor 23; a mechanism for reciprocating a carriage 31 in the axial direction of the platen 26 with the aid of a carriage motor 24; a mechanism for actuating the print head 28 mounted on the carriage 31 and ejecting the ink to form ink dots; and a control circuit 40 for exchanging signals between the paper feed motor 23, the carriage motor 24, the print head 28, and a control panel 32.

The mechanism for reciprocating the carriage 31 perpendicular to the direction of transport of the printing paper P comprises a sliding shaft 34 mounted perpendicular to the direction of transport of the printing paper P and designed to slidably support the carriage 31, a pulley 38 for extending an endless drive belt 36 from the carriage motor 24, a position sensor 39 for sensing the original position of the carriage 31, and the like.

The carriage 31 can support a cartridge 71 for black ink (K) and a color-ink cartridge 72 containing inks of the following six colors: cyan (C), light cyan (LC), magenta (M), light magenta (LM), and yellow (Y). A total of six ink-ejecting heads 61 to 66 are formed in the print head 28 in the bottom portion of the carriage 31, and introduction tubes 67 for guiding the ink from the ink tank to each color head are provided to the bottom portion of the carriage 31. Mounting the cartridge 71 for the black (K) ink and the cartridge 72 for the color inks on the carriage 31 causes the introduction tubes 67 to enter the connection holes provided to each cartridge and allows the ink to be fed from the ink cartridges to the ejection heads 61 to 66.

The color heads 61 to 66 in the bottom portion of the carriage 31 are provided with 48 nozzles Nz for each color, and each nozzle is provided with a highly responsive piezoelectric (electrostrictive) element PE. The piezoelements PE are disposed at locations adjacent to the ink conduits for guiding the ink to the nozzles Nz. As is well known, a piezoelement PE changes its crystal structure under the application of voltage and very rapidly converts electrical energy to mechanical energy. In the present embodiment, applying a voltage for a prescribed period between the electrodes disposed at both ends of a piezoelement PE causes the piezoelement PE to expand during the application of voltage, and deforms the lateral wall of the corresponding ink conduit. As a result, the volume of the ink conduit 68 decreases in accordance with the expansion of the piezoelement PE, the ink forms particles Ip in proportion to this contraction, and the particles are ejected at a high speed from the tip of the corresponding nozzle Nz. Images are printed as a result of the fact that the ink particles Ip penetrate into the paper P mounted on the platen 26.

Figure 7:
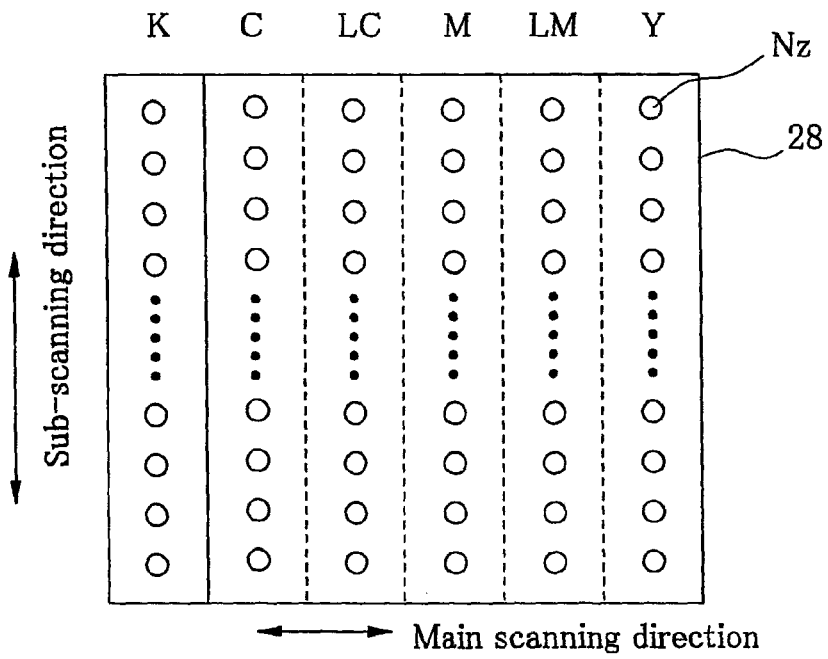
FIG. 7 is a plan view depicting the arrangement of the nozzle units of each color in a print head unit 60.

FIG. 7 is a diagram depicting the arrangement of the ink-jet nozzles Nz in the ink-ejecting heads 61-66. These nozzles form six nozzle arrays for ejecting the ink of each color (black (K), cyan (C), light cyan (LC), magenta (M), light magenta (LM), and yellow (Y)), and the 48 nozzles of each array form a single row at a constant pitch k. Nozzle pitch is a value equal to the number of raster lines (that is, pixels) accommodated by the interval between the nozzles on the print heads in the sub-scanning direction. For example, nozzles whose intervals correspond to three interposed raster lines have a pitch k of 4.

Figure 8:
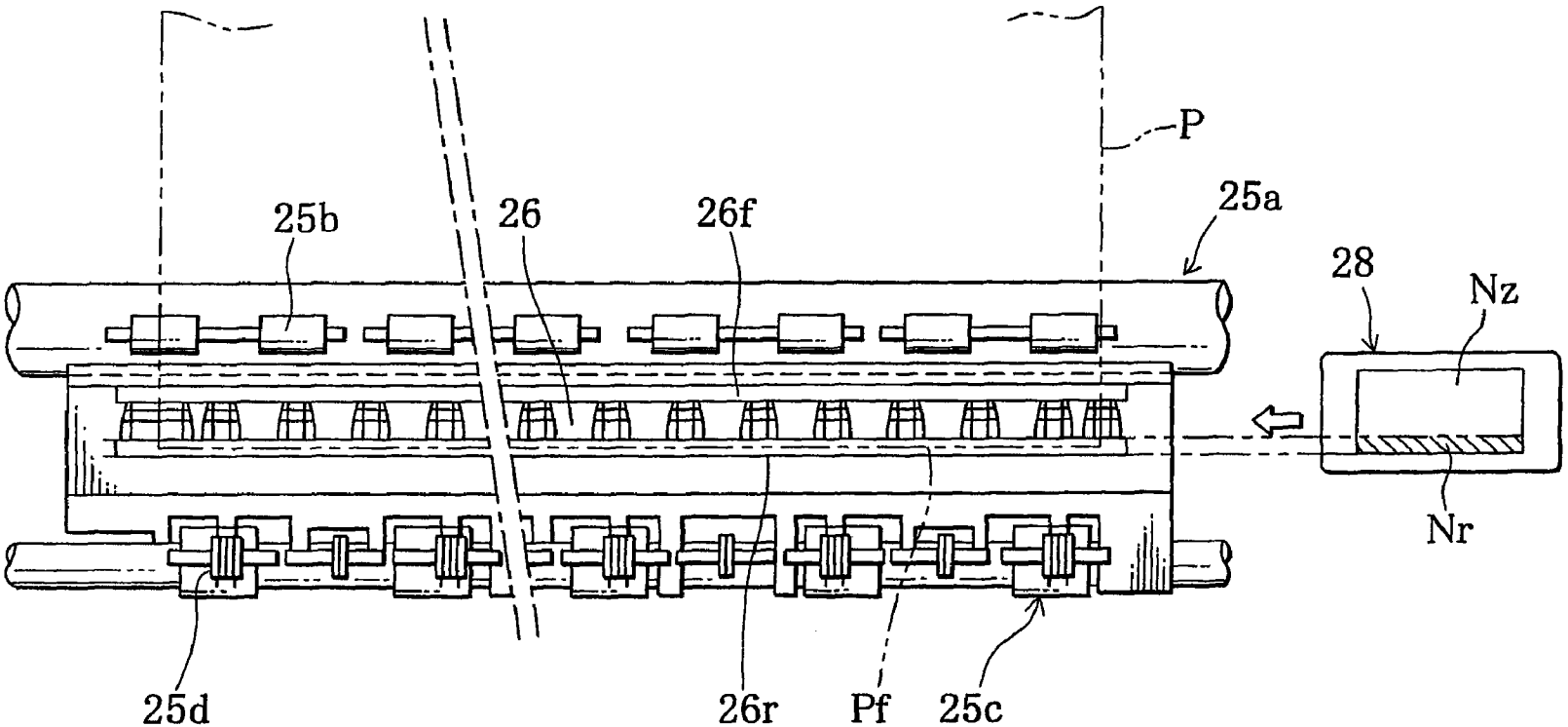
FIG. 8 is a plan view depicting the periphery of a platen 26.

FIG. 8 is a plan view depicting the periphery of the platen 26. The width of the platen 26 in the sub-scanning direction is greater than the maximum width of the printing paper P that can be accommodated by the printer 22. Upstream paper feed rollers 25*a* and 25*b* are provided upstream of the platen 26. Whereas the upstream paper feed roller 25*a* is a single drive roller, the upstream paper feed roller 25*b* comprises a plurality of freely rotating small rollers. Downstream paper feed rollers 25*c* and 25*d* are also provided downstream of the platen. The downstream paper feed roller 25*c* comprises a plurality of rollers on a drive shaft, and the downstream paper feed roller 25*d* comprises a plurality of freely rotating small rollers. Slots parallel to the axis of rotation are formed in the external peripheral surface of the downstream paper feed roller 25*d*. Specifically, the downstream paper feed roller 25*d* has radial teeth (portions between slots) in the external peripheral surface thereof and appears to be shaped as a gear when viewed in the direction of the axis of rotation. The downstream paper feed roller 25*d* is commonly referred to as a milled roller and is designed to press the printing paper P against the platen 26. The downstream paper feed roller 25*c* and upstream paper feed roller 25*a* rotate synchronously at the same peripheral speed.

The print head 28 moves back and forth in the main scanning direction over the platen 26 sandwiched between the upstream paper feed rollers 25*a* and 25*b* and the downstream paper feed rollers 25*c* and 25*d*. The printing paper P is held by the upstream paper feed rollers 25*a* and 25*b* and the downstream paper feed rollers 25*c* and 25*d*, and an intermediate portion thereof is supported by the upper surface of the platen 26 while disposed opposite the rows of nozzles in the print head 28. The paper is fed in the sub-scanning direction by the upstream paper feed rollers 25*a* and 25*b* and the downstream paper feed rollers 25*c* and 25*d*, and images are sequentially recorded by the ink ejected from the nozzles of the print head 28. In the present claims, the upstream paper feed rollers 25*a* and 25*b* are referred to as an upstream sub-scanning unit, and the downstream paper feed rollers 25*c* and 25*d* as a downstream secondary drive/scan unit.

The platen 26 is provided with an upstream slot 26*f* and a downstream slot 26*r*, which are located on the upstream and downstream sides, respectively, in the sub-scanning direction. The width of the upstream slot 26*f* or downstream slot 26*r* in the main scanning direction is greater than the maximum width of the printing paper P that can be accommodated by the printer 22. In addition, absorbent members 27*f* and 27*r* for accepting and absorbing ink droplets Ip are disposed in the bottom portions of the upstream slot 26*f* and downstream slot 26*r*, respectively. The downstream slot 26*r* is disposed opposite those nozzles Nz of the print head 28 that form a downstream group of nozzles Nr (the hatched group of nozzles in FIG. 8) containing the extreme downstream nozzle. The upstream slot 26*f* is disposed opposite those nozzles of the print head 28 that form an upstream group of nozzles Nf (not shown in FIG. 8) containing the extreme upstream nozzle. The printing paper P passes over the openings of the upstream slot 26*f* and downstream slot 26*r* when fed in the sub-scanning direction by the upstream paper feed rollers 25*a* and 25*b* and the downstream paper feed rollers 25*c* and 25*d*.

The inner structure of the control circuit 40 (see FIG. 6) belonging to the printer 22 will now be described. The control circuit 40 contains the following units in addition to CPU 41, PROM 42, and RAM 43: a PC interface 45 for exchanging data with the computer 90, a drive buffer 44 for outputting the ON and OFF signals of the ink jet to the ink-ejecting heads 61-66, and the like. These elements and circuits are connected together by a bus. The control circuit 40 receives the dot data processed by the computer 90, temporarily stores them in the RAM 43, and outputs the results to the drive buffer 44 according to specific timing. The RAM 43 corresponds to the print data storage unit.

In the printer 22 thus configured, the carriage 31 is reciprocated by the carriage motor 24 while paper P is transported by the paper feed motor 23, the piezoelement of each of the nozzle units belonging to the print head 28 is actuated at the same time, ink droplets Ip of each color are ejected, and ink dots are formed to produce multicolored images on the paper P.

In the printer of the present embodiment, the areas near the top and lower edges of printing paper are printed differently from the intermediate area of the printing paper because the upper edge Pf of the printing paper P is printed over the downstream slot 26*r*, and the lower edge Pr is printed over the upstream slot 26*f*. In the present specification, the routine whereby images are printed in the intermediate area of printing paper will be referred to as an "intermediate routine," the routine whereby images are printed in the area near the upper edge of printing paper will be referred to as a "upper-edge routine," and the routine whereby images are printed in the area near the lower edge of printing paper will be referred to as a "lower-edge routine." The width of the upstream slot 26*f* and downstream slot 26*r* in the sub-scanning direction can be expressed as follows.

$$W=p\times n+\alpha$$

In the formula, p is a single feed increment in the sub-scanning direction during a top- or lower-edge routine, n is the number of feed increments in the sub-scanning direction during a top- or lower-edge routine, and $\alpha$ is an estimated feed error in the sub-scanning direction during a top- or lower-edge routine. The $\alpha$-value of the lower-edge routine (upstream slot 260 should preferably be set to a level above that of the $\alpha$-value for a upper-edge routine (downstream slot 26*r*). Specifying the slot width of the platen according to this formula makes it possible to provide the slots with a width sufficient to adequately receive the ink droplets ejected from the nozzles during a top- or lower-edge routine.

Figure 9:
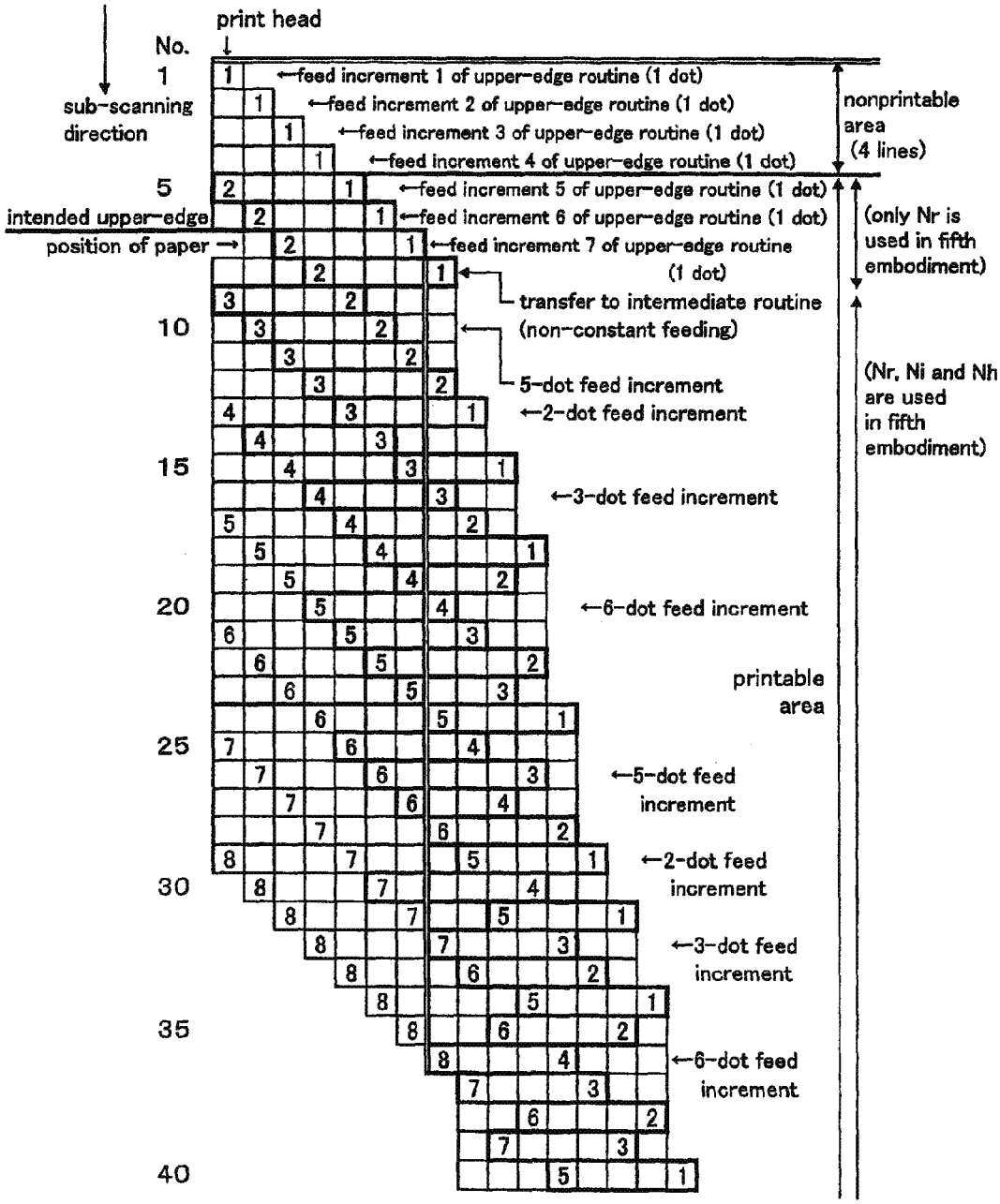
FIG. 9 is a diagram depicting the manner in which raster lines are recorded by particular nozzles in an area near the front edge (tip) of printing paper.

(2) Feeding in the Sub-scanning Direction (i) Upper-Edge Routine of First Embodiment FIG. 9 is a diagram depicting the manner in which raster lines are recorded by particular nozzles in an area near the upper edge (tip) of printing paper. For the sake of simplicity, the description will be limited to a single row of nozzles. It is assumed that a single row contains eight nozzles. During a main scan, each nozzle is responsible for recording a single raster line. As used herein, the term "raster line" refers to a row of pixels aligned in the main scanning direction. The term "pixel" refers to a single square of an imaginary grid formed on a print medium (and occasionally beyond the edges of the print medium) in order to define the positions at which dots are recorded by the deposition of ink droplets. In the case under consideration, the nozzles are spaced apart at intervals corresponding to three raster lines.

In FIG. 9, a single vertical column of squares represents the print head 28. The numerals 1-8 in each square indicate nozzle numbers. In the present specification, "No." is attached to these numbers to indicate each nozzle. In FIG. 9, the print head 28, which is transported over time in relative fashion in the sub-scanning direction, is shown moving in sequence from left to right. During the upper-edge routine, the single-dot incremental feeding in the sub-scanning direction is repeated seven times, as shown in FIG. 9. This upper-edge routine involves printing images in accordance with the first recording mode. As a unit of feed increment in the sub-scanning direction, the term "dot" designates a single-dot pitch corresponding to the printing resolution in the sub-scanning direction, and this dot is also equal to raster line pitch.

The operation then proceeds to the intermediate routine and the 5-, 2-, 3-, and 6-dot feed increments are repeated in the order indicated. The intermediate routine involves printing images in accordance with the second recording mode. The system in which sub-scanning is performed by combining different feed increments in this manner is referred to as "non-constant feeding." Such feeding in the sub-scanning direction allows each raster line (with the exception of some raster lines) to be recorded by two nozzles. In other words, the present embodiment allows each raster line to be printed by two nozzles. In the example shown in FIG. 9, the fifth raster line from the top is recorded by nozzle Nos. 1 and 2. In the process, nozzle No. 2 may, for example, record pixels with even-numbered addresses, and nozzle No. 1 may record pixels with odd-numbered addresses. In addition, the ninth raster line from the top will be recorded by nozzle Nos. 2 and 3. The system in which the pixels within a single raster line are printed by a plurality of nozzles in distributed fashion in this manner will be referred to as "overlap printing." With such overlap printing, the dots of a single raster line are recorded by a plurality of nozzles passing over this raster line during a plurality of main scans for which the positions of printing paper in the sub-scanning direction are mutually different in relation to the print head.

In FIG. 9, the four raster lines from the uppermost tier are such that the nozzle No. 1 makes only one pass per main scan during printing. The result is that pixels cannot be distributed between, and printed by, two nozzles for these raster lines. Consequently, it is assumed with reference to the present embodiment that these four raster lines cannot be used to record images. Specifically, it is assumed with reference to the present embodiment that only the fifth and greater raster lines, as counted from the upstream edge in the sub-scanning direction, can be considered as the raster lines on which the nozzles of the print head 28 can form dots in order to record images. The raster line area in which images can be recorded in this manner is referred to as a printable area. In addition, the raster line area in which image cannot be recorded is referred to as a nonprintable area. In FIG. 9, the numbers attached in order from top to the raster lines in which dots can be recorded by the nozzles of the print head 28 are indicated on the left side of the drawing. The same applies hereinbelow to the drawings illustrating the recording of dots during the upper-edge routine. In the drawings, the nozzles within bold boxes are used for recording dots on raster lines.

In FIG. 9, three or more nozzles pass over the 13th to 15th raster lines from the top in the course of a main scan during printing. In the raster lines covered by three or more nozzles during printing, dots are recorded only by two of the nozzles involved. For these raster lines, the preferred practice is to record dots as much as possible with the nozzles that pass over the raster lines after the operation has entered the intermediate routine. With the intermediate routine, non-constant feeding is accomplished, and various combinations are created from the nozzles passing over mutually adjacent raster lines, making it possible to expect that the printing operation will yield better image quality than that yielded by the upper-edge routine, which is characterized by constant feeding in single-dot increments.

In the present embodiment, images can be recorded without blank spaces up to the upper edge of the printing paper. As described above, the present embodiment is such that images can be recorded by selecting the fifth and greater raster lines (printable area), as counted from the upstream edge in the sub-scanning direction, from among the raster lines on which dots can be recorded by the nozzles of the print head 28. Consequently, images could theoretically be recorded very close to the upper edge of printing paper by starting dot recording after the printing paper is positioned relative to the print head 28 such that the fifth raster line (as counted from the upper edge) is disposed exactly at the position occupied by the upper edge of the printing paper. There are, however, cases in which the feed increment errors occur during feeding in the sub-scanning direction. There are also cases in which the direction in which ink droplets are ejected shifts away as a result of a manufacturing error or another factor related to the print head. The formation of blank spaces along the upper edge of the printing paper should preferably be prevented in cases in which the position at which the ink droplets are ejected on the printing paper is shifted for these reasons. It is thus assumed with reference to the present embodiment that the image data D used for printing are provided starting from the fifth raster line, which is counted from the upstream edge in the sub-scanning direction and is selected from the raster lines on which dots can be recorded by the nozzles of the print head 28, and that printing is started from a state in which the upper edge of the printing paper P assumes the position occupied by the seventh raster line, as counted from the upstream edge in the sub-scanning direction. Consequently, the prescribed position occupied by the upper edge of the printing paper in relation to each raster line during the start of printing coincides with the position occupied by the seventh raster line, as counted from the upstream edge in the sub-scanning direction (FIG. 9).

Figure 10:
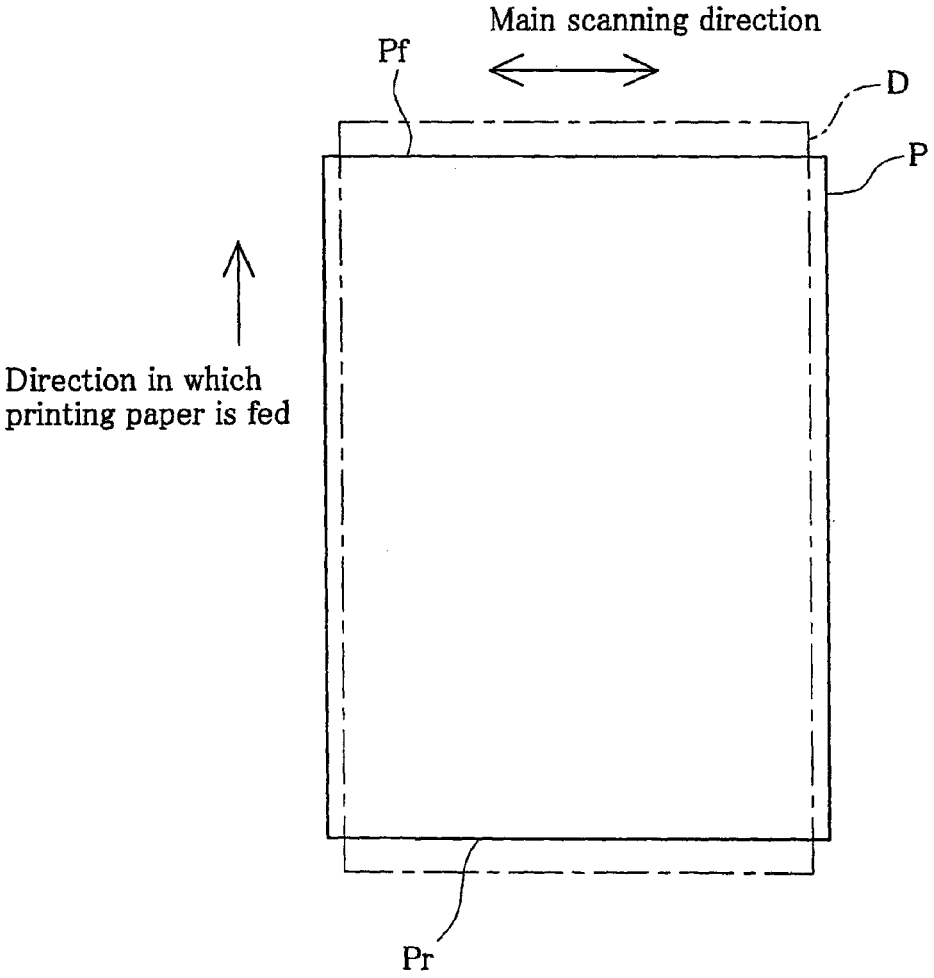
FIG. 10 is a plan view depicting the relation between image data D and printing paper P.

FIG. 10 is a plan view depicting the relation between image data D and printing paper P. As described above, the present embodiment is such that image data D are provided up to the area outside the printing paper P beyond the upper edge Pf of the printing paper P. For the same reasons, the area facing the lower edge is also treated such that image data D are provided up to the area outside the printing paper P beyond the lower edge Pr of the printing paper P. The present embodiment is therefore such that the relation between the image data D and the size of the printing paper P, on the one hand, and the image data D and the arrangement of the printing paper P during printing, on the other hand, assumes the configuration shown in FIG. 10.

Specifically, images can be recorded in accordance with the image data D in an expanded area (shown by the dashed line in FIG. 10) that extends in terms of length beyond at least the upper and lower edges of the print medium.

In the present embodiment, two raster lines are selected for the width of the portion of image data D provided up to the area outside the printing paper P beyond the upper edge Pf of the printing paper P. Similarly, two raster lines are selected for the width of the portion of image data D provided up to the area outside the printing paper P beyond the lower edge Pr of the printing paper P. In the present specification, the terms "upper edge (portion)" and "lower edge (portion)" are used to designate the edges of the printing paper P corresponding to the top and bottom of the image data recorded on the printing paper P, and the terms "front edge (portion)" and "rear edge (portion)" are used to designate the edges of the printing paper P corresponding to the direction in which the printing paper P is advanced during sub-scanning in the printer 22. In the present specification, the term "upper edge (portion)" corresponds to the front edge (portion) of the printing paper P, and the term "lower edge (portion)" corresponds to the rear edge (portion).

Figure 11:
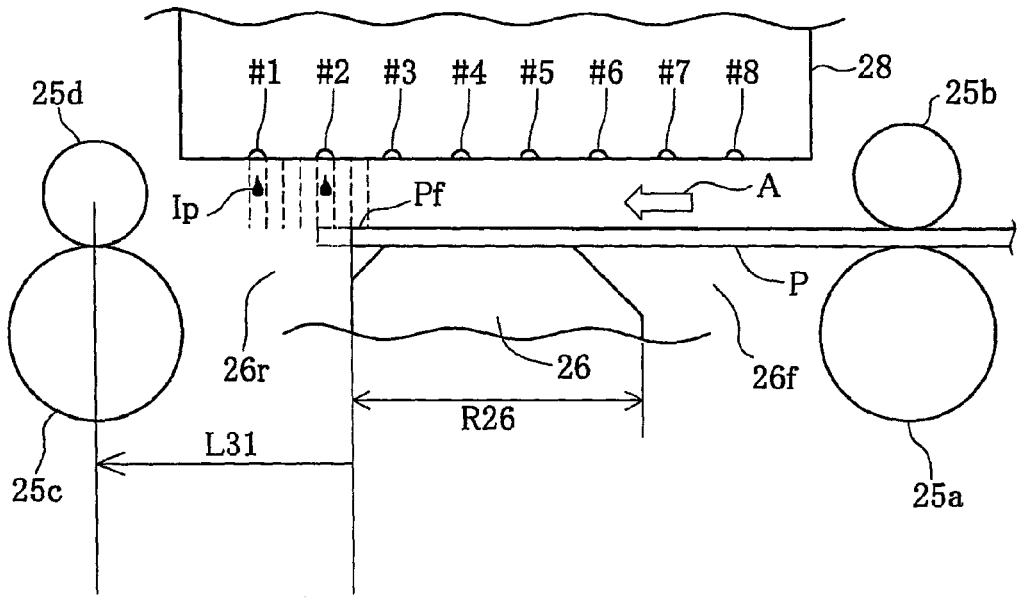
FIG. 11 is a side view depicting the relation between print head 28 and printing paper P at the start of printing.

FIG. 11 is a side view depicting the relation between print head 28 and printing paper P at the start of printing. It is assumed herein that the platen 26 covers the range R26 extending from a rearward position corresponding to two raster lines (as counted from nozzle No. 2 of the print head 28) to a forward position corresponding to two raster lines (as counted from nozzle No. 7). Consequently, the ink droplets from nozzle Nos. 1, 2, 7, and 8 are prevented from depositing on the platen 26 even when the ink droplets Ip are ejected from the nozzles in the absence of printing paper.

In FIG. 8, the nozzles Nr in the hatched portion of the print head 28 correspond to the area in which nozzle Nos. 1 and 2 are disposed. A downstream slot 26*r* is disposed underneath the area over which these nozzles pass during a main scan, and printing is started when the upper edge Pf of the printing paper P reaches the position shown by the dashed line over the downstream slot 26*r*.

As described above, the upper edge Pf of the printing paper P reaches the position of the seventh raster line (as counted from the upstream edge in the sub-scanning direction), which is one of the raster lines on which dots are recorded by the nozzles of the print head 28. Specifically, it follows from FIG. 11 that the upper edge of the printing paper P reaches a rearward position corresponding to six raster lines, as counted from nozzle No. 1. The broken lines in FIG. 11 indicate the prescribed positions of raster lines based on image data. If it is assumed that printing starts at this position, then the raster line belonging to the uppermost tier of the printable area (fifth raster line from the top in FIG. 9) is supposed to be recorded by nozzle No. 2, but the printing paper P has not yet reached the area underneath nozzle No. 2. The result is that accurate feeding of the printing paper P by the upstream paper feed rollers 25*a* and 25*b* will allow the ink droplets Ip ejected by nozzle No. 2 to descend directly into the downstream slot 26*r*. In addition, the raster line belonging to the uppermost tier of the printable area will also be recorded by nozzle No. 1 following four single-dot feed increments, as shown in FIG. 9. Similarly, the printing paper P has not yet reached the area underneath nozzle No. 1 by the time four single-dot feed increments are completed. The result is that the ink droplets Ip ejected from nozzle No. 1 at this time descend directly into the downstream slot 26*r*. The same applies to recording the second raster line from the top of the printable area (sixth raster line from the top in FIG. 9).

There are also cases in which the upper edge of the printing paper P reaches the position occupied by the second raster line from the top of the printable area or by the raster line disposed in the uppermost tier of the printable area if the feed increment of the printing paper P exceeds the designed increment for any reason. The present embodiment is configured such that nozzle Nos. 1 and 2 are still capable of ejecting ink droplets Ip to cover the aforementioned raster lines at a position beyond the upper edge Pf of the printing paper P in such cases, making it possible to record images along the upper edge of the printing paper P and to prevent blank spaces from forming. Specifically, blank spaces can be prevented from forming along the upper edge of the printing paper P when the feed increment of the printing paper P exceeds the designed increment but the excessive feed increment is still no more than two raster lines, as shown by the dashed line in FIG. 11.

It is the CPU 41 that causes images to be printed in the area (expanded area) that extends beyond the upper edge Pf of the printing paper P in this manner. Specifically, the CPU 41 corresponds to the edge printing unit.

Another possibility is that the feed increment of the printing paper P falls short of the designed increment for any reason. In such cases the printing paper fails to arrive at the designated position, and the ink droplets Ip end up depositing on the underlying structure. In the present embodiment, the two raster lines along the intended upper-edge position of the paper sheet are recorded by nozzle Nos. 1 and 2, as shown in FIG. 9. A downstream slot 26*r* is disposed underneath these nozzles, so the ink droplets Ip descend into the downstream slot 26*r* and are absorbed by an absorbent member 27*r* if they fail to deposit on the printing paper P. It is thus possible to prevent situations in which the ink droplets Ip deposit on the upper surface of the platen 26 and subsequently soil the printing paper. Specifically, adopting the present embodiment makes it possible to prevent situations in which the ink droplets Ip deposit on the upper surface of the platen 26 and subsequently soil the printing paper P when the upper edge Pf of the printing paper P moves past the intended position of the upper edge during the start of printing but the deviation of the paper from the intended position of the upper edge is still no more than two raster lines.

It is the CPU 41 that specifies the position of the printing paper P in the sub-scanning direction in the above-described manner such that the upper edge Pf of the printing paper P assumes a position above the opening of the downstream slot 26*r* during sub-scanning. The position assumed by the upper edge Pf is located upstream of the nozzles at the downstream edge in the sub-scanning direction. Specifically, the CPU 41 functions as an upper-edge positioning unit.

The printing paper P should be held and fed in the sub-scanning direction by two groups of rollers composed of the upstream paper feed rollers 25*a* and 25*b* and the downstream paper feed rollers 25*c* and 25*d*. The reason is that this arrangement allows paper to be fed in the sub-scanning direction with higher accuracy than when the sheet is held and fed in the sub-scanning direction by a single roller. However, the printing paper P is held and fed in the sub-scanning direction solely by the upstream paper feed rollers 25*a* and 25*b* when images are printed along the upper edge Pf of the printing paper. In the present embodiment, printing is started when the seventh raster line, as counted from the upstream edge in the sub-scanning direction and selected from raster lines on which dots can be recorded by the nozzles of the print head 28, reaches the position occupied by the upper edge Pf of the printing paper (see FIGS. 8 and 10). Consequently, images are printed as the sheet is fed in the sub-scanning direction solely with the upstream paper feed rollers 25*a* and 25*b* from this position onward until the upper edge Pf of the printing paper is picked up by the downstream paper feed rollers 25*c* and 25*d*, that is, in the period during which the printing paper travels the distance L31, as shown in FIG. 11. In the present embodiment, the printing operation yields better image quality because the sheet is fed in the sub-scanning direction solely by the upstream paper feed rollers 25*a* and 25*b*, and the printing operation is completed in a comparatively short time. These effects are not limited to the above-described arrangement and extend to situations in which the area near the upper edge Pf of the printing paper is printed with nozzles located in the vicinity of the edge on the downstream side in the sub-scanning direction. This arrangement is particularly effective in cases in which the upstream drive units (upstream paper feed rollers 25*a* and 25*b*) for sub-scanning have comparatively low feed accuracy.

The printing paper P is supported at two locations on the platen 26 and the upstream paper feed rollers 25*a* and 25*b* when images are printed on the area occupied by the upper edge. For this reason, the upper-edge portion of the printing paper P has comparatively high resistance to downward bending when disposed above the downstream slot 26*r*. It is therefore less likely that the quality of printing in the upper-edge portion will be adversely affected by the bending of the printing paper.

(ii) Upper-Edge Feeding According to Comparative Example

Figure 12:
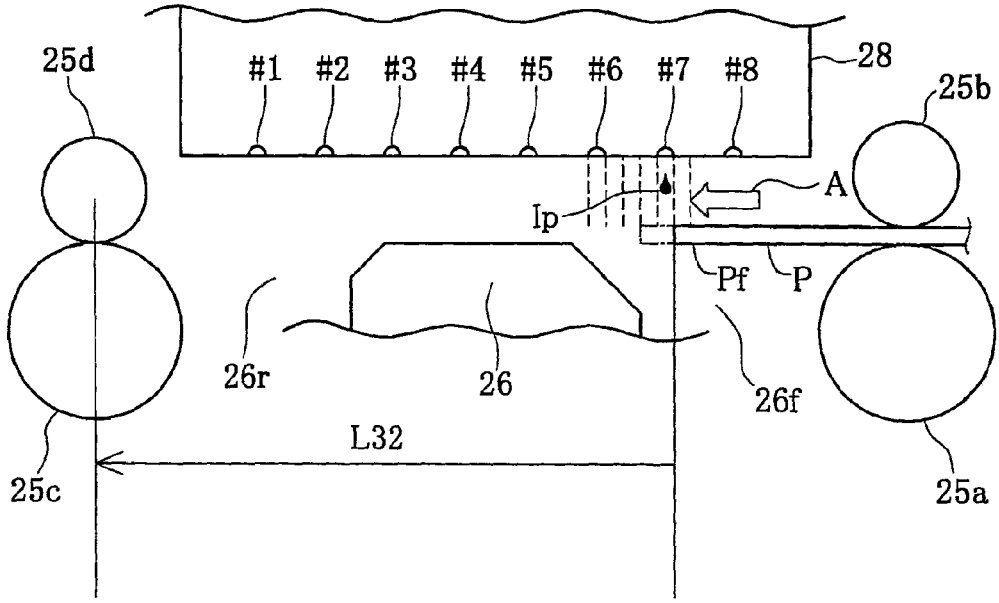
FIG. 12 is a side view depicting the relation between print head 28 and printing paper P at the start of printing according to a comparative example.

FIG. 12 is a side view depicting the relation between print head 28 and printing paper P at the start of printing according to a comparative example. It can be seen in FIG. 12 that the ink droplets not deposited on the printing paper P are prevented from depositing on the upper surface of the platen 26 when images are printed in the upper-edge portion of the printing paper P over the upstream slot 26*f*. In this comparative example, however, printing is started in the upper-edge portion of the printing paper, so the distance L32 (see FIG. 12) traveled by the printing paper until the upper edge of the printing paper is held by the downstream paper feed rollers 25*c* and 25*d* is greater than the distance (L31 in FIG. 9) traveled according to the embodiment. In other words, the sheet is fed in the sub-scanning direction solely by the upstream paper feed rollers 25*a* and 25*b*, and the printing period is comparatively long. The print quality is therefore lower than in the embodiment.

The printing paper P is held solely by the upstream paper feed rollers 25*a* and 25*b* when images are printed in the upper-edge portion. The upper-edge portion of the printing paper P will therefore likely to bend downward over the upstream slot 26*f*. There is, therefore, a comparatively high possibility that the print quality will decrease when images are printed in the upper-edge portion.

(iii) Lower-Edge Routine of First Embodiment

Figure 13:
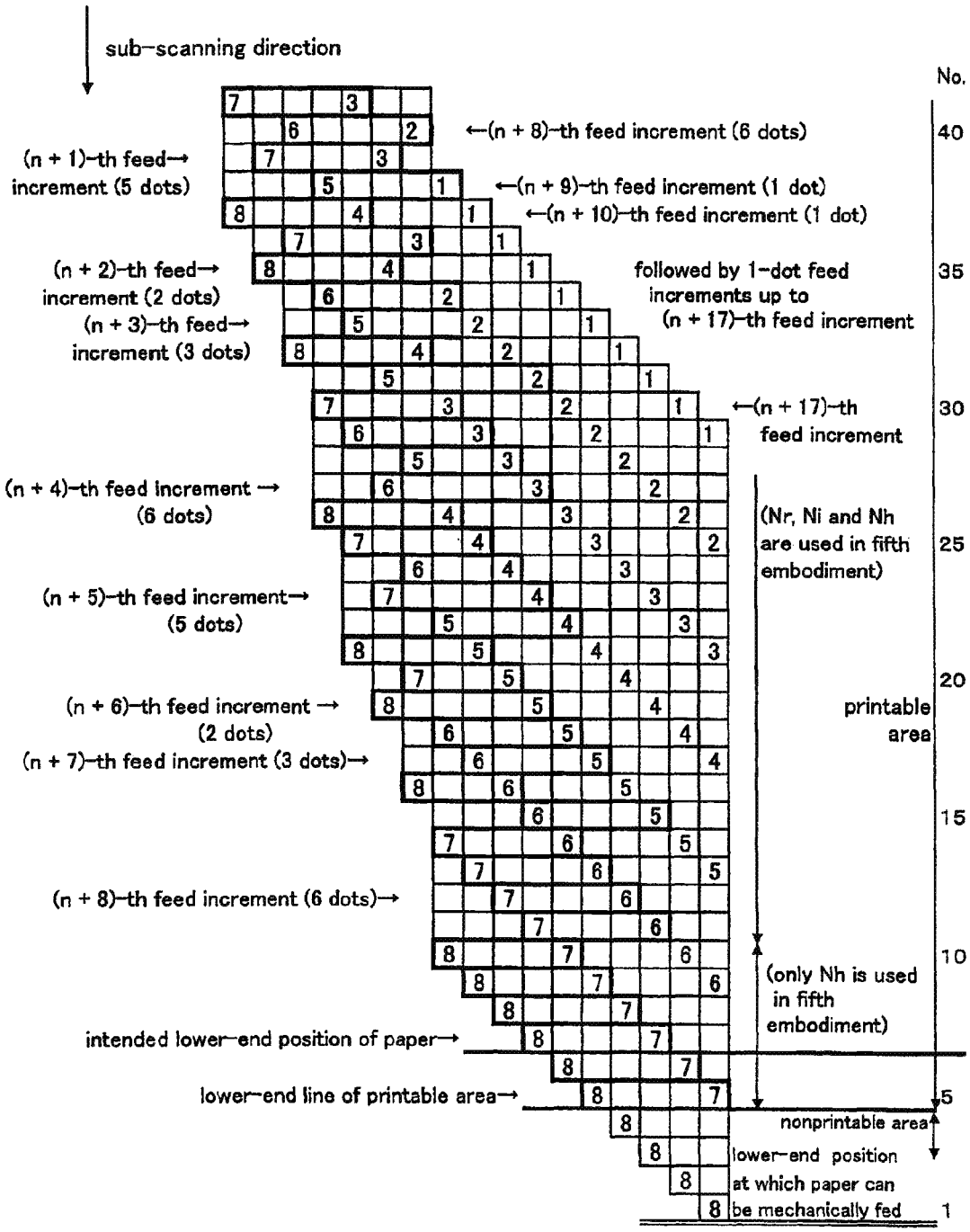
FIG. 13 is a diagram depicting the manner in which raster lines are recorded by particular nozzles during a lower-edge routine.

FIG. 13 is a diagram depicting the manner in which raster lines are recorded by particular nozzles during the lower-edge routine. FIG. 13 depicts the results obtained from the moment an (n+1)-th feed increment is completed in the sub-scanning direction until the moment the final (n+17)-th feed increment is completed in the sub-scanning direction. In the present embodiment, the lower-edge routine entails performing the last nine (that is, from (n+9)-th to (n+17)-th) single-dot feed increments in the sub-scanning direction after 5-, 2-, 3- and 6-dot feed increment are repeatedly performed in sequence in the sub-scanning direction up to the (n+8)-th cycle of the intermediate routine, as shown in FIG. 13. As a result, each of the raster lines (with the exception of some raster lines) aligned in the main scanning direction is recorded by two nozzles. In FIG. 13, the numbers attached in order from the bottom to the raster lines in which dots can be recorded by the nozzles of the print head 28 are indicated on the right side of the drawing. The rest is the same as in the drawings illustrating the recording of dots by the lower-edge routine.

In FIG. 13, the four raster lines from the lowermost tier are such that nozzle No. 8 makes only one pass during printing. The fifth and greater raster lines above the lowermost tier are recorded by two or more nozzles. Consequently, the printable area of the portion occupied by the lower edge of the printing paper extends to the fifth and greater raster lines from the lowermost tier.

In FIG. 13, three or more nozzles pass over the ninth and tenth raster lines from the bottom in the course of a main scan during printing. For the raster lines covered by three or more nozzles during printing, the preferred practice is to record dots as much as possible with the nozzles that pass over the raster lines during an intermediate routine. The printing operation can be expected to yield better image quality than when a lower-edge routine is performed in single-dot constant feed increments.

In the present embodiment, images can be recorded without blank spaces up to the lower edge in the same manner for the upper edge. As described above, the present embodiment is such that images can be recorded by selecting the fifth and greater raster lines (printable area), as counted from the downstream edge in the sub-scanning direction, from among the raster lines that can be used to record dots by the nozzles of the print head 28. It is assumed, however, that images are recorded on the printing paper starting from the seventh raster line (as counted from the downstream edge in the sub-scanning direction) because of considerations related, among other things, to the feed increment errors that occur during feeding in the sub-scanning direction. Specifically, ink droplets Ip are ejected over the fifth and sixth raster lines, and the final main scan of the printing operation is performed in a state in which the lower edge of the printing paper is at a position corresponding to the seventh raster line, as counted from the upstream edge in the sub-scanning direction. Consequently, the intended position of the lower edge of the printing paper in relation to each raster line during the end of printing coincides with the position occupied by the seventh raster line, as counted from the downstream edge in the sub-scanning direction (FIG. 13).

Figure 14:
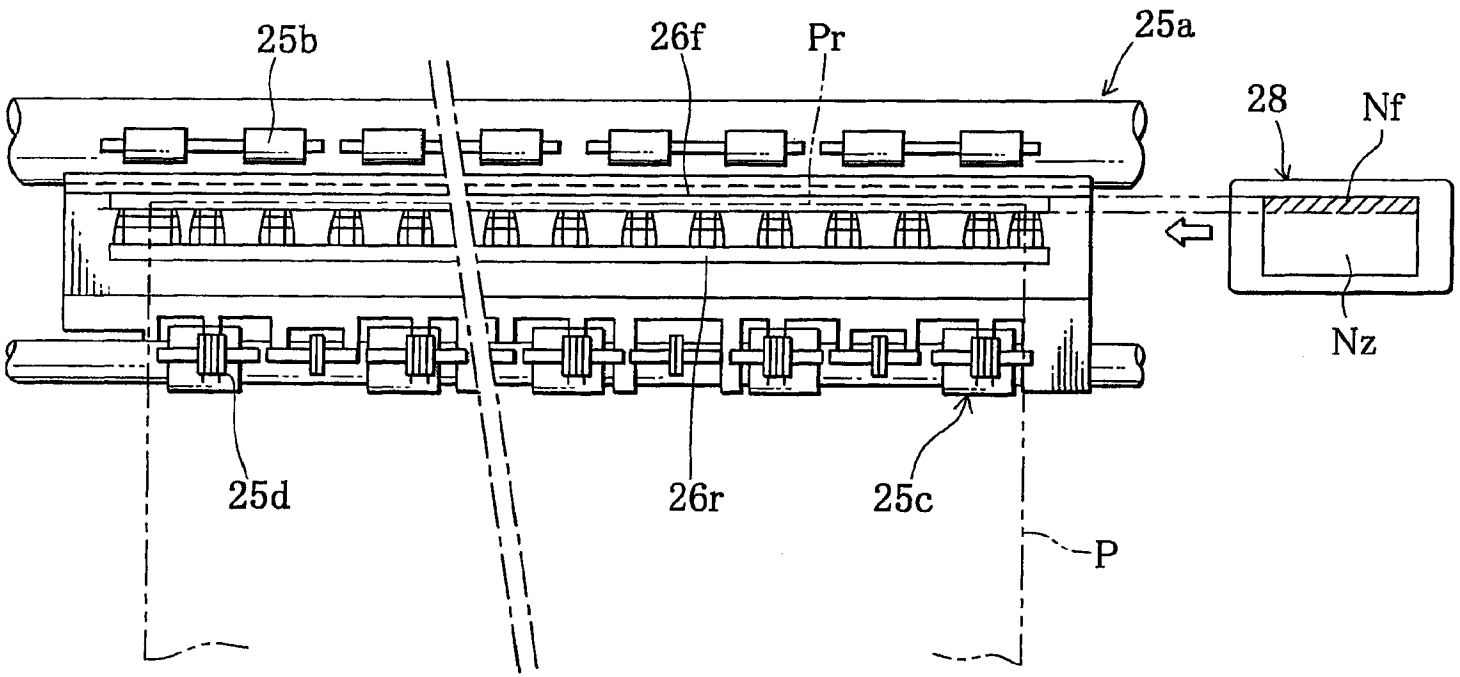
FIG. 14 is a plan view depicting the relation between the printing paper P and an upstream slot 26*f* during printing in the lower-edge portion Pr of the printing paper P.

FIG. 14 is a plan view depicting the relation between the printing paper P and upstream slot 26*f* during printing in the lower-edge portion Pr of the printing paper P. In FIG. 14, the nozzles Nf in the hatched area of the print head 28 correspond to the area in which nozzle Nos. 7 and 8 are located. An upstream slot 26*f* is disposed underneath the area over which these nozzles pass during a main scan, and printing is completed when the lower edge Pr of the printing paper P reaches the position shown by the dashed line above the upstream slot 26*f*.

Figure 15:
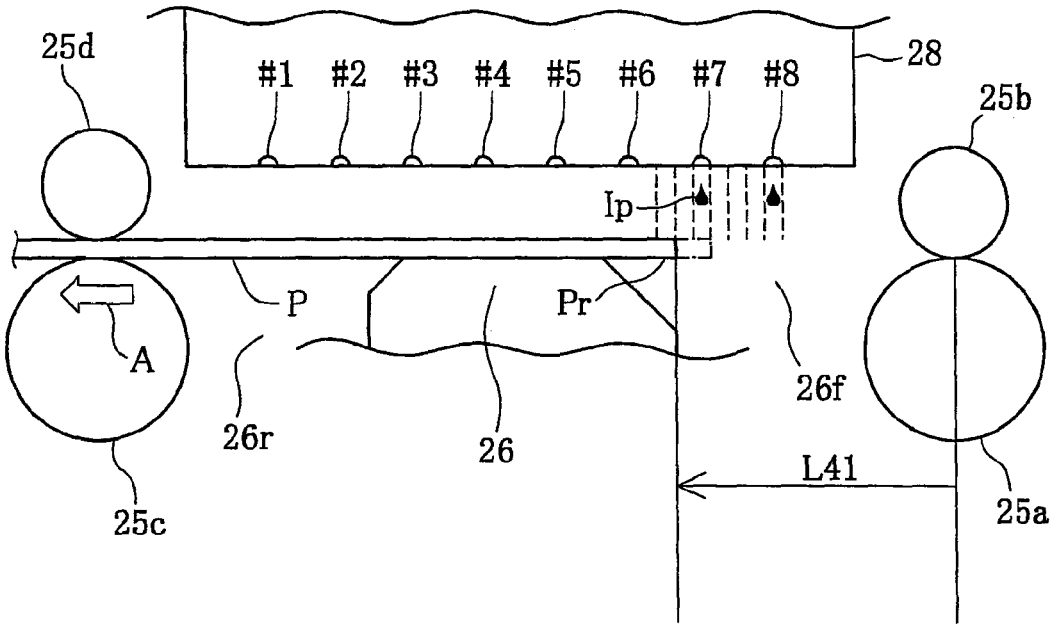
FIG. 15 is a side view depicting the relation between the printing paper P and print head 28 during printing along the lowermost edge of the printing paper.

FIG. 15 is a side view depicting the relation between the printing paper P and print head 28 during printing in the lower-edge portion Pr of the printing paper P. When images are printed in the lower-edge portion Pr of the printing paper P, the lower edge Pr of the printing paper P is disposed at the position occupied by the seventh raster line (as counted from the downstream edge in the sub-scanning direction), which is a raster line on which dots can be recorded by the nozzles of the print head 28, as described above (see FIG. 13). In other words, the lower edge of the printing paper P is disposed at a position six raster lines in front of nozzle No. 8. The ink droplets Ip ejected from the nozzle Nos. 7 and 8 will therefore directly descend into the upstream slot 26*f* if it is assumed that dots are recorded in the lowermost tier of the printable area and on the second raster line from the lowermost tier (sixth and fifth raster lines from bottom in FIG. 13).

If the feed increment of the printing paper P falls below the designed increment for any reason, nozzle Nos. 7 and 8 move beyond the lower edge Pr of the printing paper P and discharge ink droplets Ip for the designated raster lines (fifth and sixth raster lines from bottom in FIG. 13), making it possible to record images along the lower edge Pr of the printing paper P without leaving any blank spaces. Specifically, blank spaces can be prevented from forming along the lower edge of the printing paper P when the deficit of the feed increment is no more than two raster lines, as shown by the dashed line in FIG. 15.

It is the CPU 41 that prints images in the area (expanded area) beyond the lower edge Pr of the printing paper P in this manner. Specifically, the CPU 41 corresponds to the edge printing unit.

The two raster lines (seventh and eighth raster lines from bottom in FIG. 13) along the intended upper-edge position of the paper sheet are recorded by nozzle Nos. 7 and 8. It is therefore possible to prevent situations in which the ejected ink droplets Ip fall into the upstream slot 26*f* and deposit in the area occupied by the upper surface of the platen 26 when the feed increment of the printing paper P falls below the designed increment for any reason.

It is the CPU 41 that specifies the position of the printing paper P in the sub-scanning direction in the above-described manner such that the lower edge Pr of the printing paper P assumes a position above the opening of the upstream slot 26*f* during sub-scanning. The position assumed by the lower edge Pr is located downstream of the nozzles at the upstream edge in the sub-scanning direction. Specifically, the CPU 41 functions as a lower-edge positioning unit.

In the present embodiment, printing is completed when the seventh raster line, as counted from the downstream edge in the sub-scanning direction and selected from raster lines on which dots can be recorded by the nozzles of the print head 28, reaches the position occupied by the lower edge Pr of the printing paper (that is, a position two raster lines in front of nozzle No. 7 in FIG. 15) (see also FIG. 13). Consequently, images are printed as the sheet is fed in the sub-scanning direction solely with the downstream paper feed rollers 25*c* and 25*d* in the period during which the printing paper P travels the distance L41, which is the distance between the point at which the lower edge Pr of the printing paper P leaves the upstream paper feed rollers 25*a* and 25*b*, and the point shown in FIG. 15. In the present embodiment, the printing operation yields better image quality because the sheet is fed in the sub-scanning direction solely by the downstream paper feed rollers 25*c* and 25*d*, and the printing operation is completed in a comparatively short time. In particular, the downstream paper feed roller 25*d* is a gear-type roller, and the combined downstream paper feed rollers 25*c* and 25*d* can feed the sheet less accurately than can the upstream paper feed rollers 25*a* and 25*b*. For this reason, adopting an arrangement in which the sheet is fed in the sub-scanning direction solely by the downstream paper feed rollers 25*c* and 25*d* and in which the printing operation is completed in a comparatively short time is highly effective for enhancing the quality of the final print. These effects are not limited to the above-described arrangement and extend to situations in which the area near the lower edge Pr of the printing paper is printed with nozzles located in the vicinity of the edge on the upstream side in the sub-scanning direction. This arrangement is particularly effective in cases in which the downstream drive units (downstream paper feed rollers 25*c* and 25*d*) for sub-scanning have comparatively low feed accuracy.

The printing paper P is supported at two locations on the platen 26 and the downstream paper feed rollers 25*c* and 25*d* when images are printed on the area occupied by the lower edge. For this reason, the lower-edge portion of the printing paper P has comparatively high resistance to downward bending when disposed above the upstream slot 26*f*. It is therefore less likely that the quality of printing in the upper-edge portion will be adversely affected by the bending of the printing paper.

(iv) Lower-Edge Feeding in Comparative Example

Figure 16:
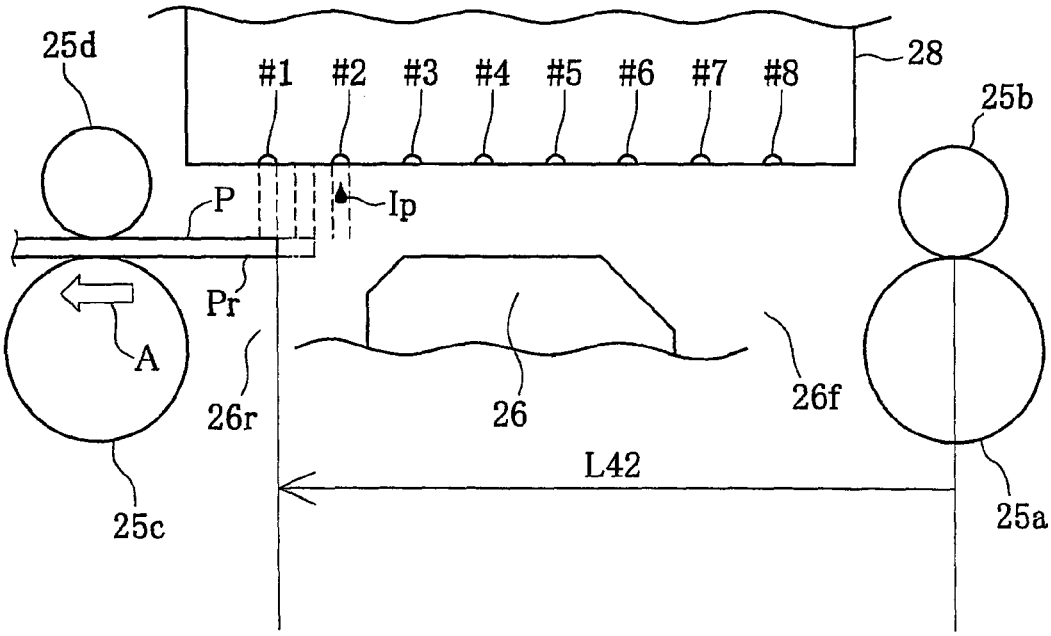
FIG. 16 is a side view depicting the relation between the print head 28 and printing paper P when the lowermost edge of the printing paper is printed according to a comparative example.

FIG. 16 is a side view depicting the relation between the print head 28 and printing paper P when the lower edge Pr of the printing paper P is printed according to a comparative example. It can be seen in FIG. 16 that the ink droplets not deposited on the printing paper P are prevented from depositing on the upper surface of the platen 26 when images are printed in the lower-edge portion of the printing paper P above the downstream slot 26*r*. In this comparative example, however, the distance L42 traveled by the printing paper until the lower edge thereof is held by the upstream paper feed rollers 25*a* and 25*b* is greater than the distance (L41 in FIG. 15) traveled according to the embodiment, as shown in FIG. 16. In other words, the sheet is fed in the sub-scanning direction solely by the downstream paper feed rollers 25*c* and 25*d* (which have comparatively low feed accuracy), and the printing period is comparatively long. The print quality is therefore lower than in the embodiment.

The printing paper P is held solely by the downstream paper feed rollers 25*c* and 25*d* when images are printed in the lower-edge portion. The lower-edge portion of the printing paper P will therefore likely to bend downward over the downstream slot 26*r*. There is, therefore, a comparatively high possibility that the print quality will decrease when images are printed in the lower-edge portion.

C. Second Embodiment

Figure 17:
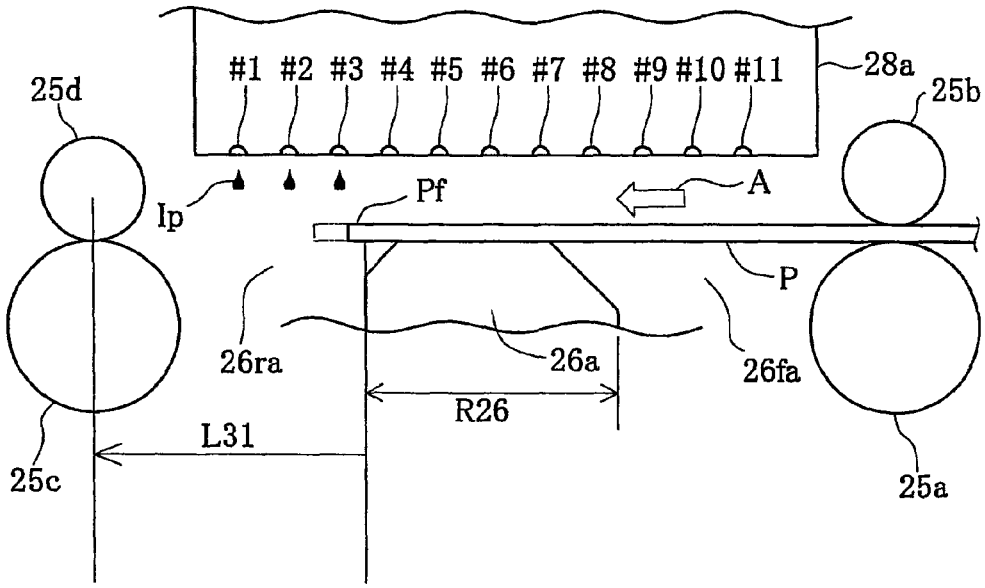
FIG. 17 is a side view depicting the relation of a print head 28*a* with an upstream slot 26*fa* and a downstream slot 26*ra* according to a second embodiment.

FIG. 17 is a side view depicting the relation of a print head 28*a* with an upstream slot 26*fa* and a downstream slot 26*ra* according to a second embodiment. A case will now be described in which upper- and lower-edge routines are performed by a printing device in which a single nozzle row contains 11 nozzles. In the printing device used herein, the downstream slot 26*ra* is provided at a position opposite nozzle Nos. 1-3 in the sub-scanning direction. The upstream slot 26*fa* is provided at a position opposite nozzle Nos. 9-11. The rest of the structure is the same as that of the printing device described above. Another feature of the second embodiment is that the overlap printing is dispensed with. In other words, each raster line is recorded by a single nozzle in the course of a main scan.

(1) Upper-Edge Routine of Second Embodiment

Figure 18:
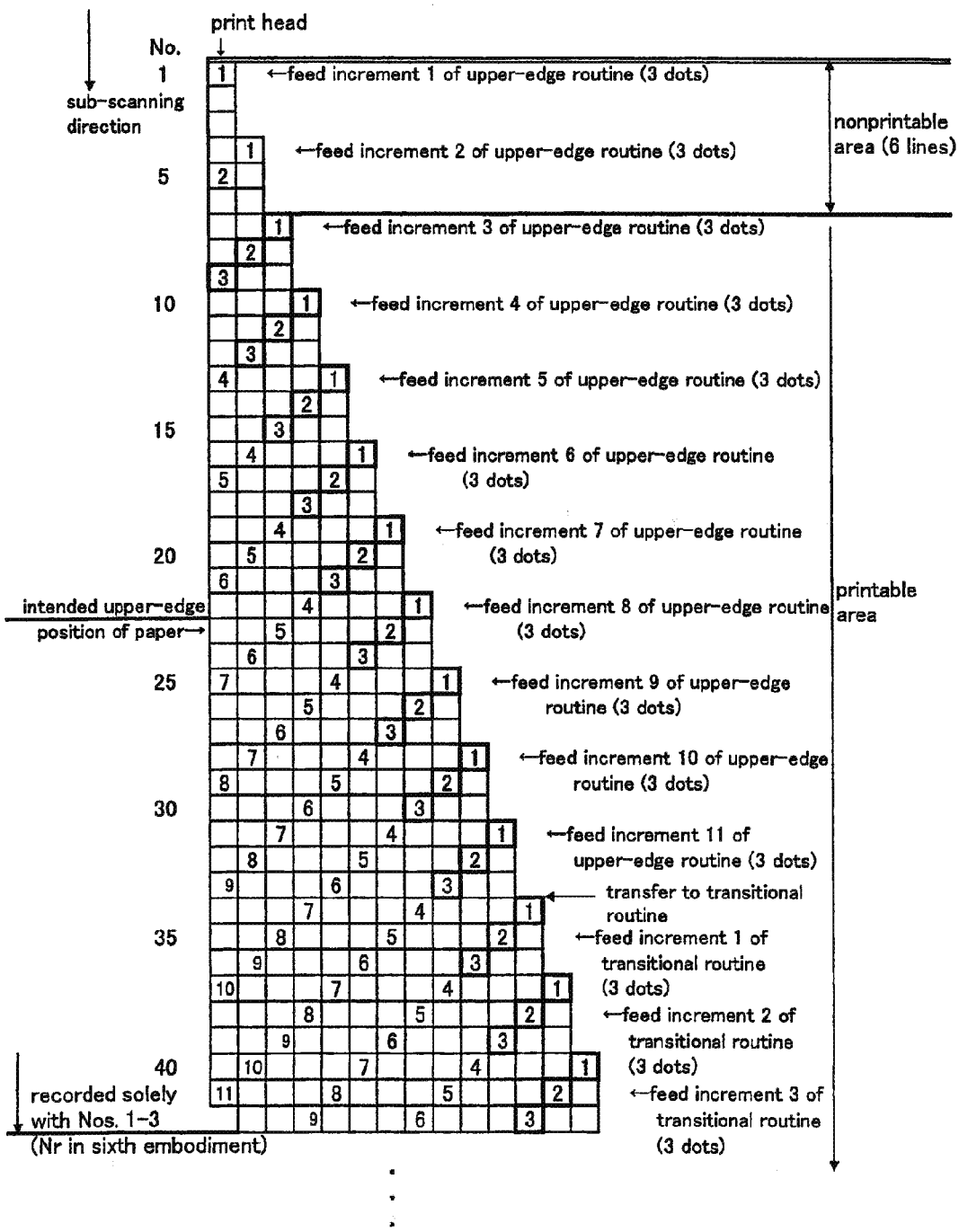
FIG. 18 is a diagram depicting the manner in which raster lines are recorded by particular nozzles during the upper-edge routine of the second embodiment.

FIGS. 17 and 18 are diagrams depicting the manner in which raster lines are recorded by particular nozzles in accordance with the upper-edge routine of the second embodiment. FIGS. 17 and 18 depict two separate levels (upper and lower) of the process in which the head records the raster lines. The lower part of FIG. 18 is connected to the upper part of FIG. 19. The 38th to 42nd raster lines from the top are shown in overlapped form in FIGS. 17 and 18.

During the upper-edge routine of the second embodiment, 3-dot incremental feeding in the sub-scanning direction is repeated 11 times, as shown in FIG. 18. This upper-edge routine involves printing images in accordance with the first recording mode. The upper-edge routine is performed without the use of nozzles other than nozzle Nos. 1-3 of the print head 28*a*. In the drawings, the nozzles within bold boxes are used for recording dots on raster lines.

Figure 19:
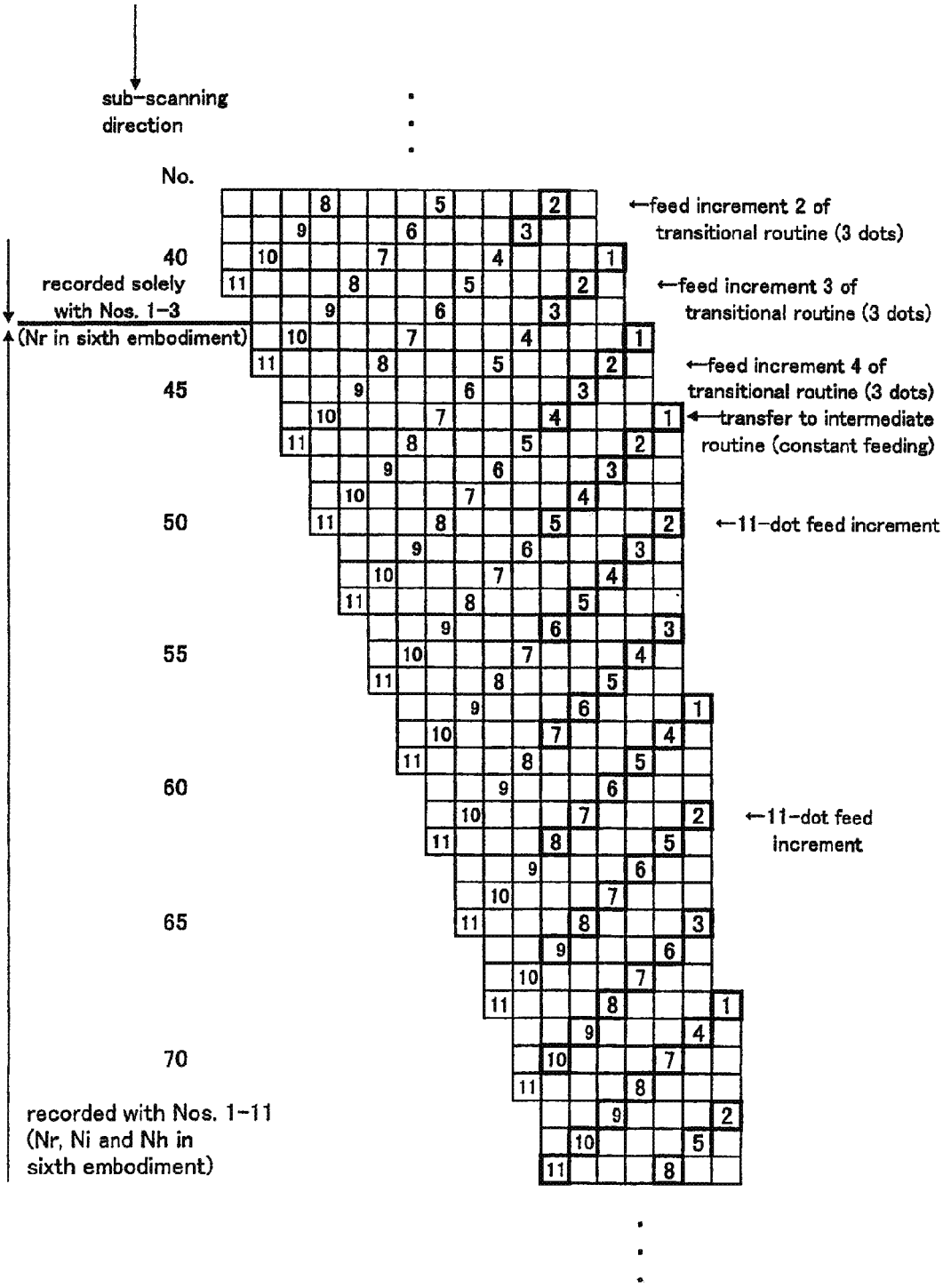
FIG. 19 is a diagram depicting the manner in which raster lines are recorded by particular nozzles during the upper-edge routine of the second embodiment.

Instead of an intermediate routine being performed immediately thereafter, a transitional routine is carried out prior to the intermediate routine. Similar to the upper-edge routine, the transitional routine involves repeating 3-dot feed increments four times in the sub-scanning direction. All the nozzles (Nos. 1-11) are used in the transitional routine. The operation then proceeds to the intermediate routine, and constant 11-dot feed increments are then repeated, as shown in FIG. 19. This intermediate routine involves printing images in accordance with the second recording mode.

In FIG. 18, none of the nozzles pass over the second, third, or six raster line (as counted from the uppermost tier) during main-scan printing. It is therefore impossible to print pixels by connecting together adjacent raster lines selected from the raster lines extending from the uppermost tier to the sixth raster line. In the present embodiment, these six raster lines constitute a nonprintable area. For a raster line covered by two or more nozzles, such as the 13th to 16th raster lines from the top, it is assumed that dots are formed exclusively by the last nozzle passing over the raster line.

In the second embodiment, images can be recorded by selecting the seventh and greater raster lines (printable area), as counted from the upstream edge in the sub-scanning direction, from among the raster lines on which dots can be recorded by the nozzles of the print head 28*a*. The image data D used for printing are provided starting from the seventh raster line, as counted from the upstream edge in the sub-scanning direction. For the same reasons as those described with reference to the first embodiment, printing is started when the upper edge of the printing paper P reaches the position occupied by the 23rd raster line rather than the seventh raster line, as counted from the upstream edge in the sub-scanning direction. Specifically, the intended position of the upper edge of the printing paper P in relation to each raster line at the start of printing coincides with the position occupied by the 23rd raster line, as counted from the upstream edge in the sub-scanning direction (FIG. 18). Consequently, the second embodiment entails providing image data D for 16 raster lines, beyond the intended position of the upper edge of the printing paper P. For this reason, images can still be formed without blank spaces up to the upper edge of the printing paper P when an error affecting the feeding of the printing paper P has occurred and the printing paper P is fed in an excessive manner, provided the error is within 16 raster lines.

Another feature of the second embodiment is that nozzle Nos. 1-3 are the only nozzles involved in the recording of the 20 raster lines counted from the position occupied by the upper edge and the 16 preset raster lines extending beyond the intended position of the upper edge of the printing paper P. A downstream slot 26*ra* is disposed underneath nozzle Nos. 1-3. Ink droplets can therefore be prevented from depositing on a platen 26*a* when these droplets are ejected onto the 16 preset raster lines beyond the intended position of the upper edge of the printing paper P (that is, onto the area beyond the printing paper). It is also possible to prevent the ink droplets from depositing on the platen 26*a* when these droplets are ejected onto the raster lines in an area outside the upper-edge portion of the printing paper P in a state in which a feed error affecting the printing paper P has occurred and the printing paper P fails to arrive at the intended position, provided the feed error is within 20 raster lines.

(2) Lower-Edge Routine of Second Embodiment

Figure 20:
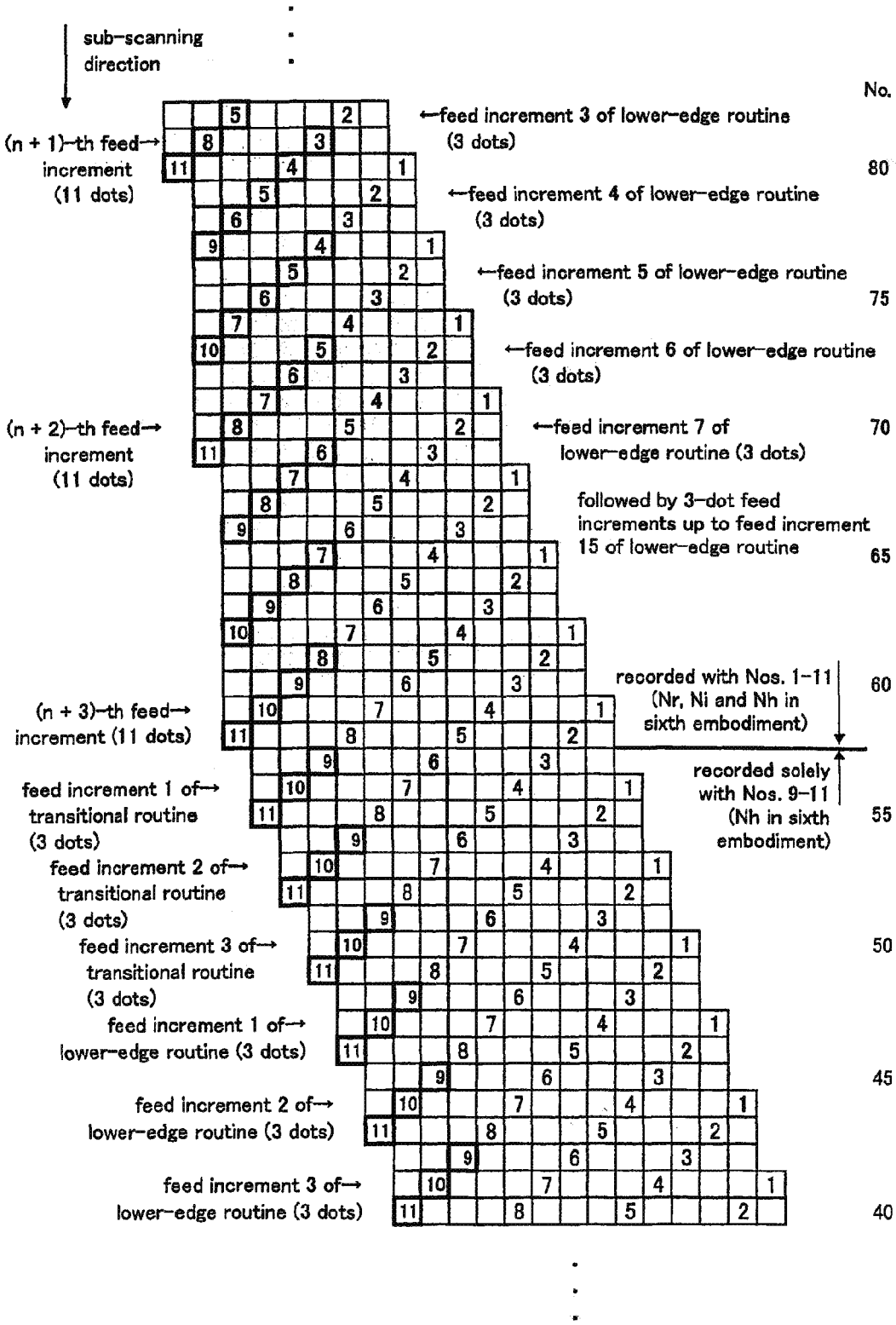
FIG. 20 is a diagram depicting the manner in which raster lines are recorded by particular nozzles during the lower-edge routine of the second embodiment.

FIGS. 19 and 20 are diagrams depicting the manner in which raster lines are recorded by particular nozzles in accordance with the lower-edge routine of the second embodiment. The case shown in FIG. 20 involves (n+1)-th and greater feed increments in the sub-scanning direction. FIGS. 19 and 20 depict two separate levels (upper and lower) of the process in which the head records the raster lines. The lower part of FIG. 20 is connected to the upper part of FIG. 21. The 45th to 40th raster lines from the bottom are shown in overlapped form in FIGS. 19 and 20.

In the present embodiment, 3-dot feeding is repeated four times in accordance with a transitional routine after 11-dot constant feeding has been repeated in the sub-scanning direction from the (n+1)-th cycle to the (n+3)-th cycle in accordance with an intermediate routine, as shown in FIGS. 19 and 20. Three-dot feeding is then performed using solely nozzle Nos. 9-11 in accordance with a lower-edge routine.

Figure 21:
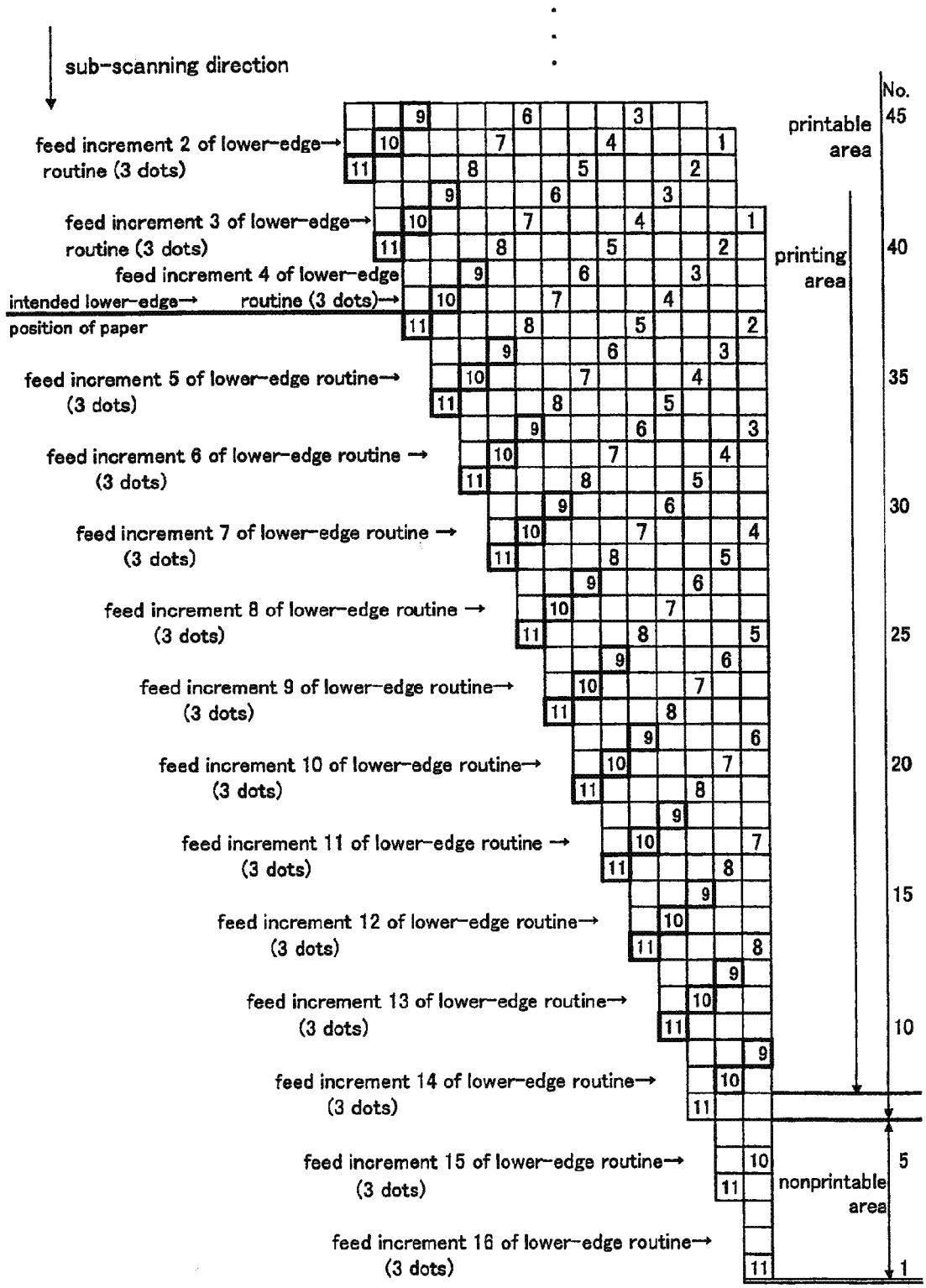
FIG. 21 is a diagram depicting the manner in which raster lines are recorded by particular nozzles during the lower-edge routine of the second embodiment.

In the second embodiment, images can be recorded by selecting the seventh and greater raster lines (printable area, counted from the bottom) from the raster lines on which dots can be recorded by the nozzles of the print head 28, as shown in FIG. 21. In the second embodiment, however, images are recorded using the eighth and greater raster lines from the bottom. In other words, the eighth and greater raster lines from the bottom in FIG. 21 constitute a printing area, and image data are specified for these raster lines.

In FIG. 21, a raster line such as the 13th or 16th raster line from the bottom is covered by two or more nozzles during a main print scan. For a raster line covered by two or more nozzles during printing, dots are recorded by the last nozzle passing over the raster line.

In the second embodiment, images can be recorded by selecting the eighth and greater raster lines, as counted from the downstream edge in the sub-scanning direction, from among the raster lines on which dots can be recorded by the nozzles of the print head 28*a*. The image data D used for printing are provided starting from the eighth raster line. For the same reasons as those described with reference to the first embodiment, printing is completed when the lower edge of the printing paper P reaches the position occupied by the 38th raster line rather than the eighth raster line, as counted from the downstream edge in the sub-scanning direction. Specifically, the intended position of the lower edge of the printing paper P in relation to each raster line at the end of printing coincides with the position occupied by the 38th raster line, as counted from the downstream edge in the sub-scanning direction (FIG. 21). Consequently, the second embodiment entails providing image data D equivalent to 30 raster lines, beyond the intended position of the lower edge of the printing paper P. For this reason, images can still be formed without blank spaces up to the lower edge when an error affecting the feeding of the printing paper P has occurred and the printing paper P fails to arrive at the intended position, provided the error is within 30 raster lines.

Another feature of the second embodiment is that nozzle Nos. 9-11 are the only nozzles involved in the recording of the 20 upstream raster lines counted from the position occupied by the lower edge and the 30 preset raster lines extending beyond the intended position of the lower edge of the printing paper P. An upstream slot 26*fa* is disposed underneath nozzle Nos. 9-11. Ink droplets can therefore be prevented from depositing on a platen 26*a* when these droplets are ejected onto the preset raster lines beyond the intended position of the lower edge of the printing paper P (that is, onto the area beyond the printing paper). It is also possible to prevent the ink droplets from depositing on the platen 26*a* when these droplets are ejected onto the raster lines in an area outside the lower-edge portion of the printing paper P in a state in which a feed error affecting the printing paper P has occurred and the printing paper P is fed in an excessive manner, provided the feed error is within 20 raster lines.

The printing paper P travels a longer distance when images are recorded in the area along the lower edge of the printing paper P than when images are recorded in the area along the upper edge of the printing paper P. It is highly likely, therefore, that when images are recorded the area along the lower edge of the printing paper P is recorded, the positional error of the printing paper P will be greater than when images are recorded in the area along the upper edge of the printing paper P. In addition, the downstream paper feed roller 25*d* is a gear-type roller, and the combined downstream paper feed rollers 25*c* and 25*d* can feed the sheet with less accuracy than when the upstream paper feed rollers 25*a* and 25*b* are involved. This is another factor that increases the likelihood that the error created during the recording of the area along the lower edge will be greater than the positional error of the printing paper P created during the recording of the area along the upper edge. Consequently, the number of raster lines recorded solely by the nozzles (Nos. 9-11) above the upstream slot 26*fa* in the lower-edge portion of the printing paper P should preferably be set above the number of raster lines recorded solely by the nozzles (Nos. 1-3) above the downstream slot 26*ra* in the upper-edge portion of the printing paper P in the manner adopted in the second embodiment. For image data D, the number of raster lines selected for the area beyond the lower edge of the printing paper P should preferably be set above the number of raster lines selected for the area beyond the upper edge of the printing paper P.

D. Third Embodiment

Figure 22:
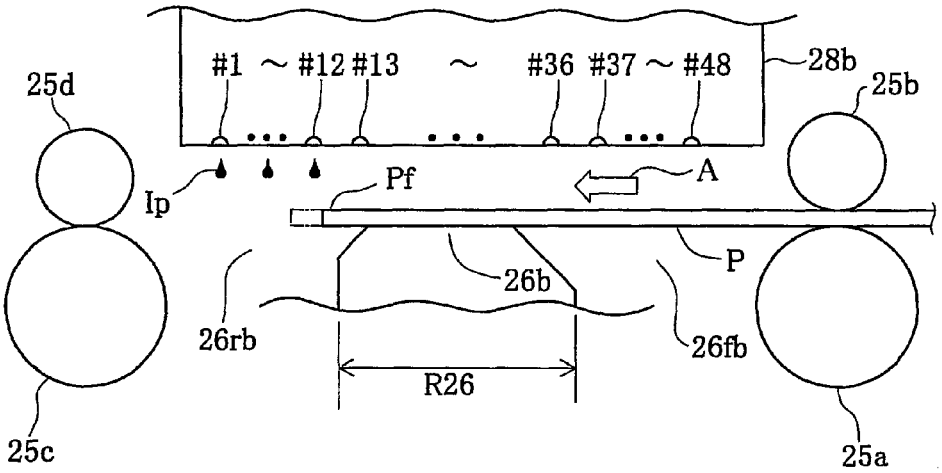
FIG. 22 is a side view depicting the relation of a print head 28*b* with an upstream slot 26*fb* and a downstream slot 26*rb* according to a third embodiment.

FIG. 22 is a side view depicting the relation of a print head 28*b* with an upstream slot 26*fb* and a downstream slot 26*rb* according to a third embodiment. A case will now be described in which upper- and lower-edge routines are performed by a printing device configured such that a single nozzle row contains 48 nozzles. In the printing device used herein, the downstream slot 26*rb* is provided at a position opposite nozzle Nos. 1-12 in the sub-scanning direction. The upstream slot 26*fb* is provided at a position opposite nozzle Nos. 37-48. The rest of the structure is the same as that of the printing device described above.

Figure 23:
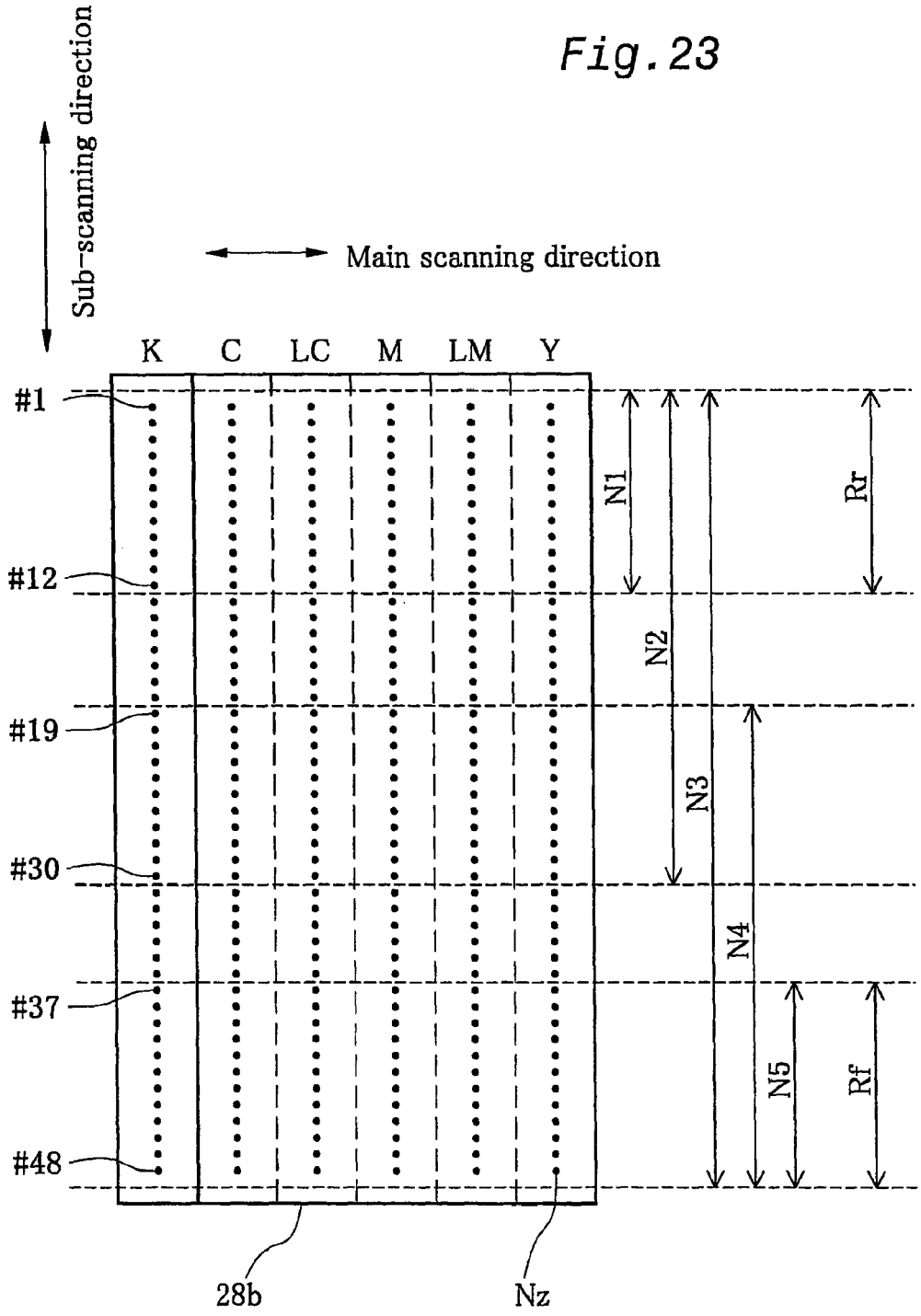
FIG. 23 is a diagram depicting the arrangement of ink-jet nozzles Nz in the ink-injecting heads 61*b*-66*b* pertaining to the third embodiment.

FIG. 23 is a diagram depicting the arrangement of ink-jet nozzles Nz in the ink-injecting heads 61*b*-66*b* pertaining to the third embodiment. In the third embodiment, the nozzles and the raster lines have the same pitch. Consequently, the print head 28*b* can record dots on adjacent raster lines by a single main scan. In FIG. 23, the area on the platen 26*b* opposite the downstream slot 26*rb* is labeled Rr, and the area opposite the upstream slot 26*fb* is labeled Rf. Area Rr accommodates nozzle Nos. 1-12, and area Rf accommodates nozzle Nos. 37-48. In the third embodiment, overlap printing is performed using the print head 28*b*.

(1) Upper-Edge Routine of Third Embodiment

Figure 24:
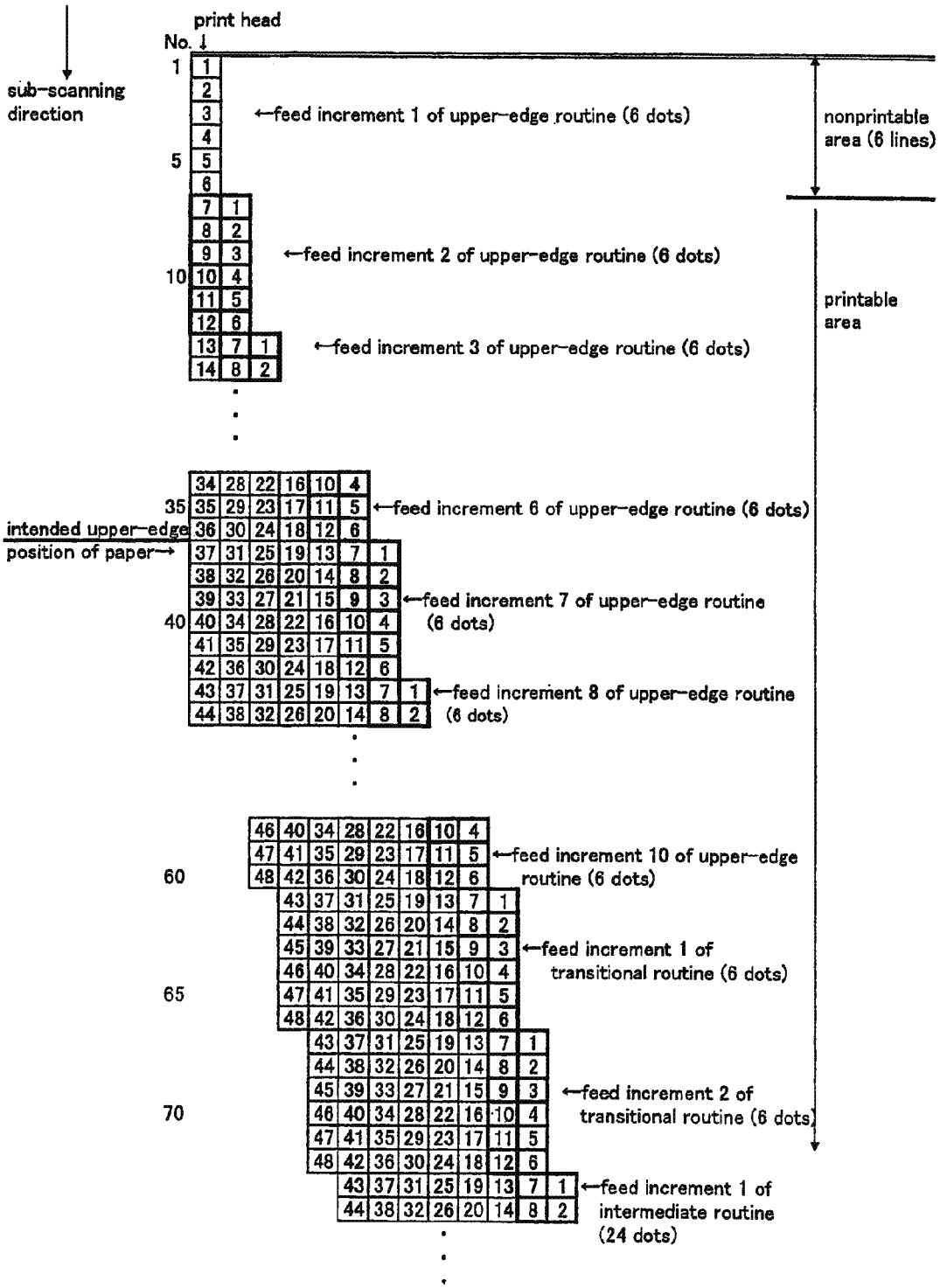
FIG. 24 is a diagram depicting the manner in which raster lines are recorded by particular nozzles during the upper-edge routine of the third embodiment.

FIGS. 23 and 24 are diagrams depicting the manner in which raster lines are recorded by particular nozzles in accordance with the upper-edge routine of the third embodiment. The lower part of FIG. 24 is connected to the upper part of FIG. 25. The 66th to 74th raster lines from the top are shown in overlapped form.

During the upper-edge routine of the third embodiment, 6-dot incremental feeding in the sub-scanning direction is repeated ten times, as shown in FIG. 24. This upper-edge routine involves printing images in accordance with the first recording mode. The upper-edge routine is performed without the use of nozzles other than nozzle Nos. 1-12 of the print head 28*b*. In the drawings, the nozzles within bold boxes are used for recording dots on raster lines. The nozzles used for the upper-edge routine are labeled "nozzle group N1" in FIG. 23.

Figure 25:
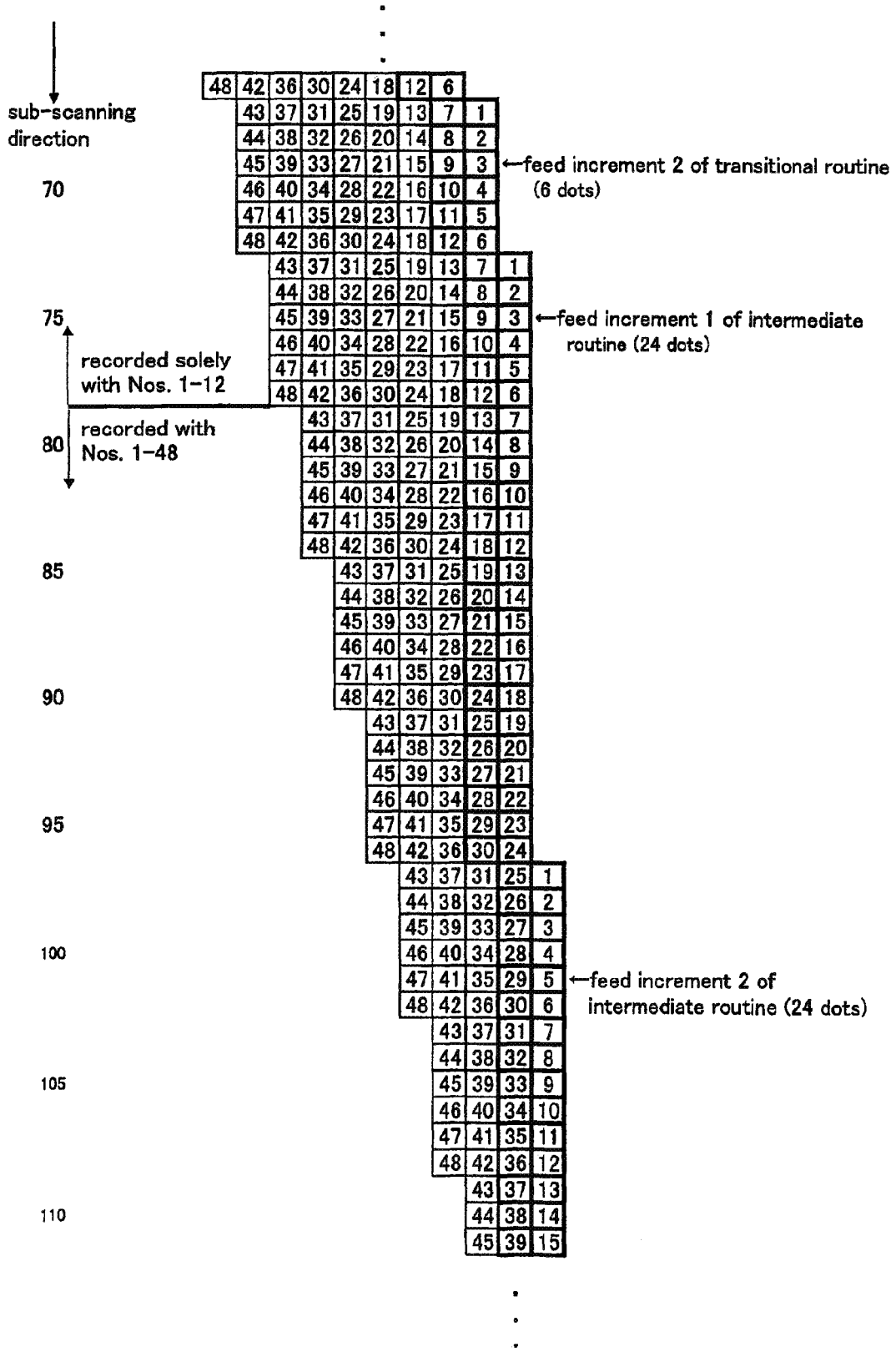
FIG. 25 is a diagram depicting the manner in which raster lines are recorded by particular nozzles during the upper-edge routine of the third embodiment.

A transitional routine is subsequently carried out. The transitional routine is similar to the upper-edge routine is that feeding in 6-dot increments is carried out twice in the sub-scanning direction. The transitional routine is also similar to the upper-edge routine in that the final feed is followed by an operation in which dots are recorded by nozzle Nos. 1-12. Nozzle Nos. 1-30 are used after the second feed. The operation then proceeds to the intermediate routine, and 24-dot constant feeds are repeated, as shown in FIG. 25. All the nozzles (Nos. 1-48) are used in the intermediate routine. The intermediate routine involves printing images in accordance with the second recording mode. The nozzles used in the transitional routine after the second feed are labeled "nozzle group N2" in FIG. 23. The nozzles used in the intermediate routine are labeled "nozzle group N3" in FIG. 23.

In FIG. 24, overlap printing is dispensed with because the nozzles pass only once over the group of raster lines extending from the uppermost tier to the sixth raster line during a main print scan. In the present embodiment, these six raster lines constitute a nonprintable area. Of the raster lines covered by two or more nozzles, such as the 13th and greater raster lines from the top, dots can be recorded only by the last nozzles passing over the raster lines, and by the nozzles passing over the raster lines immediately before the last nozzles.

In the third embodiment, the image data D used for printing are specified based on the seventh raster line (as counted from the upstream edge in the sub-scanning direction), which constitutes the upper edge of the printable area. For the same reasons as in the first embodiment, printing is started after the upper edge of the printing paper P reaches the position occupied by the 37th raster line, as counted from the upstream edge in the sub-scanning direction. This position is labeled in FIG. 24 as the intended position of the upper edge of the printing paper P. In other words, the third embodiment entails providing image data D for 36 raster lines, beyond the intended position of the upper edge of the printing paper P. For this reason, images can still be formed without blank spaces up to the upper edge of the printing paper P when an error affecting the feeding of the printing paper P has occurred and the printing paper P is fed in an excessive manner, provided the error is within 36 raster lines.

Another feature of the third embodiment is that nozzle Nos. 1-12 above the downstream slot 26*rb* are the only nozzles involved in the recording of the 42 raster lines counted from the position occupied by the upper edge and the 36 preset raster lines extending beyond the intended position of the upper edge of the printing paper P. Ink droplets can therefore be prevented from depositing on the platen 26*a* when these droplets are ejected onto the 36 preset raster lines beyond the intended position of the upper edge of the printing paper P (that is, onto the area beyond the printing paper). It is also possible to prevent the ink droplets from depositing on the platen 26*b* when these droplets are ejected onto the raster lines in an area outside the upper-edge portion of the printing paper P in a state in which a feed error affecting the printing paper P has occurred and the printing paper P has failed to arrive at the intended position, provided the feed error is within 42 raster lines.

(2) Lower-Edge Routine of Third Embodiment

Figure 26:
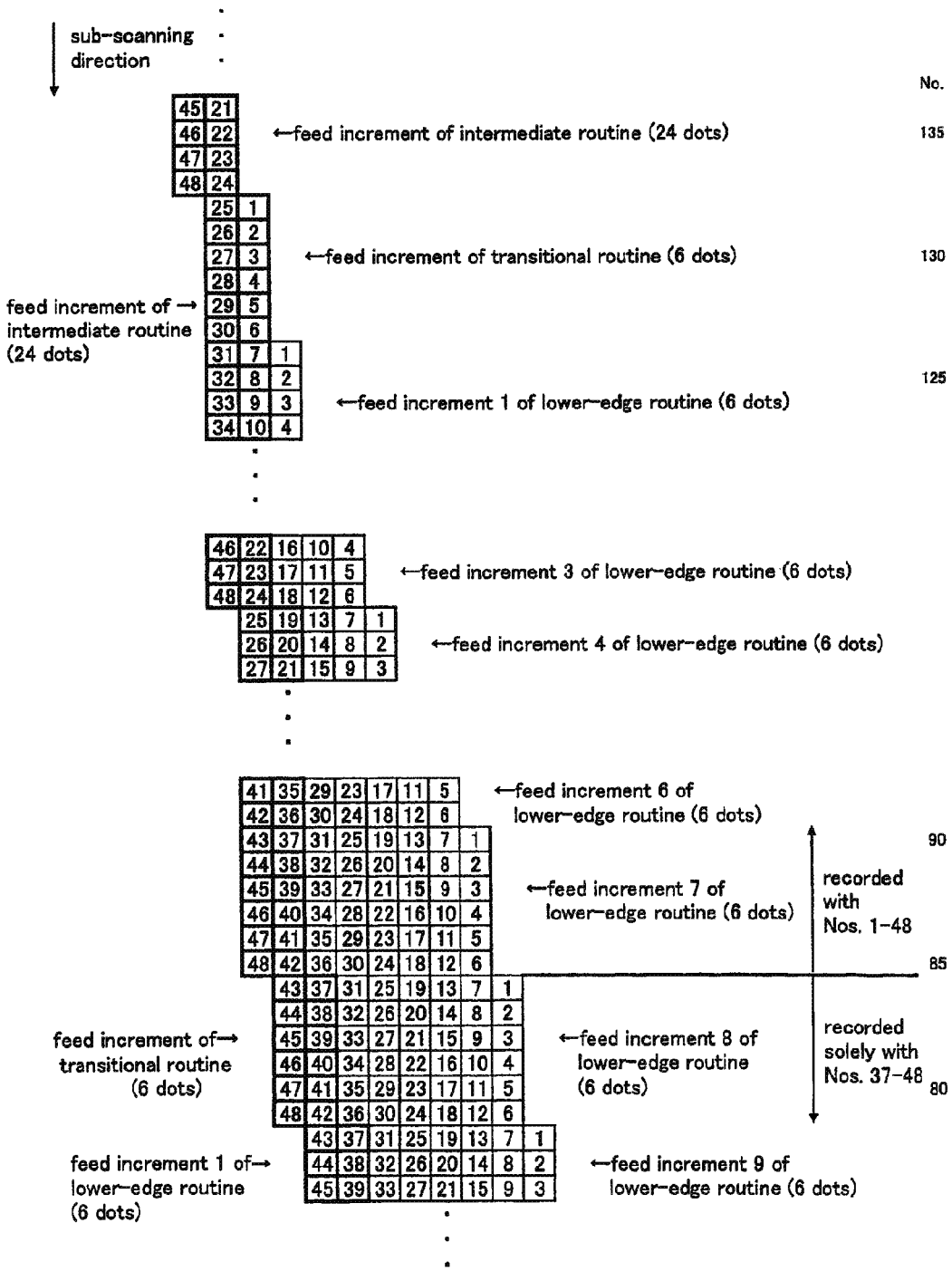
FIG. 26 is a diagram depicting the manner in which raster lines are recorded by particular nozzles during the lower-edge routine of the third embodiment.

FIGS. 25 and 26 are diagrams depicting the manner in which raster lines are recorded by particular nozzles in accordance with the lower-edge routine of the third embodiment. The lower part of FIG. 26 is connected to the upper part of FIG. 27.

In the present embodiment, 24-dot constant feeds are repeated in accordance with the intermediate routine, and a single 6-dot feed is performed in accordance with the transitional routine, as shown in FIG. 26. Nozzle Nos. 19-48 are used following this feed. A 6-dot feed is then made using solely nozzle Nos. 37-48 in accordance with the lower-edge routine. The nozzles used following the feed performed in accordance with the transitional routine are those labeled "nozzle group N4" in FIG. 23. The nozzles used for the lower-edge routine are those labeled "nozzle group N5" in FIG. 23

Figure 27:
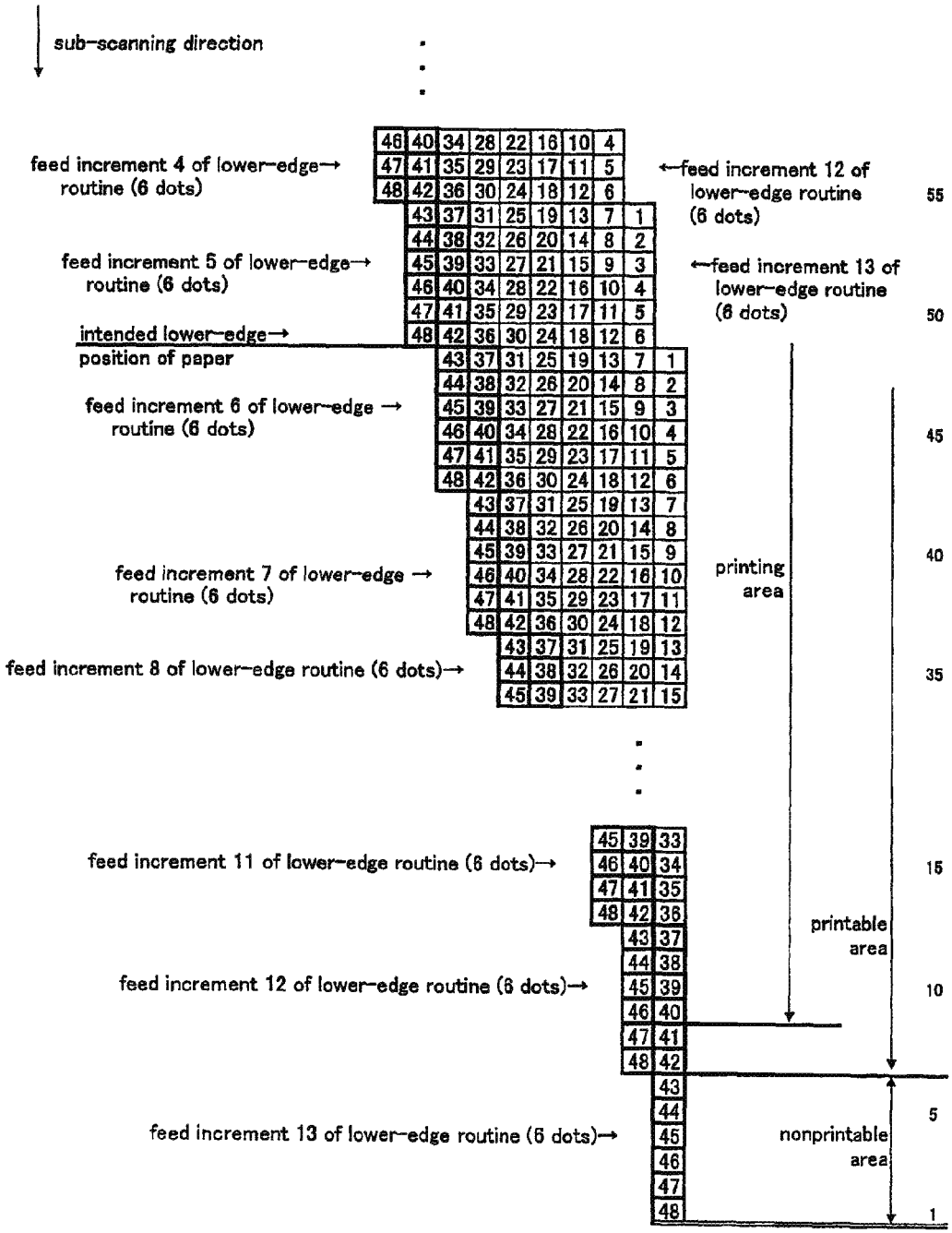
FIG. 27 is a diagram depicting the manner in which raster lines are recorded by particular nozzles during the lower-edge routine of the third embodiment.

In the third embodiment, images may be recorded by selecting the seventh and greater raster lines (printable area, counted from the bottom) from the raster lines on which dots can be recorded by the nozzles of the print head 28, as shown in FIG. 27. In the third embodiment, however, images are recorded using the ninth and greater raster lines from the bottom. In other words, the ninth and greater raster lines from the bottom in FIG. 27 constitute a printing area, and image data are specified for these raster lines.

In FIG. 27, the 13th and greater raster lines from the bottom are covered by two or more nozzles during a main print scan. For a raster line covered by two or more nozzles during printing, dots are recorded by the last nozzle passing over the raster lines, and by the subsequent nozzles passing over the raster lines.

In the third embodiment, the image data D used for printing are specified up to the ninth raster line from the bottom. For the same reasons as in the first embodiment, printing is completed after the lower edge of the printing paper P reaches the position occupied by the 49th raster line rather than the position occupied by the ninth raster line, as counted from the downstream edge in the sub-scanning direction. FIG. 27 depicts the intended position of the lower edge of the printing paper P in relation to the raster lines at the end of printing. Consequently, the third embodiment entails providing image data D for 40 raster lines, beyond the intended position of the lower edge of the printing paper P. For this reason, images can still be formed without blank spaces up to the lower edge when an error affecting the feeding of the printing paper P has occurred and the printing paper P fails to arrive at the intended position, provided the error is within 40 raster lines.

Another feature of the third embodiment is that nozzle Nos. 37-48 above the upstream slot 26*fb* are the only nozzles involved in the recording of the 36 raster lines counted from the position occupied by the lower edge and the 40 preset raster lines extending beyond the intended position of the lower edge of the printing paper P. Ink droplets can therefore be prevented from depositing on the platen 26*b* when these droplets are ejected onto the preset raster lines beyond the intended position of the lower edge of the printing paper P (that is, onto the area beyond the printing paper). It is also possible to prevent the ink droplets from depositing on the platen 26*a* when these droplets are ejected onto the raster lines in an area outside the lower-edge portion of the printing paper P in a state in which a feed error affecting the printing paper P has occurred and the printing paper P is fed in an excessive manner, provided the feed error is within 36 raster lines.

Yet another feature of the third embodiment is that the number of raster lines recorded solely by the nozzles (Nos. 37-48) disposed above the upstream slot 26*fb* in the lower-edge portion of the printing paper P is set above the number of raster lines recorded solely by the nozzles (Nos. 1-12) disposed above the downstream slot 26*rb* in the upper-edge portion of the printing paper P. For image data D, the number of raster lines selected for the area beyond the lower edge of the printing paper P is set above the number of raster lines selected for the area beyond the upper edge of the printing paper P.

E. Embodiment with Lateral Slot

The above description was given with reference to an embodiment in which a printer 22 comprising an upstream slot 26*f* and a downstream slot 26*r* in a platen 26 was used to print images on the basis of image data D (see FIG. 10) provided for an area beyond the lower and upper edges of a printing paper P, as shown in FIGS. 11 and 15. Following is a description of an embodiment in which a printer 22*n* whose platen is fitted with a left slot 26*na* and a right slot 26*nb* in addition to the upstream slot 26*f* and downstream slot 26*r* is used to print images on the basis of image data Dn provided for an area beyond the upper, lower, left, and right edges of a printing paper P.

Figure 28:
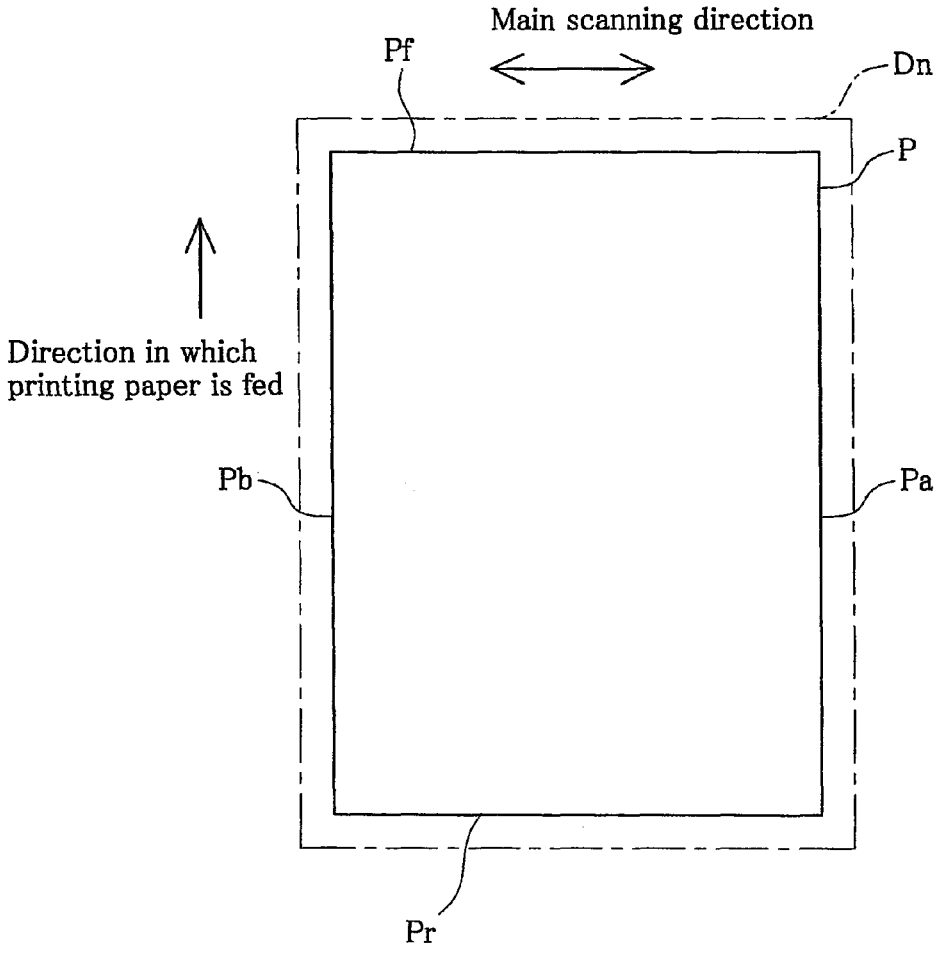
FIG. 28 is a plan view depicting the relation between image data Dn and printing paper P.

FIG. 28 is a plan view depicting the relation between image data Dn and printing paper P. In FIG. 28, the image data Dn are provided for the area outside the printing paper P not only beyond the upper edge Pf and lower edge Pr edges of the printing paper P but also along the left edge Pa and right edge Pb thereof. FIG. 28 depicts the resulting relation between the image data Dn and the size of the printing paper P, on the one hand, and the image data Dn and the arrangement of the printing paper P during printing, on the other hand, in accordance with the present embodiment. The width of an image (width of expanded area) that can be recorded with the image data Dn is such that the image extends beyond the left and right edges of the printing paper P but fits between the side walls of the exterior portions of the left slot 26*na* and right slot 26*nb*. Because the terms "left" and "right" for the left edge Pa and right edge Pb are selected to match the terms "left" and "right" for the printer 22, the actual left and right sides of the printing paper P are the reverse of those designated by the terms "left edge Pa" and "right edge Pb."

Figure 29:
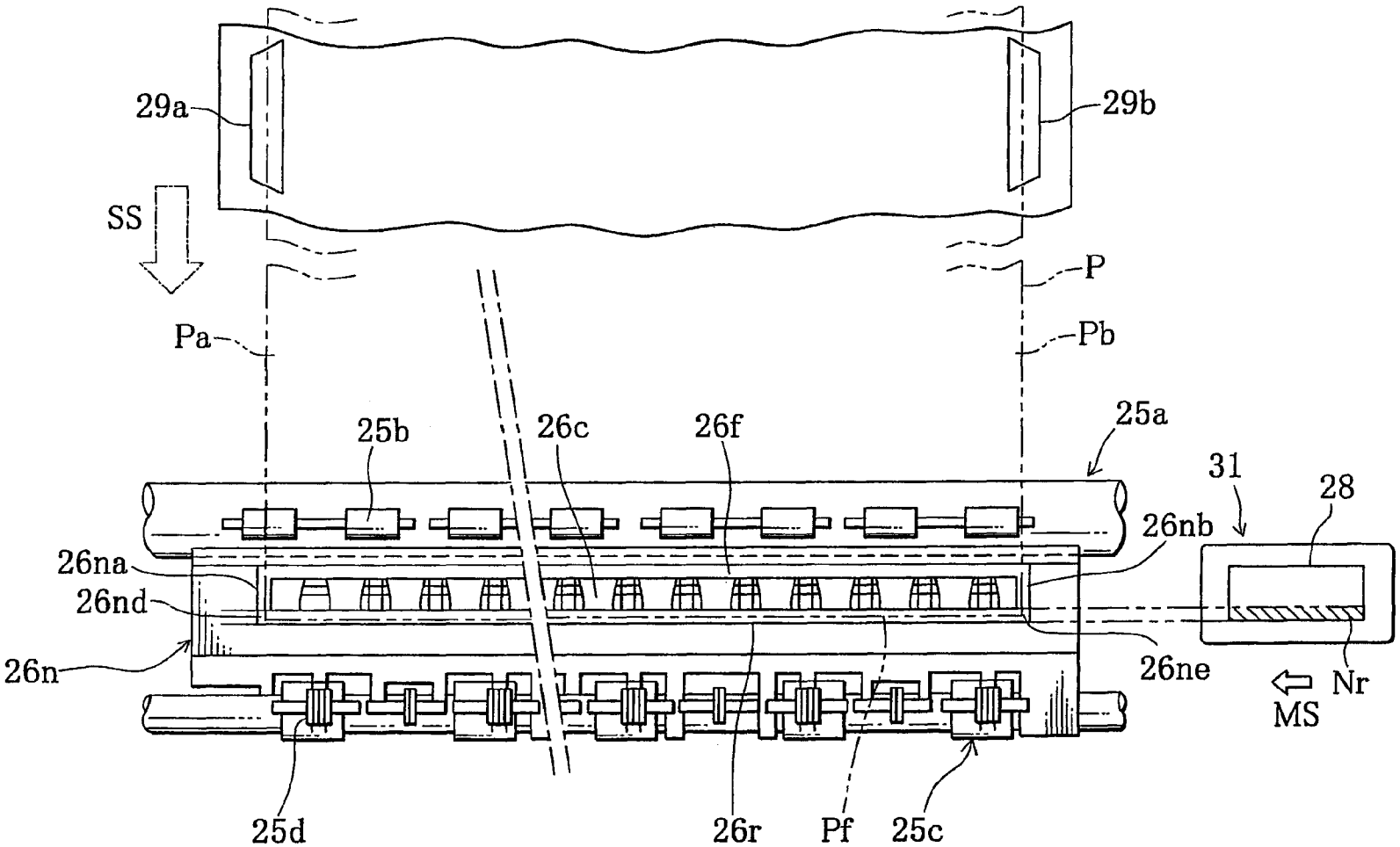
FIG. 29 is a plan view depicting the periphery of a platen 26*n* for a printer 22*n;*

FIG. 29 is a plan view depicting the periphery of a platen 26*n* for a printer 22*n*. The printer 22*n* is equipped with guides 29*a* and 29*b* for keeping the printing paper P at a specified position in the main scanning direction during the sub-scanning of the printing paper P. Similar to the platen 26 in FIG. 8, the platen 26*n* is provided with an upstream slot 26*f* and a downstream slot 26*r*. The platen 26*n* further comprises a left slot 26*na* and a right slot 26*nb*, which extend in the sub-scanning direction to connect the two corresponding ends of the upstream slot 26*f* and downstream slot 26*r*. The left slot 26*na* and right slot 26*nb* are provided within a range (in the sub-scanning direction) greater than the range within which ink droplets can be deposited by the nozzles of the print head. The left slot 26*na* and right slot 26*nb* are arranged such that the distance between the center lines thereof (in the main scanning direction) is equal to the width of the printing paper P in the main scanning direction. Other structural elements are the same as those of the above-described printer 22.

The left slot 26*na* and right slot 26*nb* should be configured such that one of the side-edge portions (side-edge portion Pa) of the printing paper P in the main scanning direction is disposed above the opening of the left slot 26*na*, and the other side-edge portion (side-edge portion Pb) is disposed above the opening of the right slot 26*nb* when the printing paper P is brought to a specified main-scan position by the guides 29*a* and 29*b*. An arrangement in which the side-edge portions of the printing paper P are disposed at a point located inward or outward from the center lines of the left slot 26*na* and right slot 26*nb* can therefore be adopted for the left slot 26*na* and right slot 26*nb* in addition to an embodiment in which the side-edge portions of the printing paper P are disposed along the center lines of the left slot 26*na* and right slot 26*nb* when the printing paper is brought into a specified position in this manner.

The upstream slot 26*f*, downstream slot 26*r*, left slot 26*na*, and right slot 26*nb* are connected to each other, forming a quadrilateral slot. An absorbent member 27 for receiving and absorbing ink droplets Ip is disposed on the bottom thereof.

The printing paper P passes above the openings of the upstream slot 26*f* and downstream slot 26*r* when fed in the sub-scanning direction by the upstream paper feed rollers 25*a* and 25*b* and the downstream paper feed rollers 25*c* and 25*d*. The printing paper P is positioned on the platen 26*n* by the guides 29*a* and 29*b* in the main scanning direction such that the left edge Pa is disposed above the left slot 26*na*, and the right edge Pb is disposed above the right slot 26*nb*. The two side edges of the printing paper P are thereby fed while kept at positions above the openings of the left slot 26*na* and right slot 26*nb*, respectively, during sub-scanning.

In the embodiment shown in FIG. 29, the feeding methods of the above-described first embodiment (See FIGS. 8, 11, 13 to 15), second embodiment (See FIGS. 17 to 21) and third embodiment (See FIGS. 22 to 27) can be adopted for the secondary-scan feeding of the upper- and lower-edge routines in accordance with the positional relation between the platen 26*n* and the nozzles of the nozzle row. A description is therefore given below concerning the printing of images in the side-edge portions Pa and Pb of the printing paper P.

Figure 30:
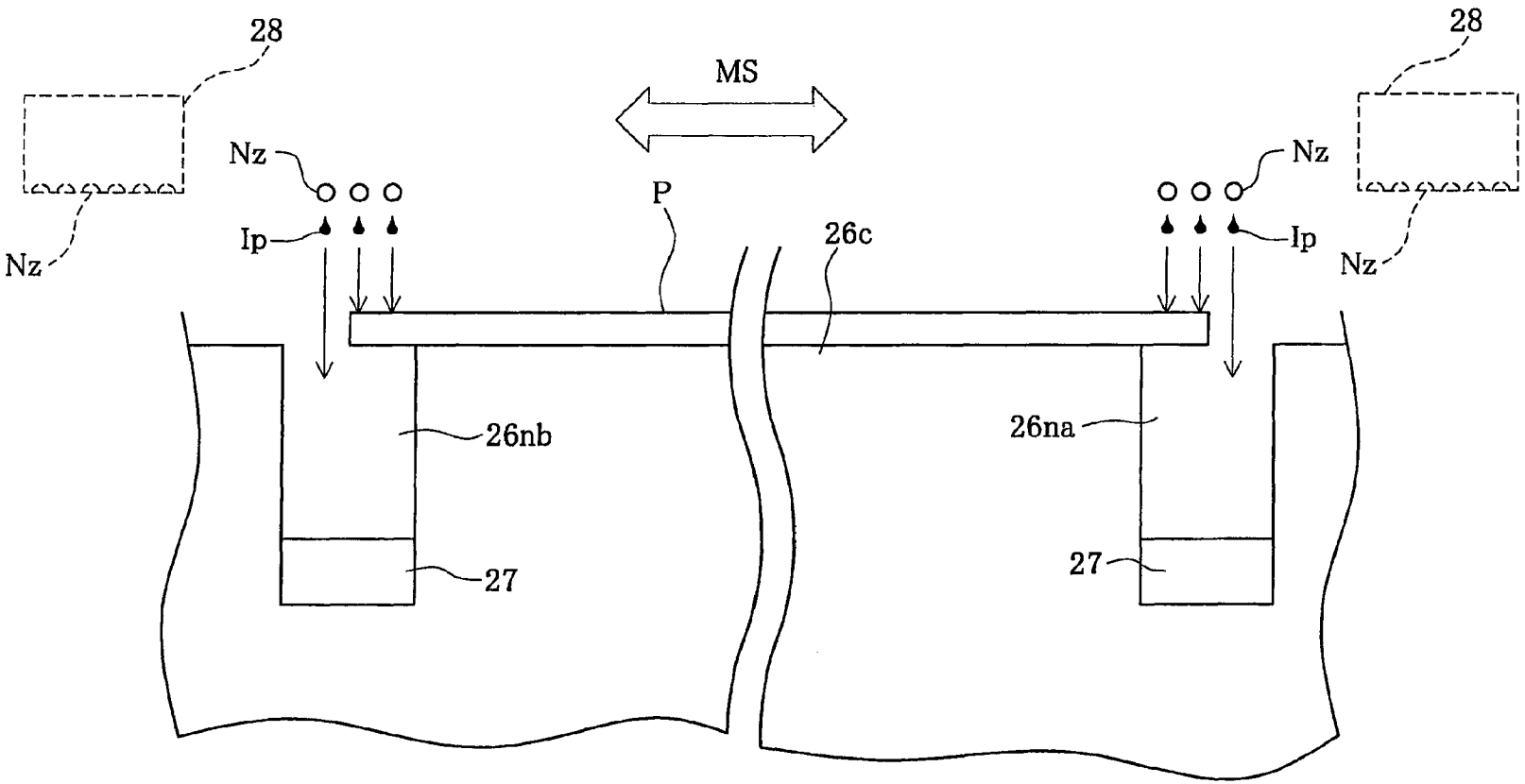
FIG. 30 is a diagram depicting the manner in which images are printed in the left and right side-edge portions of the printing paper P.

FIG. 30 is a diagram depicting the manner in which images are printed in the left and right side-edge portions of the printing paper P. The embodiment shown in FIG. 29 includes upper- and lower-edge routines, and images can be printed without blank spaces in the left and right edge portions of the printing paper P throughout the entire operation in which images are printed on the printing paper P. In the process, the print head 28 is transported in the main scanning direction until all the nozzles have moved beyond one of the edges of the printing paper P and reached a position outside the printing paper P, and until all the nozzles have moved beyond the other edge of the printing paper P and reached a position outside the printing paper P in the same manner. The nozzles Nz eject ink in accordance with image data Dn not only when they reach a position above the printing paper P but also when they reach a position beyond the edge of the printing paper P or a position above the left slot 26*na* or right slot 26*nb*. The image area (expanded area) of the image data Dn extends beyond the left and right edges of the printing paper P but fits between the side walls of the exterior portions of the left slot 26*na* and right slot 26*nb*. For this reason, ink droplets can be ejected in accordance with the image data Dn when the nozzles are disposed outside the printing paper P above the left slot 26*na* or right slot 26*nb*.

Such printing allows images to be formed without blank spaces along the right and left edges of the printing paper P even when the printing paper P is shifted somewhat in the main scanning direction. Because the nozzles for printing images in the two side-edge portions of the printing paper are disposed above the left slot 26*na* or right slot 26*nb*, ink droplets deposit in the left slot 26*na* or right slot 26*nb* rather than in the central portion 26*c* of the platen 26 when shifted away from the printing paper P. It is therefore possible to prevent situations in which the printing paper P is soiled by the deposition of ink droplets in the central portion 26*c* of the platen 26.

F. Fifth Embodiment

F1. Overview of Embodiments

Figure 31:
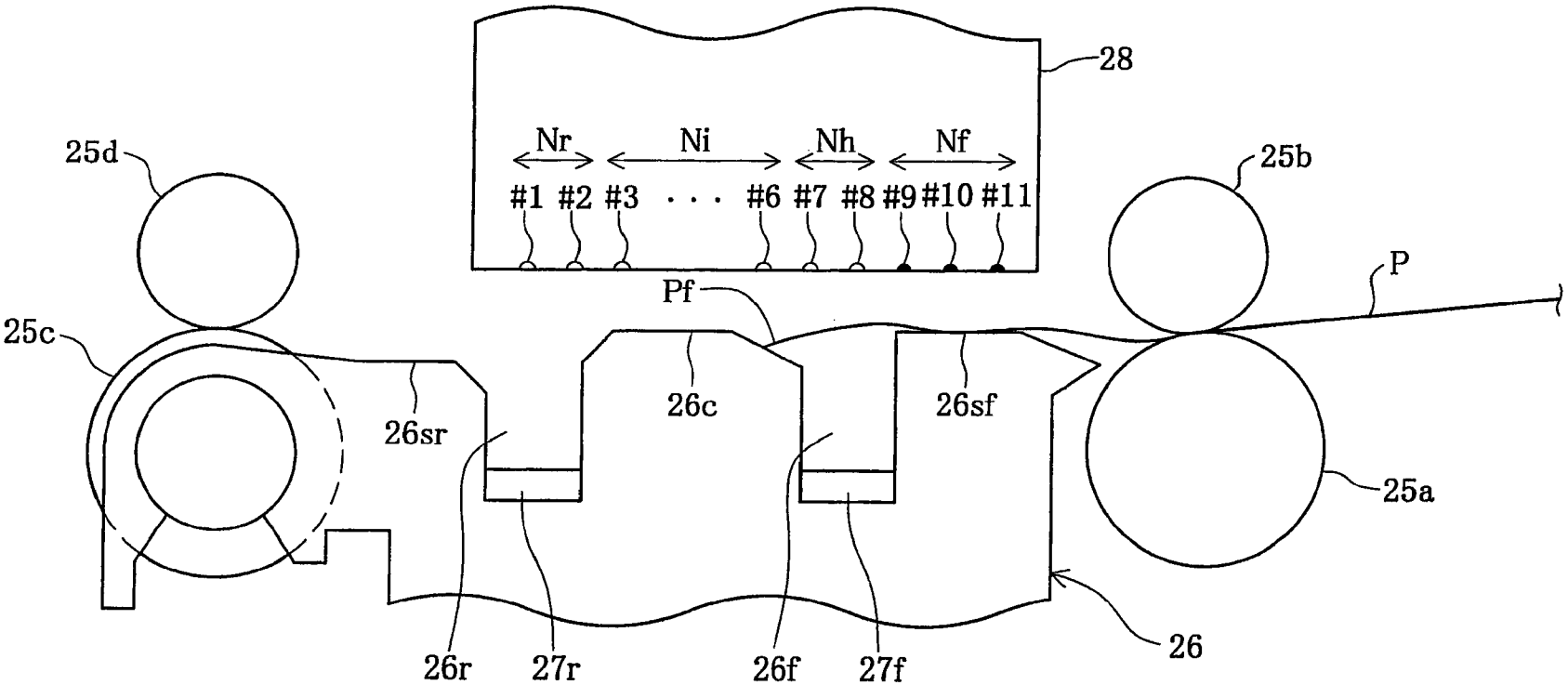
FIG. 31 is a side view depicting the structure of the periphery around a print head provided to an ink-jet printer in accordance with an embodiment of the present invention.

FIG. 31 is a side view depicting the structure of the periphery around a print head provided to an ink-jet printer in accordance with an embodiment of the present invention.

In the fifth embodiment shown in FIG. 31, the platen 26 is comprising the upstream support 26*sf* disposed further upstream from the upstream slot 26*f*. The printer in the fifth embodiment differs from the printer in the first embodiment in the positional relationship of each support, each slot and nozzles in front of these supports and slots. The rest of the structure is the same as that of the printing device pertaining to the first embodiment.

The platen 26 of the printer comprises, in order from the upstream side in the sub-scanning direction, an upstream support 26*sf*, an upstream slot 26*f*, a central support 26*c*, and a downstream slot 26*r*. The printer has a first image-printing mode for printing images without blank spaces all the way to the lower and upper edges of printing paper, and a second image-printing mode for printing images in the regular manner, with blank spaces formed along the upper and lower edges of the printing paper during printing. The second image-printing mode is performed using all the nozzles (nozzle Nos. 1-11 from nozzle groups Nr, Ni, Nh, and Nf) of the print head 28 throughout the entire process of printing images on printing paper. By contrast, the first image-printing mode is performed using solely nozzle Nos. 1-8 (nozzle groups Nr, Ni, and Nh) of the print head 28.

In the first image-printing mode, the upper-edge portion Pf of the printing paper P is disposed above the downstream slot 26*r* when images are printed along the upper (front) edge Pf of the printing paper P. The images in the upper-edge portion are printed by nozzle Nos. 1 and 2 (nozzle group Nr), which are located above the downstream slot 26*r*. The images in the intermediate portion of the printing paper P are printed by nozzle Nos. 1-8 (nozzle groups Nr, Ni, and Nh). The lower edge of the printing paper P is disposed above the upstream slot 26*f* when images are printed along the lower (back) edge of the printing paper P. The printing is accomplished using nozzle Nos. 8 and 9 (nozzle group Nh), which are located above the upstream slot 26*f*.

In the embodiment shown in FIG. 31, the platen 26 is comprising the upstream support 26*sf* disposed further upstream from the upstream slot 26*f*. For this reason, the printing paper P is supported at two points by the upstream paper feed rollers 25*a* and 25*b* and the upstream support 26*sf* when initially transported by the upstream paper feed rollers 25*a* and 25*b*. The front-edge portion Pf of the printing paper P is therefore fed in the direction of the central support 26*c* while kept in a relatively horizontal position. The resulting advantage is that the front edge Pf of the printing paper P is unlikely to fall into the upstream slot 26*f* during initial feeding in the course of sub-scanning.

The nozzle group Nr disposed above the downstream slot 26*r* is used when images are printed in the upper-edge portion of the printing paper P, and the nozzle group Nh disposed above the upstream slot 26*f* is used when images are printed in the lower-edge portion. The images can therefore be printed without blank spaces all the way to the upper and lower edges of the printing paper while the platen 26 is prevented from being soiled. Faster printing can be achieved in the intermediate portion because images are printed in this portion with the aid of the nozzle group Nr, the nozzle group Nh, and the interposed nozzle group Ni. Chronologically, images are printed first by the downstream portion of the nozzle group Nr; then by the nozzle groups Nr, Ni, and Nh; and finally by the upstream portion of the nozzle group Nh. In other words, the nozzles used for printing are smoothly shifted in the sub-scanning direction from the downstream side to the upstream side. The resulting advantage is that high-quality printing results can be obtained without the need to reverse the direction in which printing paper is fed during sub-scanning.

F2. Device Structure

Figure 32:
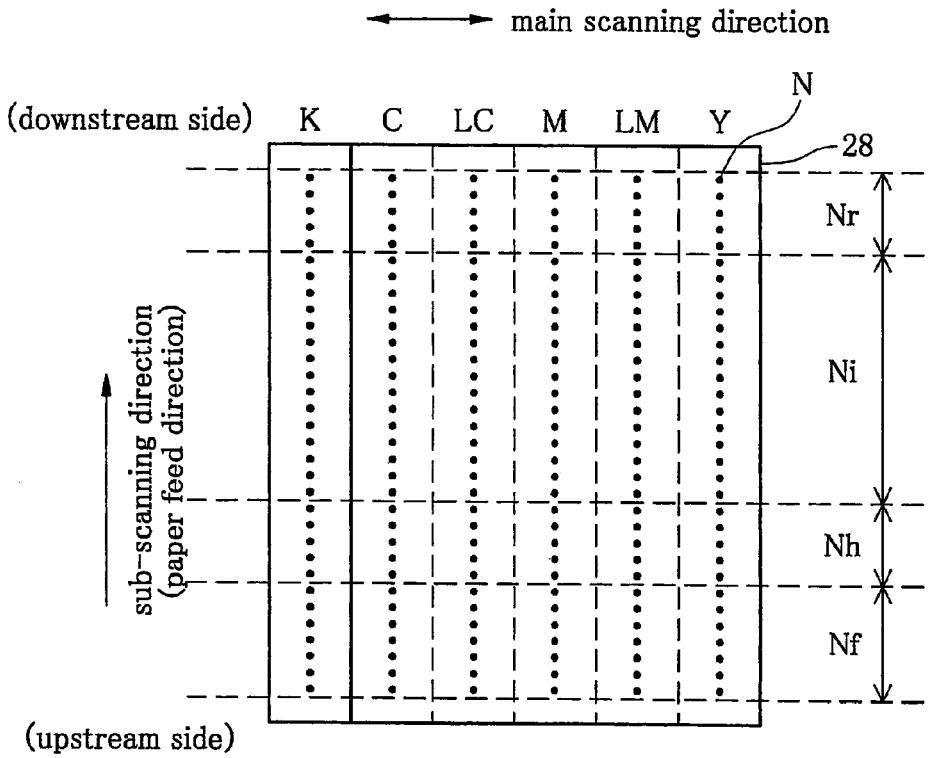
FIG. 32 is a diagram depicting the arrangement of the ink-jet nozzles N in the print head 28.

FIG. 32 is a diagram depicting the arrangement of the ink-jet nozzles N in the print head 28. These six nozzle arrays are aligned in the main scanning direction. More specifically, the nozzle pairs for each nozzle array lie on the same main scan lines. These nozzle arrays (rows of nozzles) correspond to the dot-forming elements. In FIG. 32, the nozzle arrangement is shown in enlarged form and does not reflect the actual number of nozzles or the dimensions of the head used in the embodiments.

Figure 33:
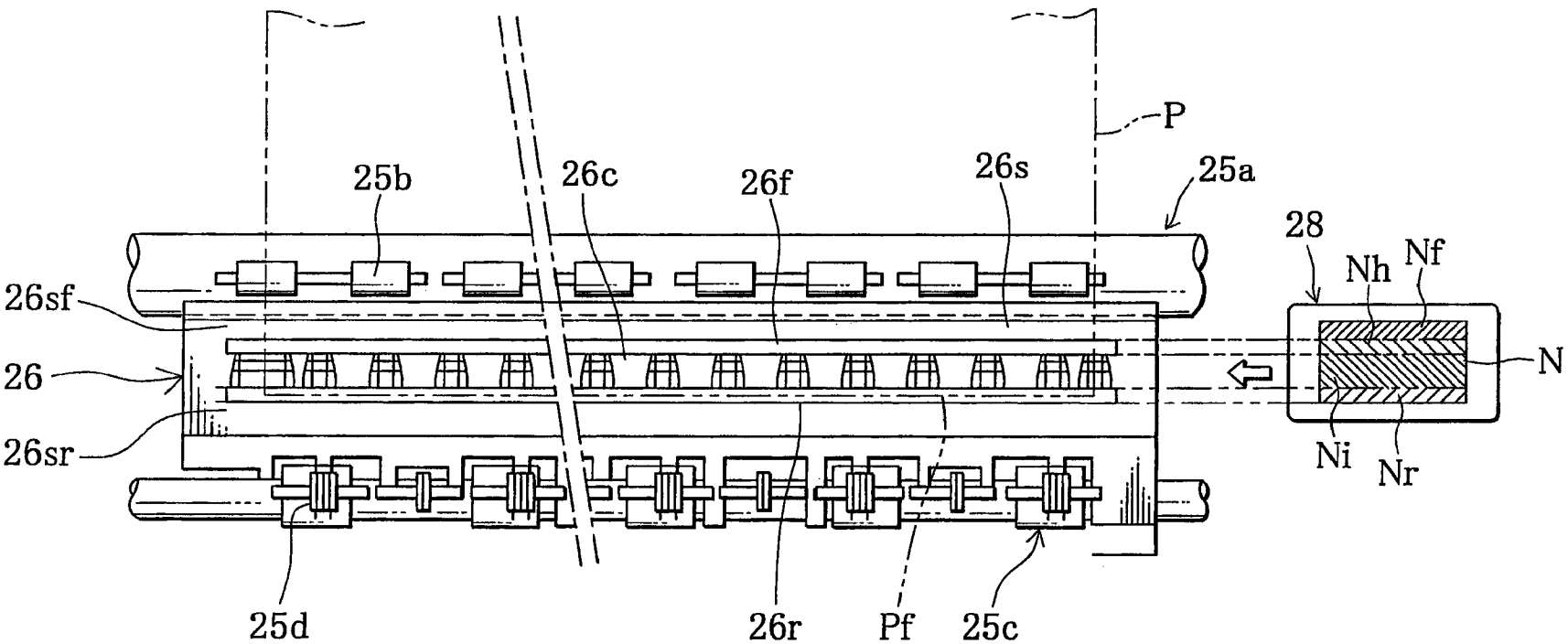
FIG. 33 is a plan view depicting the periphery of a platen 26.

FIG. 33 is a plan view depicting the periphery of the platen 26. The nozzles of each nozzle array are divided into four subgroups in order from the upstream side in the sub-scanning direction (See FIGS. 31 and 33). The subgroups correspond to the sub-groups of dot-forming elements. The subgroups of each nozzle array will be collectively referred to hereinbelow as "nozzle groups Nf, Nh, Ni, and Nr," indicated in order from the upstream side in the sub-scanning direction. The first nozzle group Nf, which is disposed on the most upstream side, corresponds to the first sub-group of dot-forming elements, and the second nozzle group Nh corresponds to the second sub-group of dot-forming elements. The third nozzle group Ni corresponds to the third sub-group of dot-forming elements, and the fourth nozzle group Nr corresponds to the fourth sub-group of dot-forming elements. Here, the sub-groups of dot-forming elements of each nozzle array are collectively treated as nozzle groups Nf, Nh, Ni, and Nr. These nozzle groups are selected to correspond to the slots, supports, and other structural components of the platen 26, which is disposed facing the print head 28 during main scanning. The correspondence between the nozzle groups and the slots, supports, and other structural components of the platen 26 will be described below.

The portion of the platen further upstream of the upstream slot 26*f* is referred to as "a upstream support 26*sf*." The portion between the upstream slot 26*f* and downstream slot 26*r* of the platen 26 is referred to as "a central support 26*c*." The portion of the platen further downstream of the downstream slot 26*r* is referred to as "a downstream support 26*sr*." The upstream slot 26*f* corresponds to the first slot, and the downstream slot 26*r* corresponds to the second slot. The upstream support 26*sf* corresponds to the first support, and the central support 26*c* corresponds to the second support.

A description will now be given in order from the upstream side in the sub-scanning direction. First, the upstream support 26*sf* is provided such that it extends in the main scanning direction at a position opposite the first nozzle group Nf, which belongs to the nozzles of the print head 28 and is disposed on the most upstream side. The upstream support 26*sf* is provided with a flat upper surface. The upstream slot

26*f* is then provided such that it extends in the main scanning direction at a position opposite the second nozzle group Nh, which is disposed downstream of the first nozzle group Nf. The central support 26*c* is provided such that it extends in the main scanning direction at a position opposite the third nozzle group Ni, which is disposed downstream of the second nozzle group Nh. The downstream slot 26*r* is then provided such that it extends in the main scanning direction at a position opposite the fourth nozzle group Nr, which is disposed downstream of the third nozzle group Ni. Finally, the downstream support 26*sr* is provided such that it extends in the main scanning direction at a position in the sub-scanning direction downstream from those nozzles of the print head 28 that are disposed at the downstream edge in the sub-scanning direction. In the print head 28 depicted in FIG. 33, the nozzle groups Nf, Nh, Ni, and Nr are hatched with oblique lines at mutually different inclines and intervals.

According to the first image-printing mode described below, the printing routine employed for the areas near the upper and lower edges of printing paper is different from that employed for the intermediate portion of the printing paper because the images at the upper edge Pf of the printing paper P are printed above the downstream slot 26*r*, and the images at the lower edge Pr are printed above the upstream slot 26*f*. In the present specification, the printing routine employed for the intermediate portion of printing paper will be referred to as "an intermediate routine," and the printing routines employed for the areas near the upper and lower edges of the printing paper will be referred "an upper-edge routine" and "a lower-edge routine," respectively. The term "upper and lower printing routines" will be used to collectively refer to the upper-edge routine and lower-edge routine.

F3. Selection of Image-Printing Mode

Figure 34:
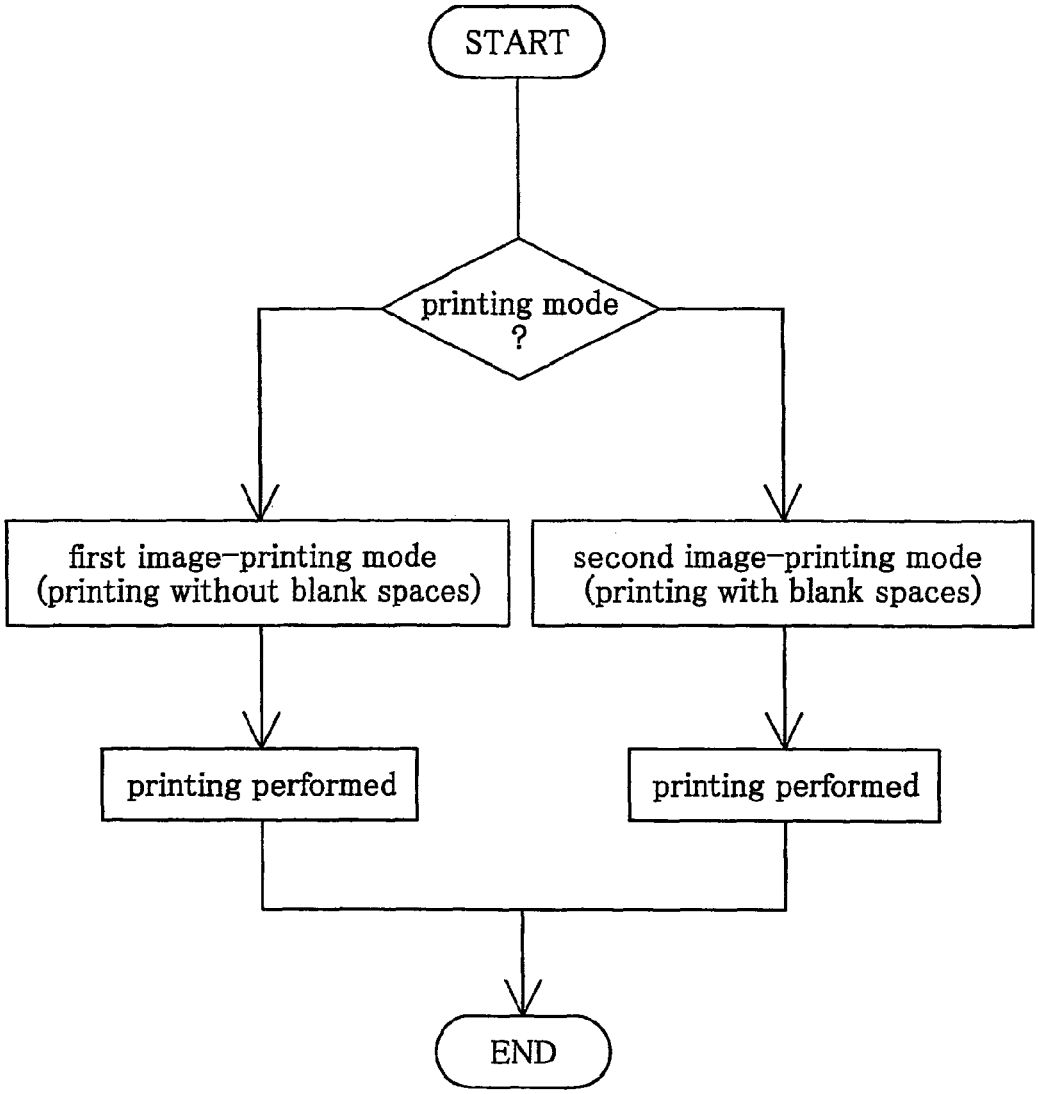
FIG. 34 is a flowchart depicting the sequence of printing routines.

FIG. 34 is a flowchart depicting the sequence of printing routines. The printer 22 has a first image-printing mode for printing images without blank spaces at the upper and lower edges of a printing paper P, and a second image-printing mode for printing images with blank spaces at the upper and lower edges of the printing paper P. When operated in the second image-printing mode, the printer 22 prints images with the aid of the nozzles belonging to all the nozzle groups, whereas operating the printer in the first image-printing mode entails printing images solely by means of the second nozzle group Nh and the third nozzle groups Ni and Nr, which are positioned downstream from the second nozzle group Nh in the sub-scanning direction. As used herein, the phrase "nozzles are used" refers to the fact that the nozzles can be used as needed. At least some of the nozzles belonging to the nozzle groups should therefore be used, and some of the other nozzles may sometimes be left unused, depending on the image data involved in the printing process. The relation between image data D and printing paper P is the same as shown in FIG. 10.

The user first selects either the first or second image-printing mode for printing. Selection information about the image-printing mode is specified for an application 95 through a keyboard 14, mouse 13, or other input device connected to a computer 90 (see FIG. 5). The application 95 or printer driver 96 prepares print data PD in accordance with the image-printing mode thus selected.

Figure 35:
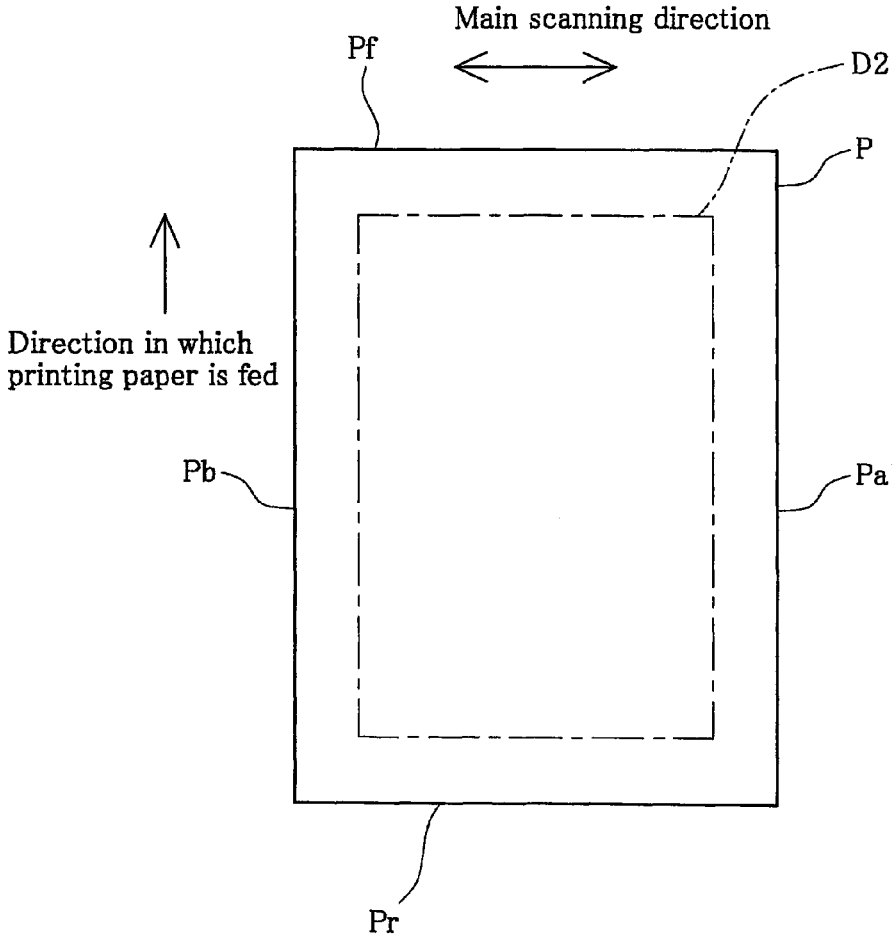
FIG. 35 is a plan view depicting the relation between the image data D2 and printing paper P in the second image-printing mode.

FIG. 35 is a plan view depicting the relation between the image data D2 and printing paper in the second image-printing mode. The image data D2 for the second image-printing mode is used to form images in an area smaller than the printing paper P, as can be seen in FIG. 35. The images are printed on the printing paper P while blank spaces are left along the upper, lower, left, and right edges.

F4. Feeding in the Course of Sub-Scanning Before Start of Printing

Figure 36:
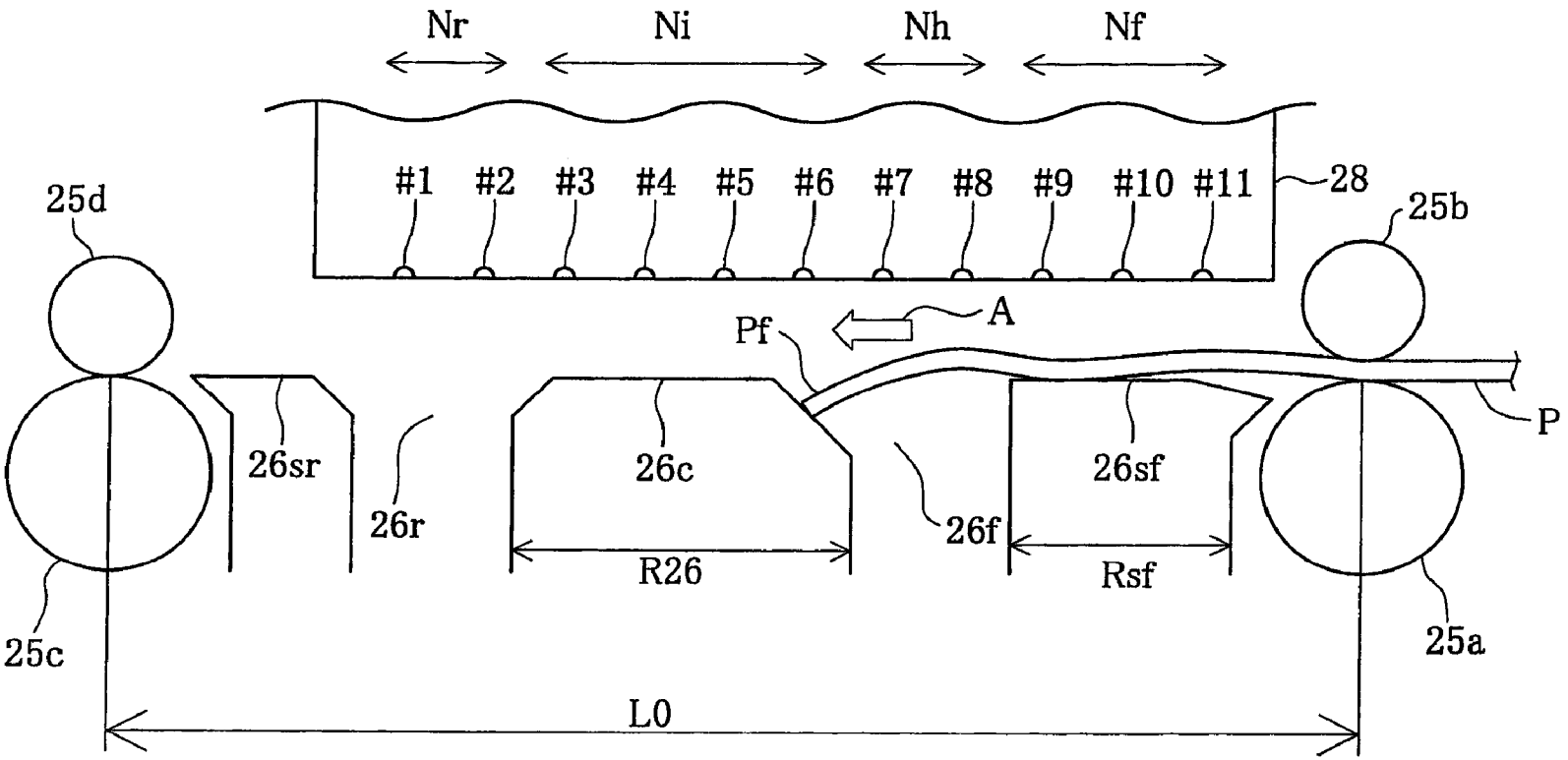
FIG. 36 is a diagram depicting the manner in which the front edge Pf of a sheet of printing paper P is transported over the platen 26.

FIG. 36 is a diagram depicting the manner in which the front edge Pf of a sheet of printing paper P is transported over a platen 26. For the sake of simplicity, the description will be given on the assumption that a single nozzle row comprises 11 nozzles. Here, nozzle Nos. 1 and 2 of each nozzle array constitute a fourth nozzle group Nr, and nozzle Nos. 3-6 constitute a third nozzle group Ni. Nozzle Nos. 7 and 8 constitute a second nozzle group Nh, and nozzle Nos. 9-11 constitute a first nozzle group Nf.

The front-edge portion Pf of a printing paper P is supported by the upstream support 26*sf* when the paper is first fed in the course of sub-scanning by the upstream paper feed rollers 25*a* and 25*b* over the platen 26. The front-edge portion Pf then passes over the upstream slot 26*f* and reaches a point above the central support 26*c*, as shown in FIG. 36. The front-edge portion Pf passes over the central support 26*c* and reaches a point above the downstream slot 26*r*. With the first image-printing mode, the feeding in the sub-scanning direction is stopped at this point, and ejection of ink droplets is started. In other words, the upper-edge routine is started. Feeding in the sub-scanning direction is sometimes stopped and ink droplets are ejected before the front edge Pf reaches the downstream slot 26*r* if the number of raster lines for the portion (see FIG. 10) established beyond the front edge Pf of the printing paper P exceeds a certain limit in relation to the image data. With the second image-printing mode, ejection of ink droplets starts after the front edge Pf is seized between the downstream paper feed rollers 25*c* and 25*d*.

In the embodiment shown in FIG. 36, the printing paper P is supported on the upstream support 26*sf* after being delivered by the upstream paper feed rollers 25*a* and 25*b*. The printing paper P is supported at least at two points by the upstream paper feed rollers 25*a* and 25*b* and the upstream support 26*sf*, and the portion in front of the upstream paper feed rollers 25*a* and 25*b* maintains constant orientation when the front-edge portion Pf of the printing paper P passes above the upstream slot 26*f*. It is therefore unlikely that the front-edge portion Pf will fall into the upstream slot 26*f*.

The upstream support 26*sf* faces the first nozzle group Nf and has a specific length Rsf in the sub-scanning direction. The printing paper P is therefore supported over a specific distance by the upstream paper feed rollers 25*a* and 25*b* and the upstream support 26*sf*, which has a specific length in the sub-scanning direction. Consequently, the portion of the printing paper P in front of the upstream paper feed rollers 25*a* and 25*b* can consistently maintain constant orientation, and the front-edge portion Pf is unlikely to fall into the upstream slot 26*f*.

The upstream support 26*sf* has a flat upper surface, and the printing paper P assumes a shape close to that of the upper surface of the flat upstream support 26*sf* under the action of gravity when the paper is on the upstream support 26*sf*. Consequently, at this point as well, the portion of the printing paper P in front of the upstream paper feed rollers 25*a* and 25*b* has a substantially flat shape, and the front-edge portion Pf is unlikely to fall into the upstream slot 26*f*.

Figure 37:
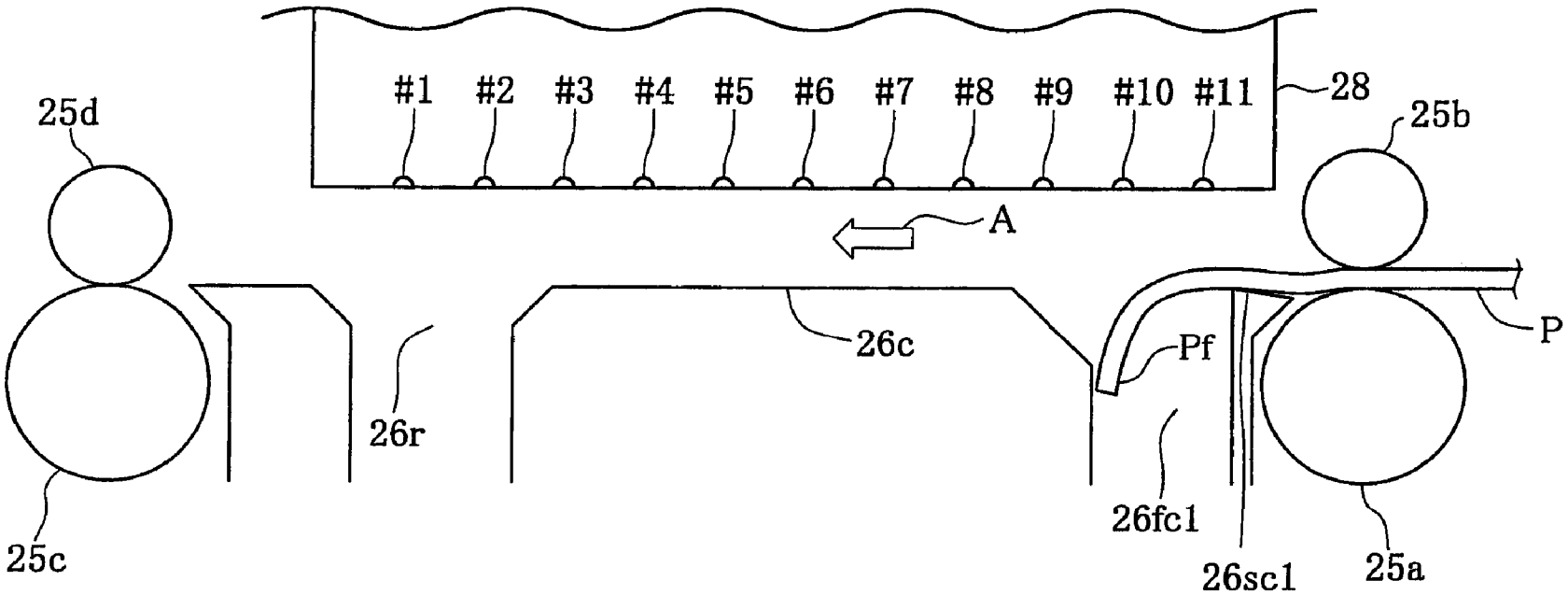
FIG. 37 is a diagram showing a case in which the front-edge portion Pf of a sheet of printing paper P reaches a point above the platen 26 of a printer pertaining to a comparative example.

FIG. 37 is a diagram showing a case in which the front-edge portion Pf of a sheet of printing paper P reaches a point above the platen 26 of a printer pertaining to a comparative example. The printer of the first embodiment was provided with an upstream support 26*sf* at a position opposite the area extending up to the most upstream nozzle No. 11 from nozzle No. 9. In the printer shown in FIG. 37, however, an upstream slot 26*fc*1 is provided at a position opposite the most upstream nozzle Nos. 11 and 10, and a portion is provided for supporting the printing paper P. A section 26*sc*1 of the platen 26 extends to the upstream side of the upstream slot 26*fc*1. All the other features are the same as in the first embodiment.

The printer of the comparative example is configured such that the section 26*sc*1 of the platen 26 is disposed further upstream from the print head 28, as are the upstream paper feed rollers 25*a* and 25*b* for supporting the printing paper P; and the interval between them is less than in the first embodiment. Adopting such an embodiment makes it more likely that the front-edge portion Pf of the printing paper P will fall into the upstream slot 26*fo* when the paper is first fed by the upstream paper feed rollers 25*a* and 25*b* over the platen 26 in the course of sub-scanning. In addition, the front-edge portion Pf is apt to fall into the upstream slot 26*fo* when the printing paper P is in the form of curved roll paper with a convex shape. The front-edge portion Pf is less likely to fall into the upstream slot 26*fo* if the section 26*sc*1 of the platen 26 has sufficient length in the sub-scanning direction on the upstream side, but adopting such an embodiment increases printer dimensions in the sub-scanning direction.

F5. Feeding in the Course of Sub-scanning During Printing

The first and second image-printing modes employ different patterns of feeding the system in the course of sub-scanning during printing. Whereas the first image-printing mode entails performing different feed patterns for sub-scanning in the upper-edge routine, intermediate routine, and lower-edge routine, the second image-printing mode is performed using the same feed patterns for sub-scanning. Such feeding in the course of sub-scanning is described below separately for the upper-edge and intermediate routines of the first image-printing mode, the lower-edge routine of the first image-printing mode, and the second image-printing mode.

(1) Upper-Edge Routine and Intermediate Routine of First Image-printing Mode

A single row of nozzles consists of 11 nozzles spaced at 3-raster line intervals. The eight nozzles disposed on the downstream side in the sub-scanning direction are the only nozzles used in the first image-printing mode, however. Accordingly, the manner in which raster lines are recorded by these nozzles in an area near the upper edge (tip) of printing paper is the same as shown in FIG. 9. In FIG. 9, only the eight nozzles participating in the printing operation are shown, with nonparticipating nozzles omitted from the drawing.

As a result of such printing, the area from the fifth to the eighth raster line (as counted from the uppermost raster line on which dots can be recorded by the print head) is recorded solely by nozzle Nos. 1 and 2 (fourth nozzle group Nr). The ninth and greater raster lines are recorded using Nos. 1-8 (nozzle groups Nr, Ni, and Nh). The relation between these raster lines and the printing paper P, and the effect thereof, will be described below.

In the first image-printing mode, two raster lines are selected for the width (see FIG. 10) of the portion of image data D provided up to the area outside the printing paper P beyond the upper edge Pf of the printing paper P. Similarly, two raster lines are selected for the width of the portion of image data D provided up to the area outside the printing paper P beyond the lower edge Pr of the printing paper P. The raster lines disposed along the lower edge will be described below.

Figure 38:
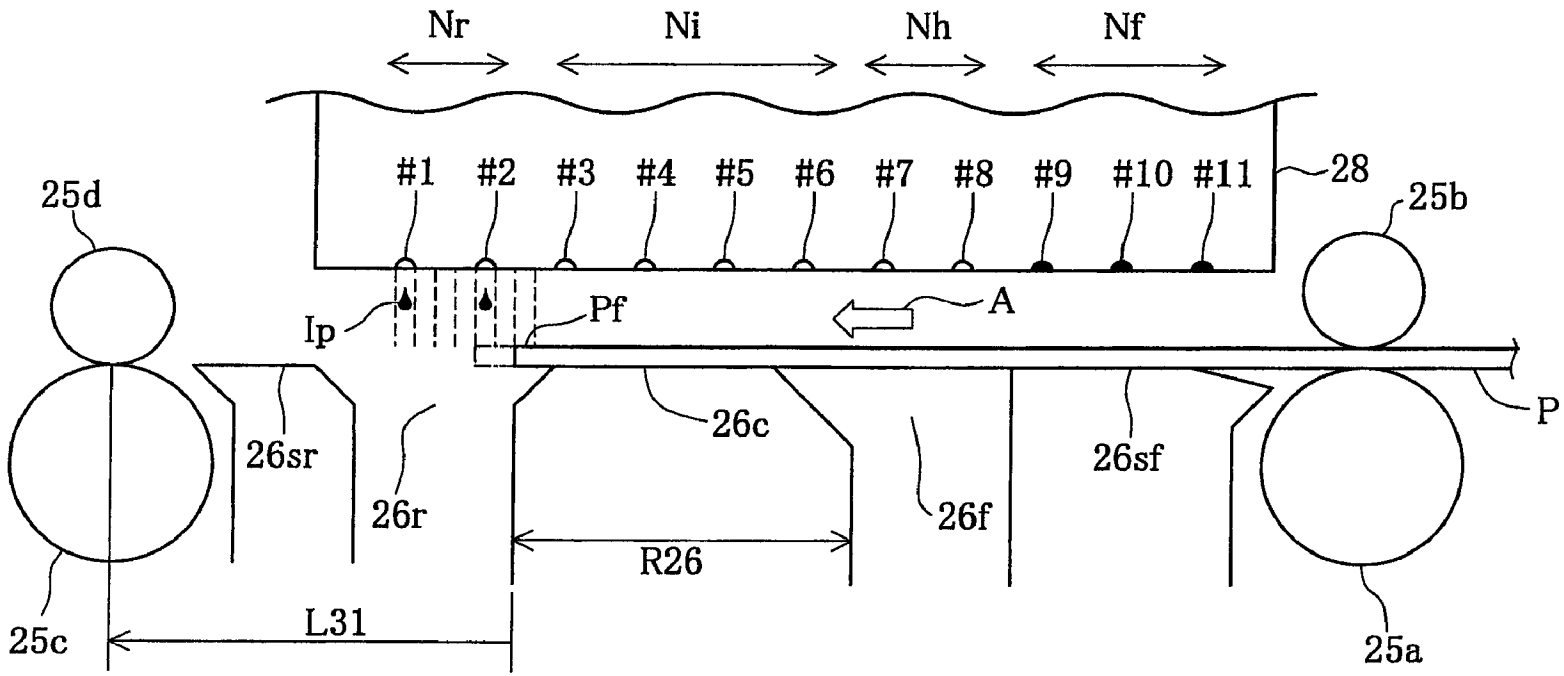
FIG. 38 is a side view depicting the relation between the print head 28 and the printing paper P at the start of printing.

FIG. 38 is a side view depicting the relation between the print head 28 and the printing paper P at the start of printing. Here, the central support 26*c* of the platen 26 is provided within a range R26 that extends from an upstream position corresponding to two raster lines (as counted from nozzle No. 2 of the print head 28) to a downstream position corresponding to two raster lines (as counted from nozzle No. 7). The upstream slot 26*f* is provided within a range that extends from a downstream position corresponding to a single raster line (as counted from nozzle No. 7) to an upstream position corresponding to two raster lines (as counted from nozzle No. 8). The downstream slot 26*r* is provided within a range that extends from a downstream position corresponding to two raster lines (as counted from nozzle No. 1) to an upstream position corresponding to two raster lines (as counted from nozzle No. 2). Consequently, the ink droplets Ip from nozzle Nos. 1 and 2 land in the downstream slot 26*r*, and the ink droplets from nozzle Nos. 7 and 8 land in the downstream slot 26*r* when the ink droplets are ejected from the nozzles in the absence of printing paper. In other words, the ink droplets from these nozzles are prevented from depositing on the central support 26*c* of the platen 26. In FIG. 38, nozzle Nos. 9-11, which are left unused according to the first image-printing mode, are shown as black dots.

The fourth nozzle group Nr, which is shown above in FIGS. 4 and 5, is composed of nozzle Nos. 1 and 2 shown in FIG. 38. The downstream slot 26*r* (see FIG. 33) is disposed underneath the portion passed over by these nozzles during main scanning. Printing is started when the upper edge Pf of the printing paper P reaches the position above the downstream slot 26*r* shown by the solid line in FIG. 38.

According to this embodiment, ink droplets can be prevented from depositing on the plate, and areas extending all the way to the upper edges of printing paper can be printed without blank spaces with the aid of dot-forming elements disposed opposite the slot as long as first embodiment.

The above-described results can be obtained by adopting an arrangement in which ink droplets are ejected from at least some of the nozzles belonging to the fourth nozzle group Nr (fourth sub-group of dot-forming elements), and dots are formed on a sheet of printing paper P when the upper edge of the printing paper P passes above the opening of the downstream slot 26*r* during the printing of images along the upper edge of the printing paper P.

The printing of images in the upper-edge portion of the printing paper P by the fourth nozzle group Nr (nozzle Nos. 1 and 2) is done by a CPU 41 (see FIG. 6), as is the printing of images in the intermediate portion by the nozzle groups Nr, Ni, and Nh (nozzle Nos. 1-8). In other words, the CPU 41 functions as the upper-edge printing unit and intermediate printing unit. The upper-edge printing unit 41*f* and intermediate printing unit 41*g* are shown in FIG. 6 as functional units of the CPU 41.

(2) Lower-Edge Routine and Intermediate Routine of First Image-Printing Mode

Figure 39:
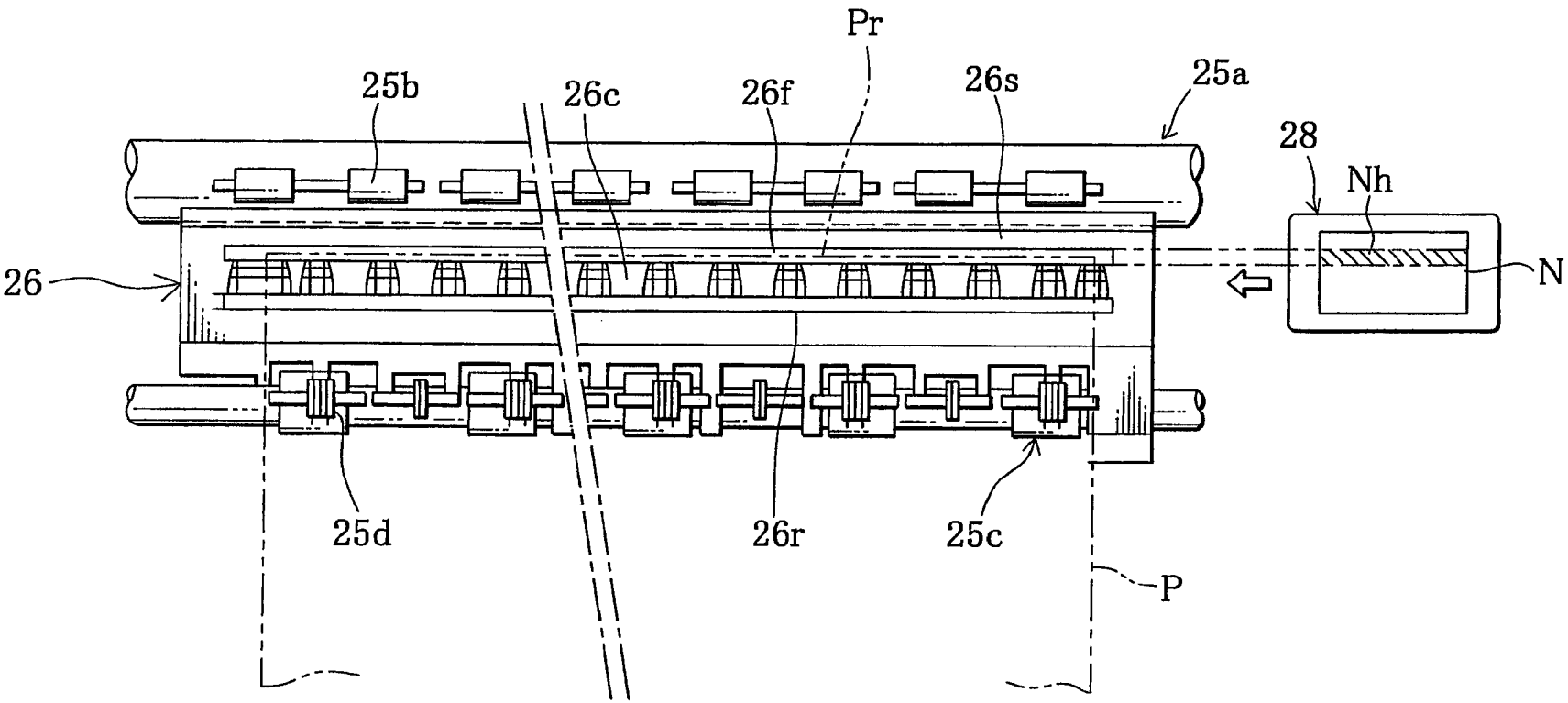
FIG. 39 is a plan view depicting the relation between the printing paper P and an upstream slot 26*f* during printing in the lower-edge portion Pr of the printing paper P.
Figure 40:
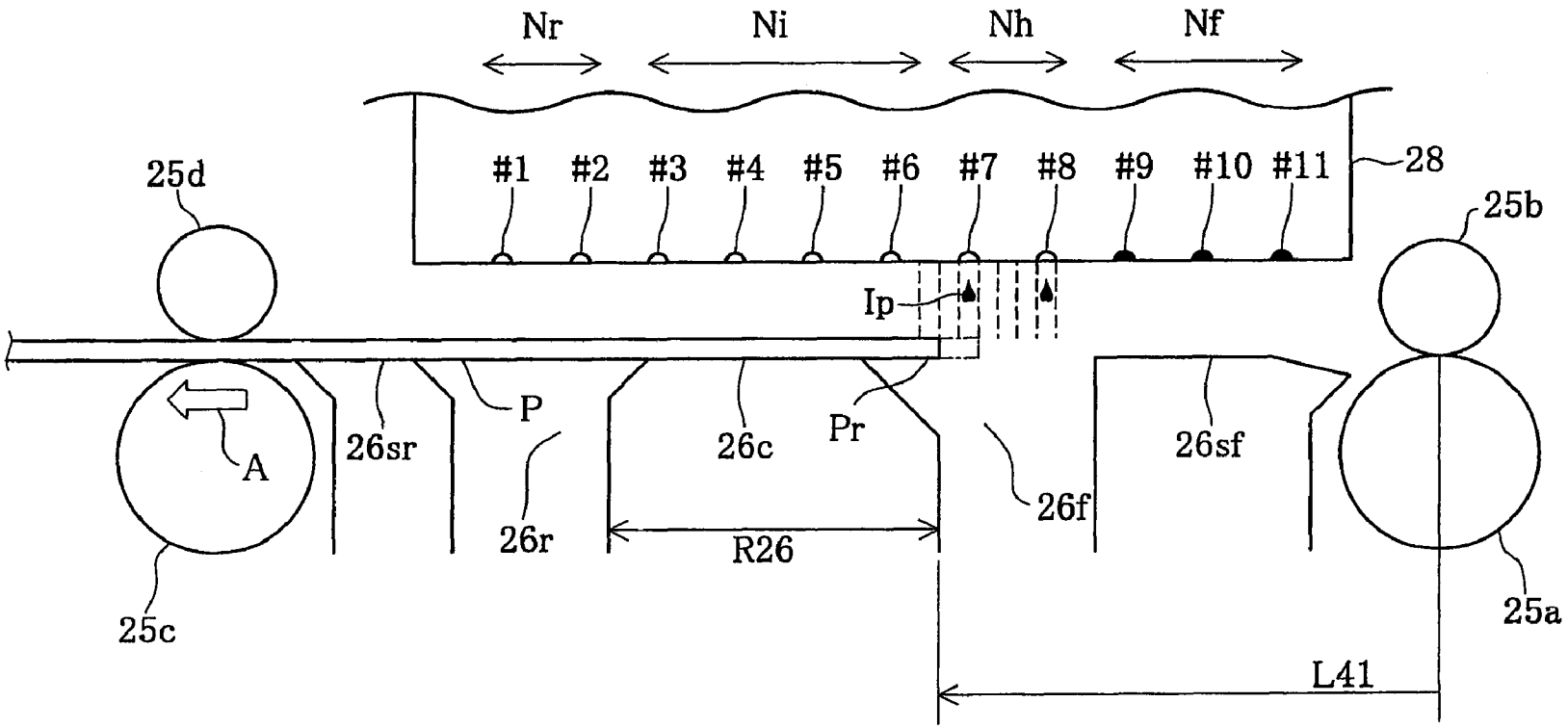
FIG. 40 is a side view depicting the relation between the printing paper P and the print head 28 during printing along the lowermost edge of the printing paper.

FIG. 39 is a plan view depicting the relation between the printing paper P and upstream slot 26*f* during printing in the lower-edge portion Pr of the printing paper P. In FIG. 15, the second nozzle group Nh in the hatched area of the print head 28 correspond to the area in which nozzle Nos. 7 and 8 are located. An upstream slot 26*f* is disposed underneath the area over which these nozzles pass during a main scan, and printing is completed when the lower edge Pr of the printing paper P reaches the position shown by the dashed line above the upstream slot 26*f*. The manner in which raster lines are recorded by these nozzles in an area near the lower edge of printing paper is the same as shown in FIG. 13.

FIG. 15 is a side view depicting the relation between the printing paper P and print head 28 during printing in the lower-edge portion Pr of the printing paper P. When images are printed in the lower-edge portion Pr of the printing paper P, the lower edge Pr of the printing paper P is disposed at the position occupied by the seventh raster line (as counted from the downstream edge in the sub-scanning direction), which is a raster line on which dots can be recorded by the nozzles of the print head 28, as described above (see FIG. 13). In other words, the lower edge of the printing paper P is disposed at a position six raster lines in front of nozzle No. 8. The ink droplets Ip ejected from the nozzle Nos. 7 and 8 will therefore directly descend into the upstream slot 26*f* if it is assumed that dots are recorded in the lowermost tier of the printable area and on the second raster line from the lowermost tier (sixth and fifth raster lines from bottom in FIG. 13).

As a result of such printing, the area from the fifth to the tenth raster line (as counted from the lowermost raster line on which dots can be recorded by the print head) is recorded solely by nozzle Nos. 7 and 8 (second nozzle group Nh). The ninth and greater raster lines are recorded using Nos. 1-8 (nozzle groups Nr, Ni, and Nh).

According to this embodiment, ink droplets can be prevented from depositing on the plate, and areas extending all the way to the lower edges of printing paper can be printed without blank spaces with the aid of dot-forming elements disposed opposite the slot as long as first embodiment.

The above-described results can be obtained by adopting an arrangement in which ink droplets are ejected from at least some of the nozzles belonging to the second nozzle group Nh (second sub-group of dot-forming elements), and dots are formed on a sheet of printing paper P when the lower edge of the printing paper P passes above the opening of the upstream slot 26*f* during the printing of images along the lower edge of the printing paper P. The intermediate routine that precedes the lower-edge routine is also carried out using solely the second nozzle group Nh (nozzle Nos. 7 and 8), third nozzle group Ni (nozzle Nos. 3-6), and fourth nozzle group Nr (nozzle Nos. 1 and 2). In other words, the routine dispenses with the use of the first nozzle group Nf, which is disposed further upstream from the second nozzle group Nh used for the lower-edge routine. A transfer from the intermediate routine to the lower-edge routine can therefore be accomplished in a smoother manner than through the use of all the nozzles (nozzle Nos. 1-11), which include the first nozzle group Nf, during the intermediate routine.

In the present embodiment, the sheet is fed in the sub-scanning direction solely by the downstream paper feed rollers 25*c* and 25*d*, and the printing operation is completed in a comparatively short feeding, because the recording on the lower edge of the paper is executed above the upstream slot 26*f* not above the down stream slot 26*r*. Accordingly, the printing operation yields better image quality.

The printing paper P is supported at three locations on the central portion 26*c* and the downstream support 26*sr* of the platen 26 and the downstream paper feed rollers 25*c* and 25*d* when images are printed on the area occupied by the lower edge. For this reason, the lower-edge portion of the printing paper P has comparatively high resistance to downward bending when disposed above the upstream slot 26*f*. It is therefore less likely that the quality of printing in the upper-edge portion will be adversely affected by the bending of the printing paper.

Figure 6:
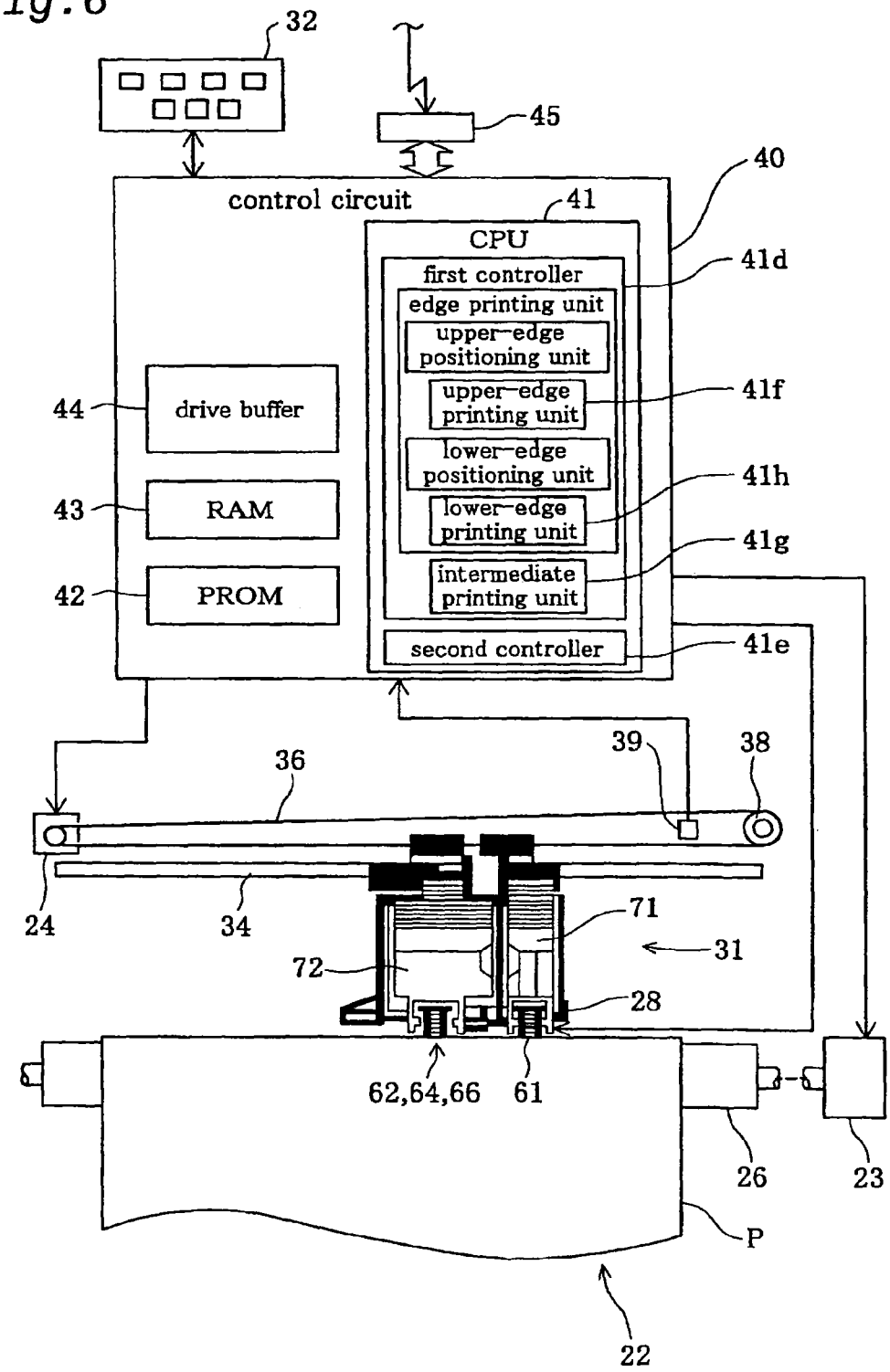
FIG. 6 is a diagram depicting the structure of the mechanical portion of the present printing device.

The above-described printing of images in the lower-edge portion of the printing paper P by the second nozzle group Nh (nozzle Nos. 7 and 8) is done by a CPU 41 (see FIG. 6). In other words, the CPU 41 functions as the lower-edge printing unit. As described above, it is the CPU 41 that controls the units and allowing printing to be performed according to the first image-printing mode. In other words, the CPU 41 functions as the first image-printing unit. The first controller 41*d* and lower-edge printing unit 41*h* are shown in FIG. 6 as functional units of the CPU 41.

(3) Second Image-Printing Mode

Figure 41:
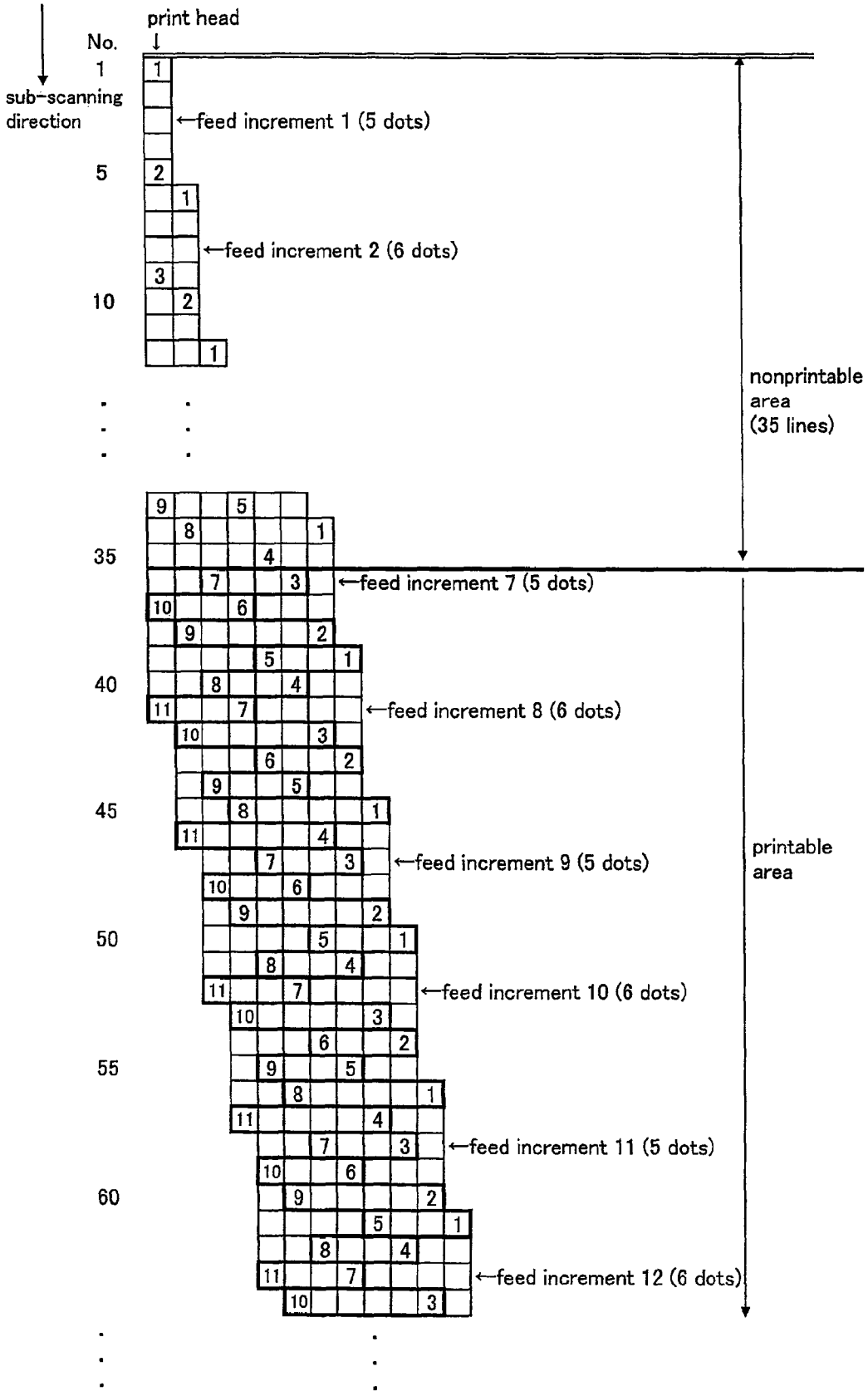
FIG. 41 is a diagram depicting the manner in which raster lines are recorded by particular nozzles in accordance with the second image-printing mode.

FIG. 41 is a diagram depicting the manner in which raster lines are recorded by particular nozzles in accordance with the second image-printing mode. In the second image-printing mode (see FIG. 34), all the nozzles (Nos. 1-11) are employed. As used herein, the phrase "nozzles are used" refers to the fact that the nozzles can be used as needed. Consequently, some of the nozzles may be left unused with certain types of image data for printing.

In the second image-printing mode, the system is alternately fed in 5- and 6-dot increments in the sub-scanning direction throughout the printing process, as can be seen in FIG. 41. As a result, the nonprintable areas formed along the upper and lower edges of the printing paper P are wider than those observed in the case of the first image-printing mode. For example, the nonprintable area along the upper edge extends across four raster lines from the upper edge in FIG. 9, as opposed to 35 raster lines in FIG. 41. The area (nonprintable area) extending across these 35 raster lines constitutes a blank space along the upper edge of the printing paper P, assuming that the position of the uppermost raster line on which dots can be recorded by nozzles is the imaginary position of the upper edge of paper.

No particular restrictions are imposed on the nozzles for forming dots in the upper- and lower-edge portions of printable areas. With the second image-printing mode, in which images are printed while blank spaces are formed in the edge portions of the printing paper P, no inconvenience is encountered, however, because there is no need to print images near the upper or lower edge only by the nozzles (Nos. 1, 2, 7, and 8) above the slots. By contrast, the second image-printing mode is performed using all the nozzles (Nos. 1-11), allowing images to be printed faster than with the first image-printing mode, in which only a limited number of nozzles are used for printing.

As described above, it is the CPU 41 that controls the units and allows printing to be performed according to the second image-printing mode. In other words, the CPU 41 functions as the second image-printing unit. The second controller 41*e* is shown in FIG. 6 as a functional unit of the CPU 41.

G. Sixth Embodiment

Figure 42:
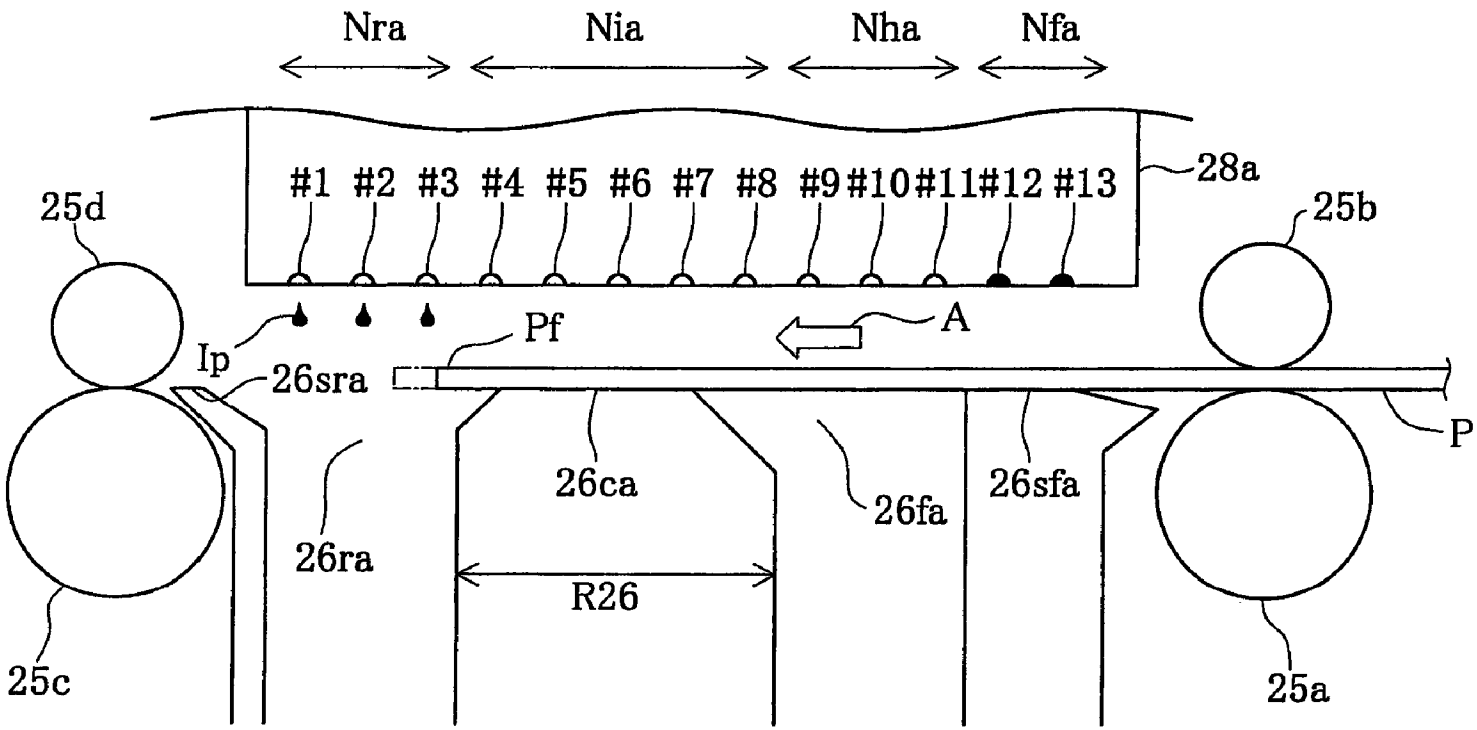
FIG. 42 is a side view depicting the relation of a print head 28*a* with an upstream slot 26*fa* and a downstream slot 26*ra* according to a second embodiment.

FIG. 42 is a side view depicting the relation of a print head 28*a* with an upstream slot 26*fa* and a downstream slot 26*ra* according to a second embodiment. A description will now be given with reference to a case in which the number of nozzles and the method for recording each raster line are different from those employed in the first embodiment. In the second embodiment, a single nozzle row contains 13 nozzles. In the printing device used herein, the upstream support 26*sf* is disposed opposite nozzle Nos. 12 and 13 (first nozzle group Nfa) in the sub-scanning direction. The upstream slot 26*fa* is disposed opposite nozzle Nos. 9-11 (second nozzle group Nha). The central support 26*ca* is disposed opposite nozzle Nos. 4-8 (third nozzle group Nia). The downstream slot 26*ra* is disposed opposite nozzle Nos. 1-3 (fourth nozzle group Nra). The rest of the structure is the same as that of the printing device pertaining to the first embodiment.

The first nozzle group Nfa of the second embodiment is an assembly corresponding to the first sub-group of dot-forming elements, and the second nozzle group Nha is an assembly corresponding to the second sub-group of dot-forming elements. The third nozzle group Nia is an assembly corresponding to the third sub-group of dot-forming elements, and the fourth nozzle group Nra is an assembly corresponding to the fourth sub-group of dot-forming elements.

The second embodiment is performed without overlap printing. In other words, each raster line is recorded by a single nozzle in the course of a main scan. The nozzles employed for the first image-printing mode are nozzle Nos. 1-11 (nozzle groups Nra, Nia, and Nha), and the nozzles employed for the second image-printing mode are nozzle Nos. 1-13 (nozzle groups Nra, Nia, Nha, and Nfa).

(1) Upper-Edge Routine and Intermediate Routine of First Image-Printing Mode

The manner in which raster lines are recorded by these nozzles in an area near the upper edge (tip) of printing paper is the same as shown in FIG. 19. The upper-edge routine is performed without the use of nozzles other than nozzle Nos. 1-3 (the fourth nozzle group Nra) of the print head 28*a*. The nozzles (Nos. 1-11) (the fourth nozzle group Nra, Nia and Nha) are used in the transitional routine. The operation then proceeds to the intermediate routine, and regular 11-dot feed increments are then repeated, as shown in FIG. 19. Another feature of the sixth embodiment is that nozzle Nos. 1-3 (the fourth nozzle group Nra) are the only nozzles involved in the recording of the 20 raster lines counted from the position occupied by the upper edge and the 16 preset raster lines extending beyond the intended position of the upper edge of the printing paper P.

(2) Lower-Edge Routine and Intermediate Routine of First Image-Printing Mode

The manner in which raster lines are recorded by these nozzles in an area near the lower edge of printing paper is the same as shown in FIGS. 20 and 21.

In the present embodiment, 3-dot feeding is repeated four times in accordance with a transitional routine using nozzle Nos. 1-11 (the nozzle groups Nra, Nia and Nha) after 11-dot constant feeding has been repeated in the sub-scanning direction from the (n+1)-th cycle to the (n+3)-th cycle in accordance with an intermediate routine, as shown in FIGS. 20 and 21. Three-dot feeding is then performed using solely nozzle Nos. 9-11 (the second nozzle group Nha) in accordance with a lower-edge routine.

The number of raster lines recorded solely by the nozzles (Nos. 9-11) (the second nozzle group Nha) above the upstream slot 26*fa* in the lower-edge portion of the printing paper P should preferably be set above the number of raster lines recorded solely by the nozzles (Nos. 1-3) (the second nozzle group Nra) above the downstream slot 26*ra* in the upper-edge portion of the printing paper P in the manner adopted in the second embodiment.

(3) Second Image-Printing Mode

Figure 43:
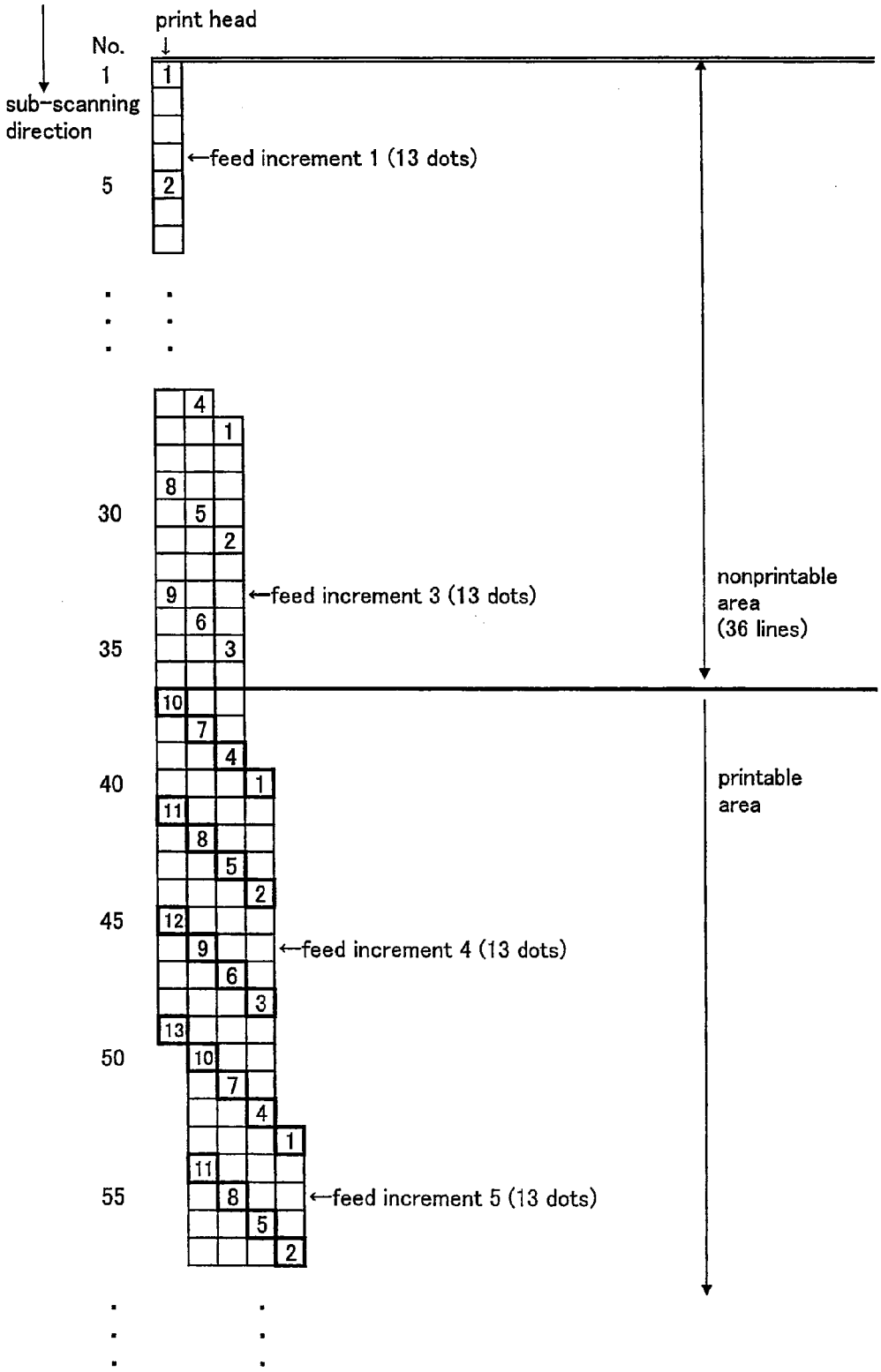
FIG. 43 is a diagram depicting the manner in which raster lines are recorded by particular nozzles in accordance with the second image-printing mode of the second embodiment.
Figure 44:
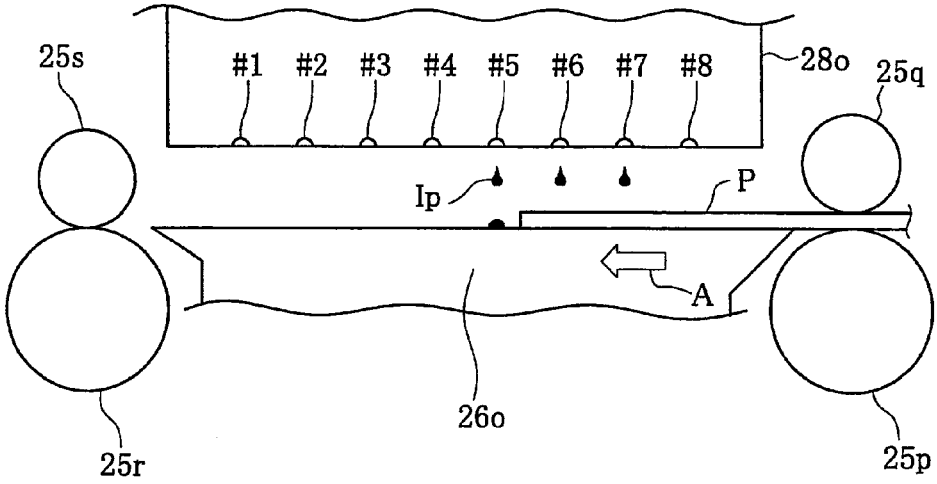
FIG. 44 is a side view depicting the periphery of a print head for a conventional printer.

FIG. 43 is a diagram depicting the manner in which raster lines are recorded by particular nozzles in accordance with the second image-printing mode of the second embodiment. In the second image-printing mode, all the nozzles (Nos. 1-13 from nozzle groups Nra, Nia, Nha, and Nfa) are employed. In the second image-printing mode, the system is repeatedly fed in 13-dot increments in the sub-scanning direction throughout the printing process, as can be seen in FIG. 43. As a result, the nonprintable areas formed along the upper and lower edges of the printing paper P are wider than those observed in the case of the first image-printing mode. For example, the nonprintable area along the upper edge extends across six raster lines from the upper edge in FIG. 18, as opposed to 36 raster lines in FIG. 43. The area (nonprintable area) extending across these 36 raster lines constitutes a blank space along the upper edge of the printing paper P, assuming that the position of the lowermost raster line on which dots can be recorded by nozzles is the imaginary position of the lower edge of paper. No particular restrictions are imposed on the nozzles for forming dots in the upper- and lower-edge portions of printable areas. The second image-printing mode is performed using all the nozzles (Nos. 1-13), allowing images to be printed faster than with the first image-printing mode, in which only a limited number of nozzles are used for printing.

H. Modifications

The present invention is not limited by the above-described embodiments or embodiments and can be implemented in a variety of ways as long as the essence thereof is not compromised. For example, the following modifications are possible.

H1. Modification 1

The first, second, and third embodiments involved performing constant feeding in 1-, 3-, and 6-dot increments, respectively, in accordance with upper- and lower-edge routines. However, the feeding method of the upper- and lower-edge routines is not limited thereby and may include constant feeding in 2-, 4-, or 5-dot increments, depending on the nozzle pitch or the number of nozzles in a nozzle row. In other words, any feeding method may be adopted as long as the maximum feed increment in the sub-scanning direction is less than the maximum feed increment in the sub-scanning direction for the intermediate routine. In should be noted that adopting smaller feed increments in the sub-scanning direction for the upper-edge routine allows the upper edge of printing paper to be recorded with the nozzles disposed further downstream in the sub-scanning direction. The downstream slot can therefore be narrowed, and the upper platen surface for supporting the printing paper can be broadened. Similarly, adopting smaller feed increments in the sub-scanning direction for the lower-edge routine allows the upper edge of printing paper to be recorded with the nozzles disposed further upstream in the sub-scanning direction. The upstream slot can therefore be narrowed, and the upper platen surface for supporting the printing paper can be broadened.

Neither is the feeding method of the intermediate routine limited to constant feeding in 11-dot increments, constant feeding in 24-dot increments, or an non-constant feeding arrangement in which the system is repeatedly fed in 5-, 2-, 3-, and 6-dot increments in the order indicated. For example, feeding the system in 5-, 3-, 2-, and 6-dot increments may be adopted for the structure described in the first embodiment. Depending on the number of nozzles, the nozzle pitch, or the like, combinations of other feed increments may be adopted, or constant feeding methods involving other feed increments carried out. In other words, any type of secondary scan feeding may be adopted as long as the maximum feed increment in the sub-scanning direction is less than the maximum feed increment in the sub-scanning direction for the upper or lower-edge routine.

H2. Modification 2

The above-described embodiments were configured such that the images provided beyond the edges of printing paper extended over two raster lines along both the upper and lower edges in the first embodiment, and constituted 16 raster lines along the upper edge and 30 raster lines along the lower edge in the second embodiment. In the third embodiment, the images extend over 30 raster lines along the upper edge and 40 raster lines along the lower edge. The images that extend beyond the edges of printing paper are not limited by these dimensions, however. For example, the width of the portion occupied by the image data D for an area lying outside the printing paper P beyond the upper edge Pf of the printing paper P may be half that of the downstream slot 26*r*. Similarly, the width of the portion occupied by the image data D for an area lying outside the printing paper P beyond the lower edge Pr of the printing paper P may be half that of the upstream slot 26*f*. In other words, the width of the portion occupied by the image data for an area lying outside a printing paper beyond either edge should be less than the width of the downstream slot 26*r* along the upper edge, and less than the width of the upstream slot 26*f* along the lower edge. Adopting this arrangement makes it possible to prevent the ink droplets Ip for recording the images lying beyond a printing paper P from being deposited on the upper surface of the platen 26 when the ends of the printing paper P fail to reach the intended position. Approximately the same amount of shift can be permitted both in cases in which the printing paper P is shifted upstream and in cases in which the paper is shifted downstream, assuming that the affected area is about half the slot width.

The same applies to the right and left edges. That is, the width of the portion occupied by the image data for an area lying outside a printing paper beyond either edge should be less than the width of the left slot 26*na* or the right slot 26*nb*. Approximately the same amount of shift can be permitted both in cases in which the printing paper P is shifted upstream and in cases in which the paper is shifted downstream, assuming that the affected area is about half the slot width.

H3. Modification 3

Although the above embodiments were described with reference to cases in which both the upper- and lower-edge routine were carried out, it is also possible to perform only one of these routines as needed. In addition, the printing devices of the present embodiments were configured such that the platen 26 was provided with an upstream slot 26*f* and a downstream slot 26*r* on the upstream side and downstream sides, respectively, in the sub-scanning direction, although providing only one of them is also acceptable.

H4. Modification 4

In the fifth embodiment, a downstream slot 26*r* is disposed underneath nozzle Nos. 1 and 2, and images are printed in the upper-edge portion by nozzle Nos. 1 and 2 in accordance with a first image-printing mode. The sixth embodiment is similar in the sense that images are printed in the upper-edge portion by nozzle Nos. 1-3, which are disposed above the slot. However, this arrangement is not the only possible option for the relation between the downstream slot and the nozzles for printing images in the upper-edge portion of printing paper. The embodiment in which each nozzle row has 48 nozzles may, for example, be configured such that a downstream slot is disposed underneath nozzle Nos. 1-5, and images are printed in the upper-edge portion by nozzle Nos. 1-5 (fourth sub-group of dot-forming elements). Specifically, adopting an arrangement in which dots are formed in the upper-edge portion of a print medium with the aid of the fourth nozzle group Nr (fourth sub-group of dot-forming elements) above the opening of the downstream slot has the effect of allowing images to be printed without blank spaces in the upper-edge portion while preventing platen soiling.

In the fifth embodiment, an upstream slot 26*f* is disposed underneath nozzle Nos. 7 and 8, and images are printed in the lower-edge portion by nozzle Nos. 7 and 8 in accordance with a first image-printing mode. The sixth embodiment is similar in the sense that images are printed in the lower-edge portion by nozzle Nos. 9-11, which are disposed above the slot. The relation between the upstream slot and the nozzles for printing images in the lower-edge portion of printing paper is not limited, however, by the embodiments adopted for the fifth and sixth embodiments. The embodiment in which each nozzle row has 48 nozzles may, for example, be configured such that an upstream slot is disposed underneath nozzle Nos. 31-34, and images are printed in the lower-edge portion by nozzle Nos. 31-34 (second sub-group of dot-forming elements). Specifically, adopting an arrangement in which dots are formed in the lower-edge portion of a print medium with the aid of the second sub-group of dot-forming elements above the opening of the upstream slot has the effect of allowing images to be printed without blank spaces in the lower-edge portion while preventing platen soiling. The first to fourth nozzle groups should each contain one or more nozzles.

H5. Modification 5

The present invention can be adapted to monochromatic printing in addition to color printing. The use of the present invention is not limited to ink-jet printers alone and commonly includes all dot-recording devices in which images are recorded on the surface of a print medium by a print head having a plurality of dot-forming element arrays. As used herein, the term "dot-forming element" refers to a dot-forming constituent element such as an ink nozzle of an ink-jet printer.

H6. Modification 6

In the above embodiments, software can be used to perform some of the functions carried out by hardware, or, conversely, hardware can be used to perform some of the functions carried out by software. For example, a host computer 90 can be used to perform some of the functions carried out by the CPU 41 (FIG. 6).

The computer programs for performing such functions may be supplied as programs stored on floppy disks, CD-ROMs, and other types of computer-readable recording media. The host computer 90 may read the computer programs from these recording media and transfer the data to internal or external storage devices. Alternatively, the computer programs can be installed on the host computer 90 from a program-supplying device via a communications line. Computer programs stored by an internal storage device are executed by the host computer 90 when the functions of the computer programs are to be performed. Alternatively, computer programs stored on a storage medium may be executed directly by the host computer 90.

As used herein, the term "host computer 90" refers both to a hardware device and to an operating system, and designates a hardware device capable of operating under the control of an operating system. Computer programs allow such a host computer 90 to perform the functions of the above-described units. Some of the aforementioned functions can be performed by an operating system rather than an application program.

As used herein, the term "computer-readable recording medium" is not limited to a portable recording medium such as a floppy disk or a CD-ROM and includes various RAMs, ROMs, and other internal computer storage devices as well as hard disks and other external storage devices fixed to the computer.

Although the present invention has been described and illustrated in detail, it is clearly understood that the same is by way of illustration and example only and is not to be taken by way of limitation, the spirit and scope of the present invention being limited only by the terms of the appended claims.

I claim:

1. A dot-recording device for recording dots on a print medium comprising:

a dot-recording head provided with a plurality of dot-forming elements for ejecting ink droplets;

a head driver configured to drive at least part of the plurality of dot-forming elements to form dots;

a transporting unit configured to transport the print medium in a transporting direction;

a platen configured to support the print medium at a position opposite the dot-recording head, the platen having an ink accepting portion, a width of the ink accepting portion in the transporting direction corresponding to a specific range of the dot-recording head including part of the plurality of dot-forming elements; and a controller configured to control the head driver and the transporting unit, wherein the controller includes:

(a) a first recording mode to effect printing near an edge of the print medium, in the first recording mode the controller performing edge printing by ejecting ink droplets from at least some of the dot-forming elements disposed opposite the ink accepting portion without ejecting ink droplets from the dot-forming elements that are not disposed opposite the ink accepting portion, and the edge of the print medium is disposed above the ink accepting portion; and (b) a second recording mode to effect printing in an intermediate portion of the print medium, a maximum sub-scan feed amount in the second recording mode being greater than a maximum sub-scan feed amount in the first recording mode, wherein in the second recording mode the controller ejects ink droplets from at least some of the dot-forming elements disposed opposite the ink accepting portions and at least some of the drop-forming elements that are not disposed opposite the ink accepting portion.

2. A dot-recording device as defined in claim 1, wherein the ink accepting portion is disposed at a position opposite a dot-forming element that is located at a downstream edge in the transporting direction; and the controller performs the edge printing when a front edge of the print medium is disposed above the ink accepting portion.

3. A dot-recording device as defined in claim 1, wherein the ink accepting portion is disposed at a position opposite a dot-forming element that is located at an upstream edge in the transporting direction; and the controller performs the edge printing when a rear edge of the print medium is disposed above the ink accepting portion.

4. A dot-recording method for recording dots on a print medium up to an edge of the print medium using a dot-recording device, comprising:

(a) preparing a dot-recording device including:

a dot-recording head having a plurality of dot-forming elements for ejecting ink droplets; and a platen configured to support a print medium at a position opposite the dot-recording head, the platen having an ink accepting portion, a width of the ink accepting portion in a transporting direction corresponding to a specific range of the dot-recording head including part of the plurality of dot forming elements:

(b) in a first recording mode to effect printing near an edge of the print medium, performing edge printing by ejecting ink droplets from at least some of the dot-forming elements disposed opposite the ink accepting portion without ejecting ink droplets from the dot-forming elements that are not disposed opposite the ink accepting portion, and the edge of the print medium is disposed above the ink accepting portion; and (c) in a second recording mode to effect printing in an intermediate portion of the print medium, performing intermediate printing with a maximum sub-scan feed amount being greater than a maximum sub-scan feed amount in the first recording mode, wherein in the second recording mode the controller ejects ink droplets from at least some of the dot-forming elements disposed opposite the ink accepting portions and at least some of the drop-forming elements that are not disposed opposite the ink accepting portion.

5. A dot-recording method as defined in claim 4, wherein the ink accepting portion is disposed at a position opposite a dot-forming element that is located at a downstream edge in the transporting direction; and the edge printing is performed when a front edge of the print medium is disposed above the ink accepting portion.

6. A dot-recording method as defined in claim 4, wherein the ink accepting portion is disposed at a position opposite a dot-forming element that is located at an upstream edge in the transporting direction; and the edge printing is performed when a rear edge of the print medium is disposed above the ink accepting portion.

* * * * *